US010940352B2

(12) United States Patent
Worsman

(10) Patent No.: US 10,940,352 B2
(45) **Date of Patent: *Mar. 9, 2021**

(54) SYSTEMS AND COMPOSITIONS FOR SUPPRESSING AND EXTINGUISHING FIRES

(71) Applicant: Chrystel Worsman, Big Bear City, CA (US)

(72) Inventor: Chrystel Worsman, Big Bear City, CA (US)

(73) Assignee: APEX FIRE TECHNOLOGIES LLC, Woodland Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/698,830

(22) Filed: Nov. 27, 2019

(65) Prior Publication Data

US 2020/0101340 A1 Apr. 2, 2020

Related U.S. Application Data

(63) Continuation-in-part of application No. PCT/US2018/035443, filed on May 31, 2018.

(60) Provisional application No. 62/582,689, filed on Nov. 7, 2017, provisional application No. 62/514,426, filed on Jun. 2, 2017.

(51) Int. Cl.
*A62D 1/00* (2006.01)
*A62D 1/02* (2006.01)

(52) U.S. Cl.
CPC ..... *A62D 1/0014* (2013.01); *A62D 1/0064* (2013.01); *A62D 1/005* (2013.01); *A62D 1/0042* (2013.01); *A62D 1/0071* (2013.01); *A62D 1/0092* (2013.01)

(58) Field of Classification Search
CPC .. A62D 1/0014; A62D 1/0064; A62D 1/0042; A62D 1/005; A62D 1/0071; A62D 1/0092; A62D 1/0035; A62D 1/00
See application file for complete search history.

(56) References Cited

U.S. PATENT DOCUMENTS 4,851,224 A 7/1989 Mcannalley
5,425,885 A * 6/1995 Zhao ..... A62D 1/0035 252/2
7,569,155 B2 8/2009 Schaefer et al.
8,257,607 B1 * 9/2012 Johnson ..... A62D 1/0035 252/2
8,815,113 B2 8/2014 Kostova
2010/0181084 A1 7/2010 Carmo
2011/0240309 A1 10/2011 Kingma et al.
(Continued)

OTHER PUBLICATIONS

ECOPOL Source:http://www.bio-ex.com/products/industry/product/ecopol-multi-risk-fluorine-free-ecological-foam-concentrate-effective-on-all-types-of-fire-high-expansion-foam-6.
(Continued)

*Primary Examiner* — Andrew J. Oyer
(74) *Attorney, Agent, or Firm* — Obi Iloputaife

(57) ABSTRACT

Systems and compositions for suppressing and extinguishing several classes of fire, e.g. Class D, fires are disclosed. The composition includes some form of powdered *Aloe vera*, a bio-surfactant, a thickening agent, and a diol. The composition may be mixed with paint to coat a structure thus protecting the structure from fire. The composition may also be mixed with epoxy resin for coating a structure also for fire protection. The composition may also be in the form of a gel in canisters for extinguishing fire.

21 Claims, 10 Drawing Sheets

| Product ID | Class A | Class B | Class C | Class D | Class K | Health | Reactivity | Flammability | Mix Reaction | MSDS | Exposure to 3623°F | Aquatic Life |
|---|---|---|---|---|---|---|---|---|---|---|---|---|
| APEX-V | Yes | Yes | Yes | Yes | Yes | 0 | 0 | 0 | N/A | 0-0-0 | Boils | Yes |
| Commercial Formulation 1 | Yes | No | No | No | No | 1 | 0 | 1 | Not Compatible | 1-0-0 | Ignition | No |
| Commercial Formulation 2 | Yes | Yes | No | No | No | 1 | 0 | 0 | None | 1-0-0 | Boils/Burns Away | No |
| Commercial Formulation 3 | Yes | Yes | No | No | No | 1 | 0 | 0 | None | 1-0-0 | Boils/Burns Away | No |
| Commercial Formulation 4 | Yes | Yes | No | No | No | 1 | 0 | 1 | None | | Boils/Burns Away | No |
| Commercial Formulation 5 | Yes | Yes | No | No | No | 1 | 0 | 0 | None | 1-0-0 | Boils/Burns Away | No |
| Commercial Formulation 6 | Yes | Yes | No | No | No | 1 | 0 | 1 | Not Compatible | 1-0-0 | Boils | No |
| Commercial Formulation 7 | Yes | Yes | No | No | No | 1 | 0 | 0 | None | 0-0-0? | Boils/Burns Away | Yes |
| Commercial Formulation 8 | Yes | Yes | No | No | No | 1 | 0 | 0 | None | 1-0-0 | Boils | Yes |
| Commercial Formulation 9 | Yes | Yes | No | No | No | 2 | 0 | 0 | None | 2-0-0 | Boils | No |
| Commercial Formulation 10 | Yes | Yes | No | No | No | 2 | 0 | 0 | None | 2-0-0 | Boils/Burns Away | No |
| Commercial Formulation 11 | Yes | No | No | No | No | 2 | 0 | 0 | None | 2-0-0 | Boils/Burns Away | No |
| Commercial Formulation 12 | Yes | No | No | No | No | 1 | 0 | 0 | None | 1-0-0 | Boils/Burns Away | No |
| Commercial Formulation 13 | Yes | Yes | No | No | No | 0 | 0 | 0 | None | 0-0-0 | Boils/Burns Away | No |

(56) References Cited

U.S. PATENT DOCUMENTS

| | | | |
|---|---|---|---|
| 2015/0251034 | A1 | 9/2015 | Vellmar |
| 2016/0166867 | A1 | 6/2016 | Hansen et al. |

OTHER PUBLICATIONS

Bio-based flame retardants: When nature meets fire protection Source:https://www.sciencedirect.com/science/article/pii/S0927796X16301516.

Aloe Vera Tea, About Aloe Tea, May 17, 2017 [Retrieved on Nov. 27, 2019). Retrieved from 1-13, 31-33, 41-44, 49, the internet: <URL: https://web.archive.org/web/20170517152948/http://www.aloe-tea.com/aboutaloetea.php.

* cited by examiner

| Product ID | Class A | Class B | Class C | Class D | Class K | Health | Reactivity | Flammability | Mix Reaction | MSDS | Exposure to 3623°F | Aquatic Life |
|---|---|---|---|---|---|---|---|---|---|---|---|---|
| APEX-V | Yes | Yes | Yes | Yes | Yes | 0 | 0 | 0 | N/A | 0-0-0 | Boils | Yes |
| Commercial Formulation 1 | Yes | No | No | No | No | 1 | 0 | 1 | Not Compatible | 1-0-0 | Ignition | No |
| Commercial Formulation 2 | Yes | Yes | No | No | No | 1 | 0 | 0 | None | 1-0-0 | Boils/Burns Away | No |
| Commercial Formulation 3 | Yes | Yes | No | No | No | 1 | 0 | 0 | None | 1-0-0 | Boils/Burns Away | No |
| Commercial Formulation 4 | Yes | Yes | No | No | No | 1 | 0 | 1 | None | | Boils/Burns Away | No |
| Commercial Formulation 5 | Yes | Yes | No | No | No | 1 | 0 | 0 | None | 1-0-0 | Boils/Burns Away | No |
| Commercial Formulation 6 | Yes | Yes | No | No | No | 1 | 0 | 1 | Not Compatible | 1-0-0 | Boils | No |
| Commercial Formulation 7 | Yes | Yes | No | No | No | 1 | 0 | 0 | None | 0-0-0? | Boils/Burns Away | Yes |
| Commercial Formulation 8 | Yes | Yes | No | No | No | 1 | 0 | 0 | None | 1-0-0 | Boils | Yes |
| Commercial Formulation 9 | Yes | Yes | No | No | No | 2 | 0 | 0 | None | 2-0-0 | Boils | No |
| Commercial Formulation 10 | Yes | Yes | No | No | No | 2 | 0 | 0 | None | 2-0-0 | Boils/Burns Away | No |
| Commercial Formulation 11 | Yes | No | No | No | No | 2 | 0 | 0 | None | 2-0-0 | Boils/Burns Away | No |
| Commercial Formulation 12 | Yes | No | No | No | No | 1 | 0 | 0 | None | 1-0-0 | Boils/Burns Away | No |
| Commercial Formulation 13 | Yes | Yes | No | No | No | 0 | 0 | 0 | None | 0-0-0 | Boils/Burns Away | No |

FIG. 1

Cocamidopropyl Betaine

Esterquat

Lauryl Amidopropyl Betaine

Sodium Lauroyl Sarcosinate

Cystine based Gemini Surfactant

Ethoxylated Sorbitan Laurate

SYSTEMS AND COMPOSITIONS FOR SUPPRESSING AND EXTINGUISHING FIRES

CROSS-REFERENCE TO RELATED APPLICATIONS

The present application is a continuation-in-part of PCT Application Ser. No. PCT/US2018/35443, filed on May 31, 2018, which claims priority to U.S. Provisional Application No. 65/582,689, filed Nov. 17, 2017 and U.S. Provisional Application No. 65/514,426 filed Jun. 2, 2017. All of the foregoing applications are hereby incorporated by reference in their entireties.

BACKGROUND OF THE INVENTION

Field of the Invention

Embodiments of the invention relates generally to the field of compositions for extinguishing and suppressing fires, systems employing those compositions and their method of manufacture and use.

Description of the Related Art

Fire extinguishing compositions are commonly employed to put out fires (e.g., extinguish them) and/or suppress the spread of fires (i.e. slow or stop their progress). Different combustible materials often are extinguished using different fire extinguishing compositions. The type of combustible material that is burning in a fire determines the classification of the fire.

In the united states, the classifications of fire include Class A (e.g., combustible materials such as wood, paper, fabric, refuse, etc.), Class B (e.g., flammable liquid and gases), Class C (e.g., electrical fires), Class D (e.g., metal fires), and Class K (e.g., cooking oils and fats).

BRIEF SUMMARY OF THE INVENTION

One or more embodiments of the invention are directed a fire extinguishing systems and compositions and methods of use thereof.

In some embodiments, the fire extinguishing composition is a concentrate. In some embodiments, the composition comprises a botanical material. In some embodiments, the composition comprises a thickening agent. In some embodiments, the composition comprises water. In some embodiments, the composition is halogen free. In some embodiments, the composition is free of sugar alcohols. In some embodiments, the composition is configured to extinguish or suppress magnesium fires. In some embodiments, the composition is configured to extinguish all classes of fires. In some embodiments, the botanical material is an *Aloe vera* extract. In some embodiments, the thickening agent comprises a saccharide material and/or cellulosic material. In some embodiments, the thickening agent is selected from the group consisting of biopolymers constituted with simple sugar monomers, such as xanthan gum, gellan gum, cellulose, or derivatives such as carboxymethylcellulose (CMC), methylcellulose.

In some embodiments, the composition further comprises a bio-based surfactant. In some embodiments, the composition further comprises a low freezing temperature agent, such as a salt or salt substitutes. In some embodiments, the composition comprises Potassium Lactate. In some embodiments, the composition further comprises a humectant. In some embodiments, the composition further comprises a pH adjusting agent. In some embodiments, the composition further comprises a preservative. In some embodiments, the composition comprises 1,3-propanediol.

Some embodiments pertain to a fire extinguishing or suppressing composition comprising a botanical material. In some embodiments, the composition comprises water. In some embodiments, the composition is halogen free. In some embodiments, the composition is free of sugar alcohols. In some embodiments, the composition is free of perfluorooctanoic acid (PFOA), fluorotelomers, or perfluorooctanesulfonic acid (PFOS).

Any of the embodiments described above, or described elsewhere herein, can include or exclude one of more of the following features.

In some embodiments, the botanical material comprises an extract from the organic inner leaf *Aloe vera, Aloe vera* extract, acemannan, or combination thereof. In some embodiments, the organic inner leaf *Aloe vera, Aloe vera* extract, acemannan or combination thereof is a powder extract that can be mixed with water to provide the botanical material. In some embodiments, the botanical material is an *Aloe vera* extract.

In some embodiments, the composition further comprises a thickening agent. In some embodiments, the thickening agent comprises a saccharide material. In some embodiments, the saccharide comprises one or more polysaccharides. In some embodiments, the thickening agent comprises one or more of guar gum, carbomer, and/or xanthan gum. In some embodiments the thickening agent comprises a cellulosic material. In some embodiments, the thickening agent is selected from the group consisting of methylcellulose, sodium carboxymethylcellulose, cyclodextrins, polydextrose and gellan gum.

In some embodiments, the botanical material and the thickening agent are mutually miscible in water at a botanical material concentration of at least 0.25% and a thickening agent concentration of at least 0.3%.

In some embodiments, the composition comprises a bio-based surfactant. In some embodiments, the surfactant is coco betaine.

In some embodiments, the composition further comprises a salt or a salt substitute, in some embodiments, the salt substitute is Potassium Lactate.

In some embodiments, the composition further comprises a preservative. In some embodiments, the preservative is phenoxyethanol.

In some embodiments, the composition further comprises a humectant. In some embodiments, the composition further comprises 1,3-propanediol.

In some embodiments, the composition further comprises a pH adjusting agent.

In some embodiments, the composition is configured to have a heat capacity of at least 8.

In some embodiments, the composition is configured to extinguish Class D fires. In some embodiments, the composition is configured to extinguish magnesium fires.

In some embodiments, the composition is configured to extinguish non-polar solvents Fires. In some embodiments, the composition is configured to extinguish non-Polar solvents fires.

Some embodiments pertain to a fire extinguishing comprising an acemannan polymer. In some embodiments, the composition comprises water. In some embodiments, the composition is halogen free. In some embodiments, the composition is free of sugar alcohols. In some embodiments, the composition is free of perfluorooctanoic acid (PFOA), fluorotelomers, or perfluorooctanesulfonic acid (PFOS).

In some embodiments, the composition is configured to extinguish magnesium fires. In some embodiments, the composition further comprises a thickening agent. In some embodiments, the composition comprises a humectant. In some embodiments, the composition comprises 1,3-propanediol.

In some embodiments, the composition further comprises a pH adjusting agent, in some embodiments, the pH adjusting agent is present in the range from about 0.01% to 3% by weight of the composition. In some embodiments, the pH adjusting agent comprises triethanolamine (TEA).

In some embodiments, the composition further comprises an agent for lowering the freezing point. In some embodiments, the agent is Potassium lactate 60% water solution. The freezing point lowering agent is present in the range of 0.5 to 35% by weight of the composition.

In some embodiments, the composition is configured to have a heat capacity of at least 8. In some embodiments, the composition is configured to extinguish Class D fires.

Some embodiments pertain to a fire suppressing (and/or extinguishing) gel. In some embodiments, the gel comprises a botanical material. In some embodiments, the gel comprises a botanical material. In some embodiments, the gel is halogen free. In some embodiments, the gel is free of sugar alcohols. In some embodiments, the gel is also free and/or lacks a surfactant. In some embodiments, the gel also is free of and/or lacks cocobetaine.

Some embodiments pertain to a composition concentrate comprising a botanical material. In some embodiments, the composition comprises a low freezing agent. In some embodiments, the composition comprises a thickening agent. In some embodiments, the composition comprises water. In some embodiments, the composition is halogen free. In some embodiments, the composition is free of sugar alcohols.

Some embodiments pertain to a fire extinguishing and/or a fire suppressing composition concentrate comprising *Aloe vera* powder. In some embodiments, *Aloe vera* powder has been reconstituted in water. Some embodiments pertain to a fire extinguishing and/or fire suppressing composition concentrate comprising *Aloe vera* extract. In some embodiments, the composition comprises water. In some embodiments, the composition comprises a low freezing agent. In some embodiments, the low freezing agent is selected from the group consisting of Potassium Lactate, Sodium lactate, sodium gluconate, Potassium acetate, potassium carbonate, calcium chloride, calcium iodide. In some embodiments, the composition comprises a thickening agent selected from the group consisting of guar gum, carbomer, xanthan gum, gum Arabic, pectin, *Acacia* gum, starch, cellulose, insulin guar, karaya, agar, algin, carrageenan, furcellaran, curdlan, dextran, cellulon, pullulan, carboxymethylcellulose (CMC), methylcellulose, cyclodextrins, polydextrose, glycogen, hyaluronic acid, chitin, and combination thereof. In some embodiments, the composition comprises a bio-based surfactant, in some embodiments, the bio-based surfactant is a betaine, in some embodiments, the surfactant is a betaine amphoteric surfactant. In some embodiments, the betaine amphoteric surfactant is used as the primary surfactant. In some embodiments, the composition comprises cocobetaine. In some embodiments, the composition comprises 1,3-propanediol. In some embodiments, the composition comprises Triethanolamine. In some embodiments, the composition as a pH of 6.5 and about 7.0.

In some embodiments, the fire extinguishing composition is free of sugar alcohols. In some embodiments, the composition further comprises a preservative.

In some embodiments, the fire extinguishing composition comprises *Aloe vera* or an *Aloe vera* extract (e.g., a concentrated extract from an *Aloe vera* plant). In some embodiments, the fire extinguishing composition is halogen-free. In some embodiments, the fire extinguishing composition is free of sugar alcohols. In some embodiments, the fire extinguishing composition consists of *Aloe vera* (and/or *Aloe vera* extract) and water.

In some embodiments, the fire extinguishing composition is at least 50% *Aloe vera* (or *Aloe vera* based product by weight). In some embodiments, the *Aloe vera* is present in a range from about 50% to about 95% by weight of the composition.

In some embodiments, the fire extinguishing composition further comprises a low freezing temperature agent. In some embodiments, the low freezing temperature agent is present in a range from about 0.1% to 5.0% by weight of the composition. In some embodiments, the low freezing temperature agent comprises one or more of Potassium lactate, Sodium lactate, and/or potassium acetate.

In some embodiments, the fire extinguishing composition further comprises a thickening agent. In some embodiments, the thickening agent is present in a range of 0.1% to about 5.0% by weight of the composition. In some embodiments, the thickening agent comprises one or more of guar gum, carbomer, and/or xanthan gum.

In some embodiments, the fire extinguishing composition further comprises a bio-based surfactant. In some embodiments, the bio-based surfactant is amphoteric. In some embodiments, the bio-based surfactant is present in the range of about 1% to about 40% by weight of the composition. In some embodiments, the bio-based surfactant comprises one or more of cocobetaine and/or sodium cocoamphoacetate, and/or glycine betaine.

In some embodiments, the fire extinguishing composition further comprises a humectant. In some embodiments, the humectant is present in a range from about 1% to about 30% by weight of the composition. In some embodiments, the humectant is 1,3-propanediol.

In some embodiments, the fire extinguishing composition further comprises a pH adjusting agent. In some embodiments, the pH adjusting agent is present in a range from about 0.01% to about 3% by weight of the composition. In some embodiments, the pH adjusting agent comprises triethylamine, triethanolamine, or both.

In some embodiments, the composition has a heat capacity of at least about 8.

In some embodiments, the composition is configured to extinguish a class D fire. In some embodiments, the composition is configured to extinguish all Classes of fire.

Some embodiments pertain to a fire extinguishing composition comprising acemannan and xanthan gum. In some embodiments the fire extinguishing composition is halogen free. In some embodiments, the fire extinguishing composition is free of sugar alcohols.

As stated above, any of the embodiments described above or described elsewhere herein, can include or exclude one or more of the following features.

In some embodiments, the composition further comprises a bio-based surfactant.

In some embodiments, the composition further comprises an agent for lowering the freezing temperature.

In some embodiments, the composition further comprises a pH adjusting agent.

In some embodiments, the *Aloe vera* is at least 50% by weight.

In some embodiments, the *Aloe vera* is present in the range from about 50% to 95% by weight of the composition.

In some embodiments, the thickening agent is present in a range from about 0.1% to about 5.0% by weight of the composition.

In some embodiments, the thickening agent comprises one or more of guar gum, carbomer, and/or xanthan gum.

In some embodiments, the bio-based surfactant is present in a range from about 5% to about 40% by weight of the composition.

In some embodiments, the bio-based surfactant comprises one or more of Betaine Amphoteric Bio-based surfactants and or decyl glycoside sodium.

In some embodiments, the low freezing agent is present in a range from about 0.5% to about 35% by weight of the composition.

In some embodiments, the low freezing agent comprises Potassium Lactate.

In some embodiments, the humectant is present in a range from about 1% to about 30% by weight of the composition.

In some embodiments, the humectant comprises 1,3 propanediol.

In some embodiments, the pH adjusting agent is present in a range from about 0.1% to about 3% by weight of the composition.

In some embodiments, the pH adjusting agent comprises triethanolamine.

In some embodiments, the composition has a heat capacity of at least about 8.

In some embodiments, the composition is configured to extinguish a magnesium fire.

In some embodiments, the composition is configured to extinguish class D fires.

In some embodiments, the composition is configured to extinguish Class B polar and Class B non-Polar fires.

In some embodiments, the composition is configured to extinguish every class of fire.

In some embodiments, as described elsewhere herein, the composition is prepared as a concentrate and is diluted with water to provide a diluted formulation. In some embodiments, the concentrate or dilute formulation can be used in any of the applications disclosed herein. Some embodiments pertain to a dilute fire extinguishing composition comprising any features of any embodiments described above, or described elsewhere herein, and or excluding one or more of those features. In some embodiments, the dilute composition contains the concentrate at a 10% by volume dilution with water. In some embodiments, the dilute composition contains the concentrate at a 3% by volume dilution with water.

Some embodiments pertain to a method for manufacturing a composition comprising any features of any of the embodiments described above, or described elsewhere herein, and/or excluding one or more of those features. In some embodiments, the method includes providing one or more of the ingredients of any of the embodiments described above. In some embodiments, the method includes mixing or combining any one or more ingredients of the ingredients of any of the embodiments described above. For instance, in some embodiments, a botanical ingredient is provided. In some embodiments, the botanical ingredient is mixed with water.

Some embodiments pertain to a fire extinguishing (and/or suppressing) system. In some embodiments, the system comprises a composition comprising any features of any of the embodiments described above, or described elsewhere herein, and/or excluding one or more of those features. In some embodiments, the system comprises a vessel for dispersing the composition. In some embodiments, the vessel comprises a fire extinguisher canister. In some embodiments, the vessel comprises a fire hose with a proportioner that disperses the composition into water flowing through the hose.

Compositions for extinguishing or suppressing fires, systems for using the same, methods of making compositions for extinguishing or suppressing fires, and/or methods of using the same are disclosed. The compositions can comprise a botanical material such as *Aloe vera* or extract thereof and one or more additional chemical components/agents. The additional chemical components can include a low freeze temperature agent such as potassium lactate, a thickening/binding agent such as propanediol (e.g., 1,3-propanediol), a bio-based surfactant such as cocamidopropyl betaine, polysaccharides such as xanthan gum, guar gum or derivatives thereof, a pH adjusting agent such as triethanolamine, sodium gluconate, foaming agents, foam stabilizers, emulsifying agents, chelating agents, emollients, preservatives, bamboo extracts, algae extracts, *Santalum acuminatum, Citrus Glauca*, wattle seed extract, cactus extract, psicose and water.

BRIEF DESCRIPTION OF THE DRAWINGS

The above and other aspects, features and advantages of the invention will be more apparent from the following more particular description thereof, presented in conjunction with the following drawings wherein:

FIG. 1 is a table showing comparison data for the testing of a disclosed embodiment versus commercially available fire extinguishing formulations.

FIG. 2A shows extinguished magnesium metal after extinguishing with a disclosed embodiment. FIG. 2B shows extinguished magnesium metal after extinguishing with a first commercial product. FIG. 2C shows extinguished magnesium metal after extinguishing with a first commercial product.

FIG. 3A shows the diesel fuel after ignition. FIG. 3B shows the application of a disclosed extinguishing composition to the fire. FIG. 3C shows the test results where the fire has been extinguished.

FIG. 4A shows the ignition of a magnesium metal. FIG. 4B shows the application of a disclosed extinguishing composition of the burning metal. FIG. 4C shows the extinguished metal being handled with bare hands after extinguishing.

FIG. 5A shows methylcellulose, FIG. 5B shows Xanthan gum, and low acyl gellan gum in FIG. 5C, that can be used as an ingredient in the composition disclosed herein.

DETAILED DESCRIPTION

Figure 2A:
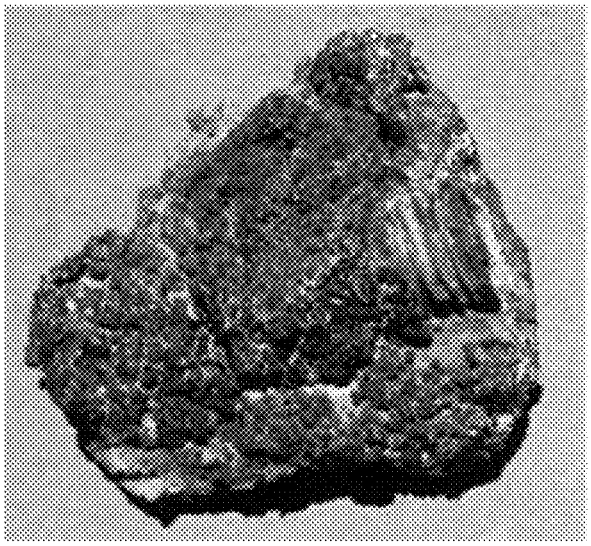
FIGS. 2A-C show magnesium metal after treatment with various extinguishing agents.

The present invention comprising compositions and methods for extinguishing fire will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. Furthermore, although steps or processes are set forth in an exemplary order to provide an understanding of one or more systems and methods, the exemplary order is not meant to be limiting. One of ordinary skill in the art would recognize that the steps or processes may be performed in a different order, and that one or more steps or processes may be performed simultaneously or in multiple process flows without departing from the spirit or the scope of the invention. In other instances, specific features, quantities, or measurements well known to those of ordinary skill in the art have not been described in detail so as not to obscure the invention. It should be noted that although examples of the invention are set forth herein, the claims, and the full scope of any equivalents, are what define the metes and bounds of the invention.

For a better understanding of the disclosed embodiment, its operating advantages, and the specified object attained by its uses, reference should be made to the accompanying drawings and descriptive matter in which there are illustrated exemplary disclosed embodiments. The disclosed embodiments are not intended to be limited to the specific forms set forth herein. It is understood that various omissions and substitutions of equivalents are contemplated as circumstances may suggest or render expedient, but these are intended to cover the application or implementation.

The term "first", "second" and the like, herein do not denote any order, quantity or importance, but rather are used to distinguish one element from another, and the terms "a" and "an" herein do not denote a limitation of quantity, but rather denote the presence of at least one of the referenced item.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

As will be understood by one skilled in the art, for any and all purposes, such as in terms of providing a written description, all ranges disclosed herein also encompass any and all possible sub-ranges and combinations of sub-ranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to", "at least", "greater than", "less than", and the like include the number recited and refer to ranges which can be subsequently broken down into sub-ranges as discussed above. Finally, as will be understood by one skilled in the art, a range includes each individual member. Thus, for example, a group having 1-3 articles refers to groups having 1, 2, or 3 articles. Similarly, a group having 1-5 articles refers to groups having 1, 2, 3, 4, or 5 articles, and so forth. The phrases "and ranges in between" can include ranges that fall in between the numerical value listed. For example, "1, 2, 3, 10, and ranges in between" can include 1-1, 1-3, 2-10, etc. Similarly, "1, 5, 10, 25, 50, 70, 95, or ranges including and or spanning the aforementioned values" can include 1, 5, 10, 1-5, 1-10, 10-25, 10-95, 1-70, etc.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

One or more embodiments of the present invention pertain to compositions for extinguishing or suppressing fires, system for using the same, methods of making compositions for extinguishing or suppressing fires, and/or methods of using the same. In some embodiments, the compositions disclosed herein are suitable for use on Class D fires (e.g., suppressing or extinguishing the fires). In some embodiments, the composition comprises *Aloe vera* or an *Aloe vera* extract (e.g., a concentrated extract from an *Aloe vera* plant, including an *Aloe vera* powder).

In some embodiments, the composition comprises one or more polysaccharides.

In some embodiments, the composition comprises acemannan. In some embodiments, the fire extinguishing composition is halogen free. In some embodiments, the fire extinguishing composition is free of sugar alcohols. In some embodiments, the composition consists of *Aloe vera* (and/or *Aloe vera* extract) and water. In some embodiments, the fire extinguishing composition also comprises other ingredients. In some embodiments, the compositions are non-toxic. In some embodiments, the compositions are biodegradable. In some embodiments the compositions are provided as a gel or as a flowable liquid. A variety of extinguishing compositions and systems for deploying those compositions are described below to illustrate various examples that may be employed to achieve one or more desired improvements. These examples are only illustrative and are not intended in any way to restrict the general invention presented and the various aspects and features of these inventions. Furthermore, the phraseology and terminology used herein is for the purpose of description and should not be regarded as limiting. No features, structure, or step disclosed herein is essential or indispensable.

As used herein, in the context of a fire, the term "extinguish" and/or "extinguishing" shall be given its ordinary meaning and can include putting out a fire and/or causing a flame to cease to burn or shine. In some embodiments, extinguishing involves causing a material to stop smoldering.

As used herein, the term "suppress" shall be given its ordinary meaning and can include, preventing, or slowing the spread of fire, preventing or delaying ignition of fire, lowering the temperature of a fire, stopping temperature to increase of a fire, and/or causing a burning material to begin to cool.

In some embodiments, the compositions disclosed herein extinguish Class D fires (e.g. put out) and/or to suppress Class D fires (e.g. prevent or slow their spread, prevent or slow their ignition, lower their temperature, and/or stop their temperature increase).

As used herein, the term "nontoxic" or "non-toxic" shall be given its ordinary meaning and can include an agent or composition that has one or more of the following properties: it can be spread on the skin or fur of mammal without substantial skin reaction (e.g., rash, reddening, irritation, itchiness, hair loss, etc.), quantities (e.g., 10 g, 50 g, 100 g, etc.) can be ingested by mammals without substantial harm (e.g., consumption does not cause nausea, sickness, and/or harm or damage to tissues, such as the liver or kidneys).

As used herein, the term "botanical" shall be given its ordinary meaning and can include materials that are extracted, isolated, or collected from plants.

As used herein, the term "vessel" is used herein in accordance with its ordinary meaning in the art and includes any structure which is capable of holding a composition and being in fluid communication with a dispensing component. Examples may include but are not limited to, containers, such as bottles, vials, canisters, tubes, reservoirs, extinguishers canisters, etc., and materials which may hold the composition such as a sponge, cloth, gauze, etc. A dispensing component may be any feature which is capable of being in fluid communication with a vessel and dispensing a composition from the vessel to a burning area of an animal or person. Examples may include but are not limited to valves, lumens, orifices, pumps, sponges, cloths, etc. In some embodiments, an extinguishing device may comprise an absorbent material such as a sponge, cloth, gauze, etc., wherein a liquid or gel composition is absorbed therein. The absorbent material may be saturated, meaning that the material cannot absorb any more liquid, or it may contain a liquid or gel composition but not be saturated. These devices might be further packaged in a film or other sealing material to reduce evaporation or other loss of the liquid.

Class D fires (the U.S. standard for fire classification and class is used throughout this disclosure) involve combustible metals, including but not limited to fires involving alkali metals like lithium, and potassium, alkaline earth metals such as magnesium, and group IV elements such as titanium and zirconium. Metal fires are uniquely hazardous. Often people are unaware of the characteristics of these fires and are not properly prepared to fight them (e.g. suppress or extinguish them). Certain metals also burn on exposure to air or water (for example, sodium), enhancing the risks of fire associated with these metals during attempted containment (e.g. because conventional fire suppressing agents may further fuel the fire). Even small metal fires can spread and become larger fires engulfing and initiating the burning of other, ordinary combustible materials (e.g., causing Class A fires, such as those involving wood, paper, fabric, and most kinds of trash), flammable liquids and gases (e.g., Class B fires, such as those involving solvents, natural gases, etc.), and oils (e.g., Class K fires, such as those involving cooking oils, etc.).

Generally, some bulk combustible metals, such as magnesium, do not represent great fire risks at storage because heat is conducted away from hot spots in an efficient enough manner that the heat of combustion is not maintained (e.g., the heat transferred or distributed to the rest of the metal before a combustion temperature is reached). In bulk form, magnesium for instance, unlike wood may require a larger portion of its surface heated to a combustion temperature before it actually ignites. Significant heat energy can be required to ignite a contiguous mass of combustible metal. However, once ignited, magnesium and certain other Class D metals (e.g., alkali metals, potassium, calcium, lithium, metals that violently react with water to form metal oxides, etc.) burn with an intense light and heat, reaching temperatures to about 5,610 degrees Fahrenheit (or about 3100 degrees Celsius). Generally metal fires are particularly hazardous when the metal is in the form of particles, machine shavings, or other metal "fines", which combust more rapidly than larger blocks. Metal fires can also be ignited by the same ignition sources that would start other common fires (including ignition by other classes of fires).

Another complicating factor when suppressing or extinguishing Class D fires is that water and other common firefighting agents can fuel metal fires and/or make them worse. For example, water and magnesium can react to form hydrogen gas and MgO. Hydrogen can ignite and further fuel the fire. For that reason, the National Fire Protection Association recommends that metal fires be fought with dry powder extinguishing agents that work by smothering and heat adsorption. The most common agents are sodium chloride granules, graphite powder, powder copper etc. Additionally, complicating matters, these Class D dry powder extinguishers should not be confused with extinguishers that contain dry chemical agents. The two are not the same and while dry powder should be used to extinguish a metal fire, using a dry chemical extinguisher can be ineffective and/or actually increase the intensity of a metal fire. Moreover, the amount of powder required for fighting large metal fires makes this method unsuitable in certain circumstances. For instance, in 'run flat' tires in certain military vehicles, a magnesium frame is placed within the tire to allow to operate after the rubber of the tire is punctured. When that magnesium frame ignites (e.g., from an improvised explosive device, etc.) a powder suppressing agent is difficult to deploy on the tire in sufficient quantity to quench the flame. Additionally, when a human is exposed to such a fire, (e.g., a passenger in the vehicle), these powders may be ineffective to properly extinguish the flame (because, as the person moves, the powder may not effectively smother the fire). Further, powders can be more difficult to deploy at a safe distance from the fire.

Because the conditions under which human life and man-made materials and equipment might be damaged or destroyed in the event of exposure to excessive heat, combustion or explosion vary considerably, the same temperature suppressing composition will not necessary be suited to afford protection to personnel and also all types of materials present in a potential damage incident. Sometimes, for example, when military personnel, uniforms, weapons, vehicles and associated equipment are in a combat situation, the welfare of the personnel may also be dependent to a significant extent on the performance of their ordinance under the potentially damaging conditions. Consequently, in the development and selection of a temperature suppressing composition or fire extinguishing agent, the paramount issue of welfare of personnel would not necessary be served by ignoring the danger to the ordinance.

Widely used but problematic, temperature suppressing compositions currently marketed to suppress Class D fires and protect human life include toxic ingredients such as surfactants, including fluorocarbons (e.g., Halons®). Although halogenated compositions may be mixed with water and sprayed on human skin to provide a cooling effect, halogenated compositions 'toxic characteristics prohibit this practice. Furthermore, their deployment within a vehicle may cause frostbite to the face and eyes and requires a level of force which may provide injuries to humans, rupturing eardrums and breaking jawbones. Halon, even at low concentrations, can be fatal to humans if inhaled during an excited state, typical of that experienced by military personnel when their vehicle is under enemy fire or after it has hit an improvised explosive device. Because of these known problems, military personnel sometimes disable the halon systems in their vehicles, potentially resulting in additional threats of uncontrolled fires in the vehicle.

While other temperature suppressing compositions exist, including ones with sugar alcohols and water, these compositions do not afford the desired level of protection for applications designed to protect humans from burning and in applications intended to suppress or extinguish Class D fires. For example, these compositions are not sufficiently protective to humans (e.g., allowing burning of the skin, etc.), are not able to extinguish and/or suppress Class D fires sufficiently, are not able to extinguish and/or suppress combinations of Class D fires and other classes of fires, and/or these compositions are not friendly to the environment and/or biodegradable.

One objective in extinguishing a magnesium fire (or other Class D material, e.g., alkali metals like lithium and potassium, alkaline earth metal such as magnesium, and group IV elements such as titanium and zirconium), is to cool it to the point of non-ignition. Water is not an option as it expands 1700 times its weight as it converts to steam, vaporizing the water molecules before they can even cool metal. Further, as described elsewhere herein, these water molecules can undergo chemical reactions forming hydrogen which is explosive.

Some embodiments of the fire extinguishing compositions and/or methods disclosed herein solve one or more of the above issues and/or other issues not solved by conventional fire extinguishing agents. In some embodiments, the fire extinguishing and/or suppressing composition disclosed herein are non-toxic, are safe for human contact (or even ingestion), suppress or extinguish Class D fires, and/or suppress or extinguish Class A, B, C, and/or K fires. In some embodiments, the compositions suppress the heat from and/or reduce the temperature of fires generally and/or Class D fires. In some embodiments, the composition extinguish Class D fires (e.g., put out) and/or to suppress class D fires (e.g., prevent or slow their spread, prevent or spread their ignition, lower their temperature, and/or stop their temperature increase). Some embodiments pertain to systems including a composition as disclosed herein within a vessel, extinguishers, vehicle systems (e.g., in containers inside a vehicle, inside the wheel-wells, engine compartment, etc.), or in another gel or liquid dispensers.

In some embodiments, as noted above, the fire suppressing and/or extinguishing compositions disclosed herein extinguish Class D fires and/or extinguish and/or suppress Class A fires (e.g., involving materials, such as wood, paper, fabric, plastic, trash, etc.), and/or extinguish and/or suppress Class B fires (e.g., flammables liquids and gases, polar and nonpolar, such as solvents, natural gas, etc.), and/or extinguish and/or suppress Class K fires (e.g., oils such as cooking oils, etc.). In some embodiments, the disclosed composition extinguishes and/or suppresses Class D, Class A, Class B and Class K fires simultaneously.

In some embodiments, once a fire is extinguished using a composition as disclosed herein, the previously burning material (e.g., the extinguished material) rapidly cools. In some embodiments, after extinguishing, the previously burning material is almost instantly or substantially instantly cool to the touch. In some embodiments, after extinguishing, the extinguished material is cool to the touch. (e.g., by hand or by a body part) within equal to less than about 1 second (s), 5 s, 10 s, 30 s, or ranges including and/or spanning the aforementioned values. In some embodiments, after extinguishing, the extinguished material reaches temperature less than about room temperature (less than about 74° F.) within equal to less than 1 s, 5 s, 10 s, 30 s, 1 minute, 5 minutes, or ranges including and/or spanning the aforementioned values. In some embodiments, after extinguishing, the extinguished material reaches a temperature less than about 150° F. (and/or a temperature that is safe to the touch with skin) within equal to less than about: 1 s, 5 s, 10 s, 30 s, 1 minute, 5 minutes, or ranges including and/or spanning the aforementioned values.

In some embodiments, applications of the fire extinguishing composition/temperature suppressing compositions disclosed herein substantially prevents the heating of an object. For example, by coating a structure (e.g., a building), or an object (e.g., a vehicle, furniture, cloth, or other textile) with a composition disclosed herein, temperature suppression can be achieved. In some embodiments, when directly heated with a torch (e.g., propane, MAPP, acetylene, oxygen, one having a flame of about 3800° F., etc.) for a period of about 1 to about 16 minutes (e.g., about 1 minute, about 2 minutes, about 3 minutes, about 4 minutes, etc.), the temperature of a surface coated with a composition as disclosed herein rises less than or equal to about: 5° F., 10° F., 20° F., 50° F., 100° F., 150° F., 200° F., 250° F., or ranges including and/or spanning the aforementioned values. In some embodiments, as disclosed elsewhere herein, the fire extinguishing composition/temperature suppressing compositions can be used as paint additive, or other coating additives for objects.

In some embodiments, the fire suppressing and/or extinguishing composition comprises a temperature suppressing agent and/or a water delivery agent. In some embodiments, the temperature suppressing agent can act as water delivery agent preventing and/or inhibiting the evaporation of water so that it can be delivered to the burning material. In some embodiments, the temperature suppressing agent delivers water to a fire (e.g., a Class D fire) and simultaneously prevents the water from further fueling the fuel. In some embodiments, the temperature suppressing agent delivers water that has been added to the temperature suppressing agent during preparation of the fire suppressing and/or extinguishing composition and/or water that is residual in the suppressing agent (e.g., water that is not added to the temperature suppressing agent). In some embodiments, the temperature suppressing agent has no water added.

In some embodiments, the fire suppressing and/or fire extinguishing composition is prepared as a concentrate (e.g., a concentrated solution and/or a concentrated mixture). In some embodiments, the concentrate is a gel (e.g., a flowable gel, a hydrogel, a thixotropic gel, etc.). In some embodiments, the concentrate comprises water. In some embodiments, the fire suppressing and/or extinguishing composition is prepared by diluting a concentrate with water to form a wetting composition. For example, in some embodiments, a concentrate, (which may already comprise some water) is diluted prior to use in, for example, a fire extinguisher, (or other device for deploying the fire extinguishing agent). In some embodiments, the concentrate is used without dilution to extinguish and/or suppress fire. In other words, in some embodiments, the fire suppressing and/or extinguishing composition is the concentrate. In some embodiments, the composition has a viscosity of equal to or less than about 10000 cP, 5000 cP, 1000 cP, 500 cP, 5 cP, or ranges including and/or spanning the aforementioned values.

Some embodiments comprise a temperature suppressing agent and/or water delivery agent. In some embodiments, it is believed that the temperature suppressing agent and/or extinguishing composition acts as a water delivery agent. In some embodiments, as disclosed elsewhere herein, the temperature suppressing agent comprises an organic polymeric material. In some embodiments, as disclosed elsewhere herein, the temperature suppressing agent comprises and/or consists of a botanical material. In some embodiments, the botanical ingredient is a gel (e.g., a botanical gel, etc.). In some embodiments, the botanical material is *Aloe vera* and/or an extract of *Aloe vera*. Without being bound to a particular mechanism, it is believed that the botanical material (e.g., *Aloe vera* and/or *Aloe vera* extract thereof), and mainly the acetylated mannose-rich polymer (acemannan) that functions as storage polysaccharides acts as a temperature reducing agent and/or water delivering material in the fire suppressing and/or extinguishing composition. In some embodiments, the botanical material is powdered and/or concentrated. In some embodiments, powdered botanical materials can be reconstituted (e.g., mixed with a diluent such as water) prior to its use in the composition.

In some embodiments, the weight percent of botanical material (e.g., *Aloe vera, Aloe vera* extract, reconstituted *Aloe vera* etc.) in the fire suppression and/or extinguishing composition concentrate is equal to or at least about: 0.5%, 1%, 5%, 10%, 25%, 50%, 70%, 95%, or ranges including and/or spanning the aforementioned values. In some embodiments, the weight percent of botanical material (e.g., *Aloe vera, Aloe vera* extract, reconstituted *Aloe vera* extract, etc.) in the fire suppressing and/or extinguishing compositions concentrate is equal to or less than about: 0.5%, 1%, 5%, 10%, 25%, 50%, 70%, 75%, 80%, 85%, 95%, or ranges including and/or spanning the aforementioned values. In some embodiments, the concentrated fire suppressing and/or extinguishing composition consists of *Aloe vera* or an extract of *Aloe vera* and/or water.

In some embodiments, as disclosed elsewhere herein, a composition concentrate is prepared which can be diluted prior to use. In some embodiments, the weight percent of botanical (e.g., *Aloe vera, Aloe vera* extract, reconstituted *Aloe vera* extract, etc.) in the fire suppressing and/or extinguishing composition, after dilution (e.g., with water) is equal to or at least about: 0.1%, 0.2%, 0.5%, 1.0%, 2.5%, 5.0%, 7.0%, 9.5%, or ranges including and/or spanning the aforementioned values. In some embodiments, the weight percent of botanical material (e.g., *Aloe vera, Aloe vera* extract, reconstituted *Aloe vera* extract, etc.) in the fire suppressing and/or extinguishing composition after dilution (e.g., with water) is equal to or less than about: 0.1%, 0.2%, 0.5%, 1.0%, 2.5%, 5.0%, 7.0%, 9.5%, or ranges including and/or spanning the aforementioned values.

In some embodiments, instead of or in addition to the botanical material, the composition comprises a saccharide material. In some embodiments, the saccharide material can be used as a thickening agent, as an emulsion stabilizer agent, as a temperature suppressing agent, as a microencapsulation agent, and/or as a water delivery agent. In some embodiments, the saccharide material is a polysaccharide. In some embodiments, the botanical material comprises a polysaccharide and/or is a polysaccharide (e.g., a hydrogel or reconstituted polysaccharide). In some embodiments, the polysaccharide is hydrophilic. In some embodiments, the polysaccharide is amphiphilic. In some embodiments, the polysaccharide is cross linkable (e.g., through ionic bonding with, for example, calcium or covalent bonding with for example, multifunctional crosslinking agents). In some embodiments, the polysaccharide is a natural polysaccharide. In some embodiments, the polysaccharide is a synthetic polysaccharide.

In some embodiments, the polysaccharide is selected from one or more of acemannan, alginate, chitosan, cellulose, callose, laminarin, chrysolaminarin, xylan, arabinoxylan, mannan, fucoidan, galactomannan, hydroxypropyl cellulose, and/or hydroxymethyl cellulose. In some embodiments, the polysaccharide is selected from one or more of a cellulose, a cellulose derivative, insulin guar, karats, pectin, agar, algin, carrageenan, furcellaran, gellan, curdlan, dextran, cellulon, pullulan, carboxymethylcellulose (e.g., the free acid sodium salt, potassium salt, etc.), methylcellulose, cyclodextrins, polydextrose, glycogen, hyaluronic acid (HA), and/or chitin. In some embodiments, the polysaccharide is acemannan.

In some embodiments, the polysaccharide comprises or is a cellulosic material. In some embodiments, the cellulosic material is one or more of methylcellulose, carboxymethylcellulose (including salt thereof such as sodium carboxymethylcellulose), gellan gum, hydroxyethyl cellulose, hydroxypropyl methylcellulose, ethyl cellulose, and/or a hydrolyzed cellulose.

It has been noted that by adding botanical material(s) and/or polysaccharides to the fire suppressing and/or extinguishing composition, a cooling effect occurs, when a fire is extinguished or suppressed. Without being bound to a particular mechanism, it is believed that the botanical material (e.g., *Aloe vera* plant extract, a botanical gel or extract) enhances the heat capacity of the suppressing and/or extinguishing composition and removes heat from the fire. It is also noted that the complex matrix formed by the addition of botanical materials and/or polysaccharides to certain bio-surfactants, enhances the emulsion stability of the suppressing and/or extinguishing composition and, hence, encapsulates the fuel. In some embodiments, it is believed that the addition of a botanical and/or polysaccharide helps prevent re-ignition by encapsulating and/or cooling the fuel source.

Figure 9A:
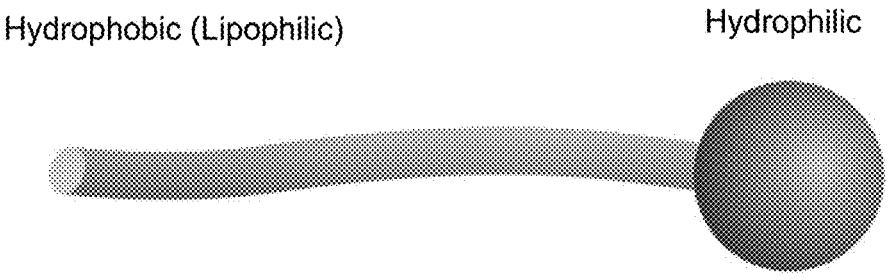
FIG. 9A is a schematic of a surfactant.

As discussed herein, surfactants, e.g., polysaccharides are amphiphiles. As illustrated in FIG. 9A, amphiphiles are compounds that possess both hydrophilic, i.e. water loving (polar), and lipophilic, i.e. oil or fat loving (non-polar) components.

Thus, surfactants are generally characterized by their chemistry, e.g. polar moiety. The hydrophilic-lipophilic balance (HLB) determines the nature of the surface activity (i.e. ability to dissolve in water, oil, or oil and water, or even balance).

Surfactants play a role (e.g. absorb) at the interfaces such as, water-oil, liquid-gas, solid-liquid, where they find the energetically most favorable conditions due to their two-part structure, to lower the surface activity. Thus, when a surfactant is present, in a two phased system, the concentration of surfactant adsorbed at the interface increases, and the interfacial tension decreases.

Figure 9B:
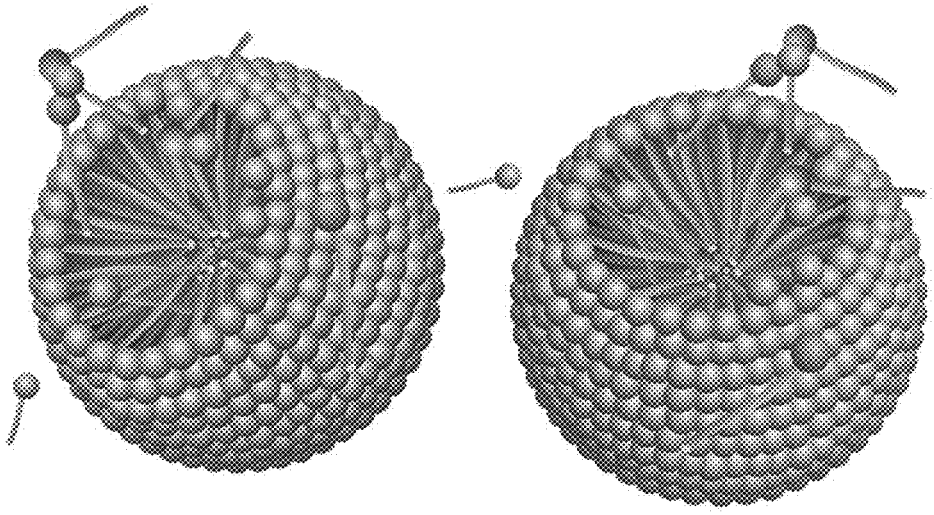
FIG. 9B shows spherical micelles.

At the interface, the polar head groups interact with water while the non-polar lipophilic chain migrate above, disturbing the cohesive energy at the interface, forming many micelles, as illustrated in FIG. 9B.

The characteristic behavior of polysaccharide with surfactant is similar to surfactant micellization in solution. It is known that the hydrophobic character of both polymer and surfactant is responsible for the interactions.

Figure 9C:
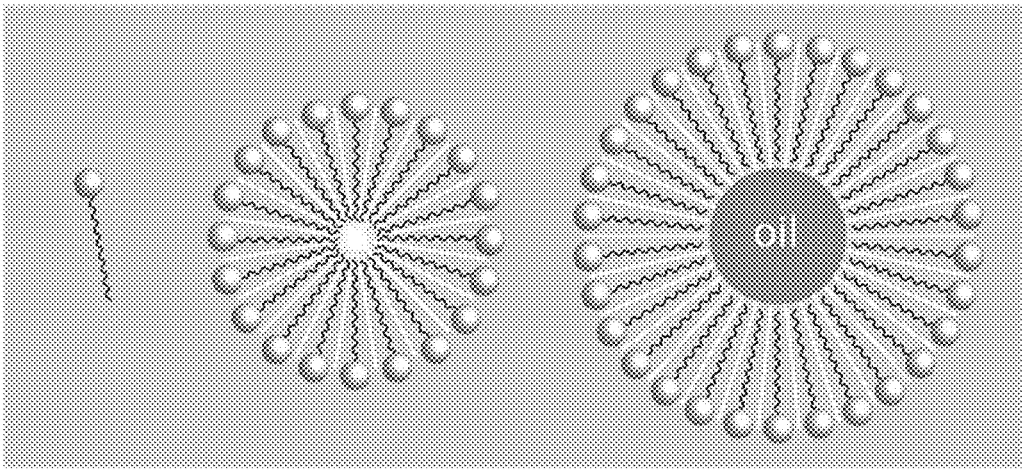
FIG. 9C shows formation of micelles.

As illustrated in FIG. 9C, the association of polysaccharide molecules and bio-surfactant leads to the formation of matrix complexes that have better emulsifying properties, and form more compact adsorption layers at the interface of oil droplets, creating strong micelles, thus facilitating the encapsulation of liquid and gas at the air-liquid interface, which once the fire is extinguished, is preventing reignition.

In some embodiments, botanical material is a material taken directly from a plant without further processing (e.g., concentration or treatment). In some embodiments, the extract comprises a material that has been further processed (e.g., by concentration, drying, purification, isolation, etc.). In some embodiments, *Aloe vera* in its gel form (e.g., *Aloe vera* juice form) is used as a botanical material base for the composition. In some embodiments, the *Aloe vera* comprises and/or consists of pure *Aloe barbadensis* leaf juice (e.g., a botanical gel). In some embodiments, the *Aloe vera* comprises and/or consists of *Aloe barbadensis* leaf gel. In some embodiments, the botanical material is an *Aloe* extract such as one or more of BiAloe®, Naturaloe, and/or Aloecorp bioactive *Aloe*. In some embodiments, the *Aloe vera* comprises and/or consists of *Aloe barbadensis* leaf gel, semi solid, liquid or liquid *Aloe vera* plant extract. In some embodiments, the *Aloe vera* comprises and/or consists of an *Aloe vera* extract powder (e.g., BiAloe®). In some embodiments, as discussed elsewhere herein, the botanical material comprises and/or is BiAloe®, and/or reconstituted BiAloe® powder. BiAloe® is a commercial *Aloe* extract available from Loraland Laboratories. In some embodiments, BiAloe® has an average acemannan wt % of 18%. In some embodiments, about 15.5% of the acemannan fraction in BiAloe® is less than 400 kDa and about 7.1% of the acemannan fraction is less than 50 kDa. In some embodiments, BiAloe® has a polysaccharide content of about 20%. In some embodiments, BiAloe® has a full spectrum of molecular weight polysaccharides. In some embodiments, as described herein elsewhere, the botanical material powder can be reconstituted with water to prepare the temperature suppressing agent and/or a water delivery concentrate.

In some embodiments, the amount of temperature suppressing agent, and/or water delivery agent (such as botanical material) on the composition is expressed as a weight percentage of the dry material (e.g., powder *Aloe* extract, BiAloe®, etc.) in composition. For example, where 1 g of dry botanical material is added to 99 g of water, the weight percent of the botanical material is 1% (1 g dry material/100 g total composition×100). In some embodiments, the weight percent of temperature suppressing agent and/or water delivery agent (e.g., botanical material, *Aloe* extract powder, BiAloe®, etc.) in the fire suppressing and/or extinguishing composition concentrate is equal to or less than about: 0.01%, 0.1%, 0.25%, 0.3%, 0.5%, 1.0%, 4.0%, 5.0%, 10%, 25%, or ranges including and/or spanning the aforementioned values. In some embodiments, the weight percent of temperature suppressing agent/and or water delivery agent in the composition concentrate is equal to or at least about: 0.001%, 0.01%, 0.03%, 0.05%, 0.1%, 0.25%, 0.50%, 1.0%, 2.5%, 5%, 7.5%, or ranges including and/or spanning the aforementioned values. In some embodiments, the weight percent of temperature suppressing agent and or water delivery agent in the dilute fire suppressing and/or extinguishing composition is equal to or less than about 0.001%, 0.01%, 0.03%, 0.05%, 0.10%, 0.40%, 0.50%, 1.0%, 2.5% or ranges including and/or spanning the aforementioned values. In some embodiments, the weight percent of temperature suppressing agent and/or water delivery agent in the dilute composition is equal to or at least about: 0.0001%, 0.001%, 0.003%, 0.005%, 0.01%, 0.10%, 0.25%, 0.50%, 0.75%, or ranges including and/or spanning the aforementioned values. Where a plurality of temperature suppressing agents and/or water delivery agents are used (e.g., 2, 3, 4, 5, or more), their individual weight percent % values can be independently selected from the weight percent values disclosed herein. In some embodiments, the weight percent of *Aloe vera* powder, or powdered botanical material or other temperature suppressing agent and/or water delivery agent) in the concentrated fire suppressing and/or extinguishing composition is equal to or at least about: 0.01%, 0.1%, 0.25%, 0.3%, 0.5%, 1.0%, 4.0%, 5.0%, 10%, 25%, 50%, 75%, or ranges including and/or spanning the aforementioned values.

In some embodiments, as mentioned above, where an *Aloe vera* extract is used (e.g. a powdered extract such as BiAloe®), it can be reconstituted before use. In some embodiments, for example, 0.228 oz of powdered *Aloe* plant extract (e.g. BiAloe®) is mixed with 60 oz of distilled water to prepare the botanical material for use in the fire suppressing and/or extinguishing composition. In some embodiments, the weight percent (wt %) of powder *Aloe vera* extract (e.g., BiAloe®) in water used to form the botanical material (e.g., a reconstituted botanical material) is equal to or less than about: 0.01%, 0.1%, 0.3%, 0.5%, 1.0%, 4.0%, 5.0%, 10%, 25%, 50%, 75%, or ranges including and/or spanning the aforementioned values. In some embodiments, the weight percent of reconstituted botanical material in the concentrate or the diluted formation is as described elsewhere herein. For example, in some embodiments, as described elsewhere herein, the wt % of botanical material (e.g., reconstituted *Aloe vera* extract, etc.) in the fire suppressing and/or extinguishing composition concentrate is equal to or less than about: 5%, 10%, 25%, 50%, 70%, 75%, 85%, 95%, or ranges including and/or spanning the aforementioned values. In some embodiments, the weight percent of botanical material (e.g., reconstituted *Aloe vera* extract, etc.) in the fire suppressing and/or extinguishing composition after dilution (e.g., with water) is equal to or less than about: 0.1%, 0.2%, 0.5%, 1.0%, 2.5%, 5.0%, 7.0%, 9.5%, or ranges including and/or spanning the aforementioned values. In some embodiments, the weight percent (wt %) of powdered *Aloe vera* extract (e.g., BiAloe®) in the fire suppressing and/or extinguishing composition after dilution (e.g., with water) is equal to or less than about: 0.001%, 0.01%, 0.03%, 0.05%, 0.1%, 1.0%, 2.5%, 5.0%, 7.5%, or ranges including and/or spanning the aforementioned values.

In some embodiments, as disclosed elsewhere within, the temperature suppressing agent and/or water delivery agent of the fire suppressing and/or extinguishing composition comprises botanical powder (e.g., extracted material from an *Aloe vera* plant, such as BiAloe®, etc.). In some embodiments the powder is an *Aloe vera* powder. In some embodiments, the *Aloe vera* powder is prepared by drying organic inner leaf *Aloe vera* or *Aloe vera* leaf juice. In some embodiments, the botanical powder is prepared by drying organic plant material. In some embodiments, *Aloe vera* juice is dehydrated and then subject to a milling or powderization process to provide *Aloe vera* powder. In some embodiments, the temperature suppressing agent and/or a water delivery agent (e.g., powdered *Aloe vera* extract, BiAloe®, acemannan, etc.), or the plurality of agents, is mixed with water (e.g., reconstituted) to prepare the concentrated temperature suppressing agent and/or a water delivery agent.

In some embodiments, the weight percent of *Aloe vera* powder in the concentrated fire suppressing and/or extinguishing composition a value as disclosed elsewhere herein and/or can be equal to or at least about 0.01%, 0.25%, 0.3%, 0.5%, 1.0%, 4.0%, 5.0%, 10%, or ranges including and/or spanning the aforementioned values. In some embodiments, the weight percent of *Aloe vera* powder (or other powder agent temperature suppressing agent and/or a water delivery agent) in the concentrated fire suppressing and/or extinguishing composition can be a value as disclosed elsewhere herein and/or can be equal to or less than about: 0.001%, 0.01%, 0.1%, 0.3%, 0.5%, 1.0%, 4.0%, 5.0%, 10%, or ranges including and/or spanning the aforementioned values.

As an illustration, where the fire suppressing and/or extinguishing composition consists of only 5 g of *Aloe vera* powder and 95 g of water, the *Aloe vera* powder is provided at a weight percent of 5%, and the concentrated fire suppressing and/or extinguishing composition comprises water at a weight percent of 95%. In some embodiments, as disclosed elsewhere herein, water is added to the powdered temperature suppressing agent and or water delivery agent (or gel) as a reconstituting agent. In some embodiments, the weight percent of water in the reconstituted temperature suppressing agent and/or a water delivery agent is equal to or at least about: 40%, 60%, 80%, 90%, 98%, 99.9%, 99.99% or ranges including and/or spanning the aforementioned values. In some embodiments, the weight percent of *Aloe vera* powder (or other temperature suppressing agent and/or a water delivery agent powdered agent) in the diluted fire suppressing and/or extinguishing composition is equal to or at least about: 0.001%, 0.01%, 0.03%, 0.05%, 0.1%, 1.0%, 2.5%, 5.0%, 7.5%, or ranges including and/or spanning the aforementioned values.

In some embodiments, the amount of polysaccharides in the fire suppressing and/or extinguishing composition is expressed as weight % of the dry material in the formulation. In some embodiments, the weight percent of polysaccharide in the fire suppressing and/or extinguishing composition concentrate is equal to or less than about: 0.01%, 0.1%, 0.25%, 0.3%, 0.5%, 1.0%, 4.0%, 5.0%, 10%, 25%, or ranges including and/or spanning the aforementioned values. In some embodiments, the weight percent of polysaccharides in the composition concentrate is equal to or at least about: 0.001%, 0.01%, 0.03%, 0.05%, 0.1%. 0.25%. 0.5%, 1.0%, 2.5%, 5.0%, 7.5%, or ranges including and/or spanning the aforementioned values. In some embodiments, the weight percent of polysaccharides in the composition concentrate is equal to or at least about: 0.001%, 0.01%, 0.03%, 0.05%, 0.1%, 0.25%, 0.50%, 1.0%. 2.5%, 5.0%, or ranges including and/or spanning the aforementioned values. In some embodiments, the weight percent of polysaccharide in the dilute fire suppressing and/or extinguishing composition is equal to or less than about: 0.001%, 0.01%, 0.03%, 0.05%, 0.10%, 0.40%, 0.50%, 1.0%, 2.5%, or ranges including and/or spanning the aforementioned values. In some embodiments, the weight percent of polysaccharide in the dilute composition is equal to or at least about 0.0001%, 0.001%, 0.003%, 0.005%, 0.01%, 0.10%, 0.25%, 0.50%, 0.75%, or ranges including and/or spanning the aforementioned values. Where a plurality of polysaccharides is used, (e.g., 2, 3, 4, 5, or more), their individual weight % values can be independently selected from the weight % values disclosed herein.

In some embodiments, the amount of cellulosic material in the fire suppressing and/or extinguishing composition is expressed as a weight % of the dry material. In some embodiments, the weight percent of cellulosic material in the fire suppressing and/or extinguishing composition concentrate is equal or less than about: 0.01%, 0.1%, 0.25%, 0.3%, 0.5%, 1.0%, 4.0%, 5.0%, 10%, 25% or ranges including and/or spanning the aforementioned values. In some embodiments, the weight percent of cellulosic material in the dilute fire suppressing and/or extinguishing composition is equal to or less than about: 0.0001%, 0.001%, 0.003%, 0.005%, 0.01%, 0.10%, 0.25%, 0.50%, 0.75% or ranges including and/or spanning the aforementioned values. Where a plurality of cellulosic materials is used, (e.g., 2, 3, 4, 5, or more), their individual weight percent values can be independently selected from the weight % values disclosed herein.

In some embodiments, the fire suppressing and/or extinguishing composition comprises an acemannan source (e.g., *Aloe vera*, alternative plant sources, etc.) and or acemannan (e.g., a dissolved powder extract of acemannan). Acemannan is a D-isomer mucopolysaccharide in *Aloe vera* leaves and is a hydrophilic polymer. Acemannan is recognized by the FDA as natural product. It can be isolated from natural *Aloe vera* to form a process stabilized powder that contain all the active characteristics of the complex carbohydrates or acetylated mannans and found in fresh *Aloe vera* gel. *Aloe vera* (and Acemannan) also contain organic acids (e.g., galacturonic acid, etc.), that exhibit and/or lend unique properties to the formulation (e.g., good viscosity, high swelling capabilities, water retention, etc.). Acemannan interacts synergistically with Xanthan gum; The two polysaccharides in solution, impart high viscosity at low concentrations, and show to be very stable when high salt content is added (for example when the concentrated fire suppression and/or fire extinguishing composition is diluted with saltwater).

Without being bound to any mechanism, it is believed that acemannan functions as a temperature reducing agent and/or water delivery material in the fire suppressing and/or extinguishing composition.

In some embodiments, the weight percent of dry acemannan used in the concentrated fire suppressing and/or extinguishing composition is as described above for the temperature suppressing agent and/or water delivery agent. In some embodiments, the wt % of acemannan in the fire suppressing and/or extinguishing composition concentrate is equal to or less than about: 0.01%, 0.05%, 0.1%, 0.25%, 0.5%, 1.0%, 2.5%, 5.0%, 10%, 25% or ranges including and/or spanning the aforementioned values.

In some embodiments, the wt % of acemannan in the fire suppressing and/or extinguishing composition concentrate is equal to or greater than about: 0.01%, 0.05%, 0.1%, 0.2%, 0.5%, 1.0%, 2.5%, 5.0%, 7.0%, 9.5%, or ranges including and/or spanning the aforementioned values. In some embodiments, the wt % of acemannan in the fire suppressing and/or extinguishing composition after dilution (e.g., with water) is equal to or less than about: 0.001%, 0.01%, 0.03%, 0.05%, 0.1%, 1.0%, 2.5%, 5.0%, 7.5%, or ranges including and/or spanning the aforementioned values.

In some embodiments, the concentrate comprises a hydrocolloid (e.g., gelling agent, a hydrogel forming, a water-soluble gum and hydrophilic polymer) capable of swelling and delivering water to the fire fuel source. In some embodiments, the hydrocolloid is a polysaccharide as disclosed elsewhere herein. In some embodiments, the temperature suppressing agent and/or water delivery agent of the concentrate comprises a hydrogel-forming and/or hydrophilic polymer. Without being bound to any mechanism, it is believed that hydrogel-forming and/or hydrophilic polymers function as temperature reducing agents and/or water delivery materials in the fire suppressing/and or extinguishing composition. These can be used in addition to, or instead of acemannan and/or *Aloe vera*. In some embodiments, the weight percent of a wet hydrogel-forming and/or hydrophilic polymer(s) (e.g., the weight percent of hydrated hydrogel) in the fire suppressing and/or extinguishing concentrate is equal to at least about: 10%, 20%, 40%, 60%, 70%, 80%, 90%, or ranges including and/or spanning the aforementioned values. In some embodiments, the wt % hydrogel-forming and/or hydrophilic polymer(s) in the fire suppressing and/or extinguishing composition is equal to or at least about: 0.01%, 0.1%, 0.3%, 0.5%, 1.0%, 10%, 25%, 50%, 75%, 80%, 95%, or ranges including and/or spanning the aforementioned values. In some embodiments, the wt % hydrogel-forming and/or hydrophilic polymer(s) in the diluted fire suppressing and/or extinguishing concentrate is equal to or at least about: 0.001%, 0.01%, 0.03%, 0.05%, 0.10%, 1.0%, 2.5%, 5.0%, 7.5%, or ranges including and/or spanning the aforementioned values.

In some embodiments, the hydrogel-forming and/or hydrophilic polymer is a polysaccharide. In some embodiments, the hydrogel-forming and/or hydrophilic polymer is the polysaccharide as disclosed elsewhere herein. In some embodiments, the hydrogel-forming and/or hydrophilic polymer is a combination of polysaccharides, with specific characteristics, charges, enabling the formation of micelles when mixed with chosen bio-surfactants. The hydrogel-forming and/or hydrophilic polymer/bio-surfactant mixture are able to form adsorption layers at the surface of oil droplets, therefore enhance the emulsion stability of the fire suppressing and/or extinguishing composition. When an oppositely charged polymer is added to the bio-surfactant solution, this forms a steric barrier which prevents coalescence and helps the stability of the foam, preventing its disruption, therefore enabling the encapsulation of the fuel and preventing re-ignition. In some embodiments, the hydrogel forming and/or hydrophilic polymer is not a polysaccharide. In some embodiments, the hydrogel forming and/or hydrophilic polymer comprises one or more of acemannan, hyaluronic acid, collagen, starch, alginate, agarose, guar gum or the like. As used herein, bio-surfactant comprises one or more of cocobetaine and/or sodium cocoamphoacetate, and/or glycine betaine.

In some embodiments, the acemannan, aloeride, polysaccharides, cellulosic material, *Aloe* extract, components (and/or hydrogel-forming and or hydrophilic polymers) are selected based on their molecular weight. In some embodiments, the molecular weight of the hydrogel-forming and/or hydrophilic polymers in the fire suppression and/or extinguishing composition have a mass in Daltons (Da) of equal to or at least about: 10000, 50000, 100000, 1000000, 1300000, 2000000, 3000000, 4000000, 5000000, 6000000, 7000000, or ranges including and/or spanning the aforementioned values.

In some embodiments, the fire suppressing and/or extinguishing composition (e.g., the concentrate or the diluted concentrate) can comprise one or more thickening agent, one or more surfactants, one or more humectants, one or more agents that prevents the crystallization of water (e.g., antifreeze agent), and/or one or more pH adjusting agent. It should be appreciated that these ingredients, individually or collectively may or may not be present in the fire suppressing and/or extinguishing composition. Thus, as described above, in some embodiments, the fire suppressing and/or extinguishing composition lacks a thickening agent, a surfactant, a humectant, an agent that prevents the crystallization of water (e.g., an antifreeze agent), and/or a pH adjusting agent.

As disclosed elsewhere herein, in some embodiments, the composition comprises one or more thickening agents. In some embodiments, the thickening comprises a polysaccharide and/or a cellulosic material (such as celluloses and their derivatives) as disclosed elsewhere herein. In some embodiments, the thickening agent comprises one or more of gellan gum, guar gum, carbomer (e.g., carbomer 940/980), xanthan gum, gum Arabic, pectin, *Acacia* gum, dried exudate from the stems and branches of the *Acacia* tree (e.g., polysaccharides, starches, glucuronic acid, galacturonic acid, etc.), and/or hydroxypropyl guar (e.g., which is a non-ionic polymer made of naturally occurring guar, *Cyamopsis tetragonoloba*). These gums also have emulsifying properties for oil in water emulsions (which helps with the encapsulation properties of the formulation). In some embodiments, the thickening agent comprises a polysaccharide or cellulosic material as disclosed above. For example, in some embodiments, a botanical material is provided as the temperature suppressing and/or water delivery agent, and a polysaccharide as a thickener. In some embodiments, one polysaccharide is used as the temperature suppressing agent and/or water delivery agent and another polysaccharide as a thickener. In some embodiments, a single or multiple polysaccharide (e.g. 2, 3, 4, 5, or more) are used together to serve a dual purpose as a temperature suppressing agent and/or water delivery agent and thickener.

In some embodiments, the weight percent of the thickening agent or thickening agents in the fire suppressing and/or extinguishing concentrate, individually or collectively, is equal to or at least about: 0.01%, 0.1%, 1.0%, 2.5%, 5.0%, 10%, 20%, 25%, 30%, or ranges including and/or spanning the aforementioned values. In some embodiments, the weight percent of the thickening agent or thickening agents in the fire suppressing and/or extinguishing concentrate, individually or collectively, is equal to or less than about: 0.01%, 0.1%, 0.3%, 0.5%, 1.0%, 2.5%, 5.0%, 10%, 20%, 25%, 30%, or ranges including and/or spanning the aforementioned values. In some embodiments, the weight percent of the thickening agent or thickening agents in the diluted fire suppressing and/or extinguishing composition, individually or collectively is equal to or at least about: 0.001%, 0.01%, 0.025%, 0.05%, 0.5%, 1.0%, 2.0%, 2.5%, 3.0%, or ranges including and/or spanning the aforementioned values. In some embodiments, the weight percent of the thickening agent in the diluted fire suppressing and/or extinguishing composition individually or collectively, is equal to or less than about: 0.001%, 0.01%, 0.025%, 0.05%, 0.1%, 2.0%, 2.5%, 3.0%, or ranges including and/or spanning the aforementioned values.

In some embodiments, as disclosed elsewhere herein, a soluble or swellable polysaccharide is used as a thickening agent (e.g., xanthan gum, a cellulosic material, etc.) because its water solubility and its ability to swell (e.g., as a swellable thickening agent). In some embodiments, thickening agents (e.g., as a swellable thickening agent) aid in causing a foam to form a gel when the composition comes into contact with a polar hydrophilic liquid (e.g. alcohols, ketones etc.). In some embodiments, the thickening agent acts as a barrier towards the fuel vapors and liquids and prevents the foam blanket from breaking. In some embodiments, 1,3-propanediol is used as a thickening agent. In some embodiments, 1,3-propanediol is not used as a thickening agent.

While several embodiments described herein comprise a thickening agent, in some embodiments, the fire suppressing and/or extinguishing composition lacks a thickening agent, including any one or more of the thickening agents disclosed elsewhere herein.

As disclosed elsewhere herein, in some embodiments, the composition comprises one or more bio-surfactants. In some embodiments, the surfactant reduces water surface tension and/or aids in foaming the composition. In some embodiments, the surfactant helps the composition form a foam blanket when mixed with air (e.g., when the composition is deployed). In some embodiments, it has been noted that compositions comprising surfactants can extinguish fires faster than those without surfactants. Molecules of surfactants adhere to interfaces (e.g., water-oil, liquid-gas, and solid-liquid or gas) and lower their surface energy (i.e., interfacial tension). For example, adding a surfactant to a two phase system (e.g., water-oil) will increase the concentration of surfactant adsorbed at the liquid-liquid interface, thus decreasing the surface energy (i.e. interfacial tension), until the interface becomes saturated in surfactant known as the critical micelle concentration (CMC). The excess of surfactant creates self-assembly systems such as micelles. Those micelles are the first step to encapsulation of the fuel, and annihilation of high energy free radicals. (in combustion, free radicals have very high energy and high velocity impact with combustible substances. They then release more energy to prompt reaction and produce more free radicals).

The addition of surfactant decreases the surface tension of water, enhancing penetration of water molecules and creating a foam blanket on the fuel, thus obstructing the combustion of oil steam.

Bio-surfactant are chosen in one or more embodiments of the invention composition for environmental reasons. The ideal surfactant will induce a low surface tension, will have high solubility in water and/or oil, will have insensitivity to temperature, salinity, or other environmental factors, fast kinetics for self-assembly, high biodegradability and biocompatibility.

In some embodiments, the surfactant comprises one or more of cocobetaine (e.g., cocamidopropyl betaine), esterquat, lysophosphatidylcholine, laurylamidopropyl hydroxysultaine, decyl glycoside, sodium lauroyle lactilate, sodium oleate, potassium laureate, alpha olein sulfonate, cocoglucose, sodium cocoamphoacetate (amphoteric), lauryl glycoside (non-ionic), sodium cocoyl glutamate (anionic) and/or sodium lauryl glucose carboxylate (anionic). In some embodiments, anionic, cationic, and or neutral (non-ionic) surfactants can be used. In some embodiments, the surfactant will be chosen for its ability to bind with the polysaccharides in the fire extinguishing composition, to create the best environment for emulsion, foam stability, micelle formation and encapsulation of the fuel.

In one or more embodiments, the compositions can comprise a botanical material such as *Aloe vera* or extract thereof and one or more additional chemical components/agents. The additional chemical components can include a low freeze temperature agent such as potassium lactate, a thickening/binding agent such as propanediol (e.g., 1,3-propanediol), a bio-based surfactant such as cocamidopropyl betaine, polysaccharides such as xanthan gum, guar gum or derivatives thereof, a pH adjusting agent such as triethanolamine, sodium gluconate, foaming agents, foam stabilizers, emulsifying agents, chelating agents, emollients, preservatives, bamboo extracts, algae extracts, *Santalum acuminatum, Citrus Glauca*, wattle seed extract, cactus extract, psicose and water.

Because of the increasing need to incorporate renewable carbon responsibility in products to reduce carbon footprint, improve sustainability and alleviate environmental concerns, one or more embodiments of the present invention incorporates bio-based surfactants ("biosurfactants").

Biosurfactants are derived in whole or significant part from biological products or renewable agricultural materials (e.g., plants, vegetable, marine materials).

Amphoteric surfactants possess both positive and negative charged groups in the same molecule. Betaine surfactants are zwitterionic. The key functional groups in the chemical structure of Betaines are the quaternized nitrogen and the carboxylic group. Amphoteric biosurfactant like Betaines offer good foam density and stability in hard water, unlike anionic surfactants.

Betaine also foams at pH extremes. It is believed that Alkyl and Alkyl Amido Betaines show synergy with anionic polyelectrolytes like xanthan gum, by increasing the packing density and stabilizing the interface. It is believed that the zwitterionic biosurfactants helps screen the charge carried by the anionic polyelectrolyte (e.g. xanthan gum) at the interface, resulting in closer packing of surfactant. The closer packing would increase the charge density and the resulting electrostatic repulsions, preventing film coalescence. The closer packing of biosurfactant-polyelectrolytes molecules at the interface, also increase the surface shear viscosity, stabilize the emulsion, thus enables encapsulation by inducing adsorption of the surfactant onto the polymer.

Figure 8A:
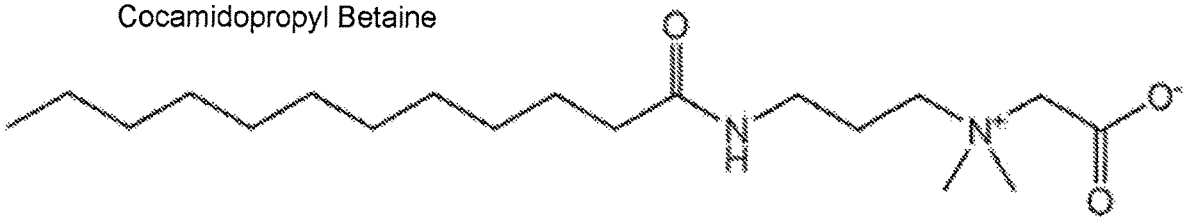
FIGS. 8A-F show various Bio-based surfactants that can be used as an ingredient in compositions in accordance with one or more embodiments of the present invention.
Figure 8B:
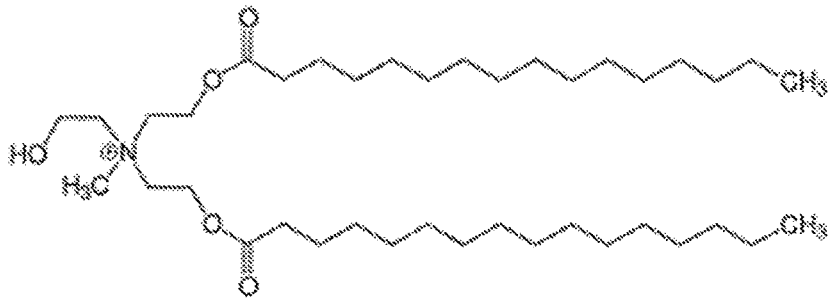
Figure 8C:
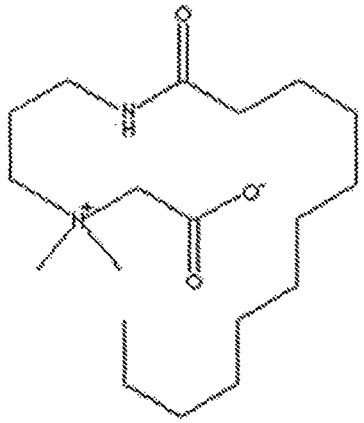
Figure 8D:
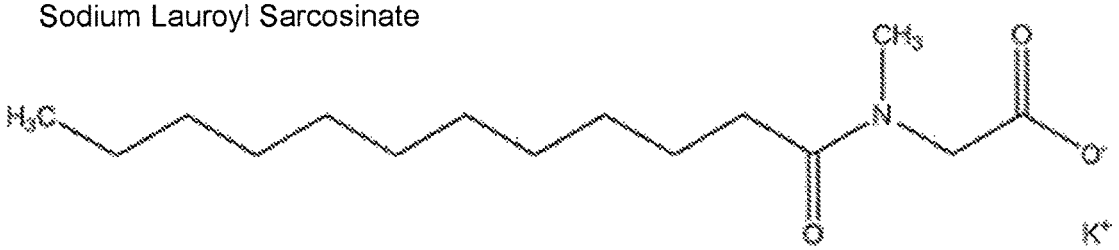
Figure 8E:
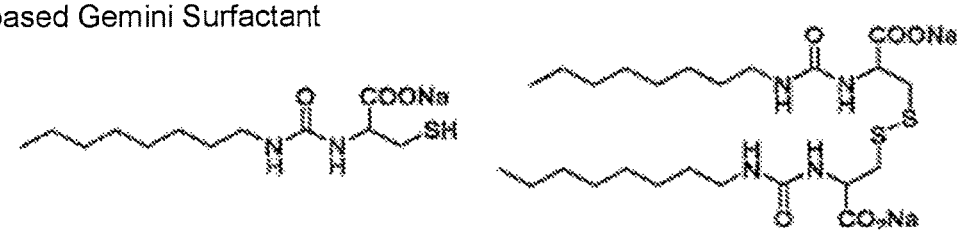
Figure 8F:
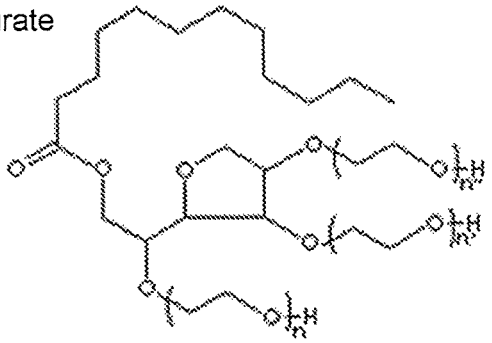

FIGS. 8A-F are illustrations of the chemical structures of various bio-based surfactants used in embodiments of the present invention. FIG. 8A is Cocamidopropyl Betaine; 8B is Esterquat; 8C is Lauryl Amidopropyl Betaine; 8D is Sodium Lauroyl Sarcosinate; 8E is Cystine based Gemini Surfactant; and 8F is Ethoxylated Sorbitan Laurate.

In some embodiments, the weight percent of the surfactant or surfactants in the fire suppressing and/or extinguishing composition concentrate, individually or collectively is equal to or at least about: 0.1%, 1%, 4%, 10%, 15%, 20%, 30%, 40%, or ranges including and/or spanning the aforementioned values. In some embodiments, the weight percent of the surfactant or surfactants, in the diluted fire suppression and/or extinguishing composition, individually or collectively, is equal to or less than about 0.1%, 1%, 4%, 5%, 10%, 15%, 20%, 30%, 40%, or ranges including and/or spanning the aforementioned values. In some embodiments, the weight percent of the surfactant or surfactants in the diluted fire suppressing and/or extinguishing composition, individually or collectively is equal to or at least about: 0.1%, 0.4%, 0.5%, 1.0%, 1.5%, 2.0%, 3.0%, 4.0%, or ranges including and/or spanning the aforementioned values. In some embodiments, the weight percent of the surfactant or surfactants in the diluted fire suppressing and/or extinguishing composition, individually or collectively, is equal to or less than about: 0.1%, 0.4%, 0.5%, 1.0%, 1.5%, 2.0%, 3.0%, 4.0% or ranges including and/or spanning the aforementioned values. In some embodiments, the fire suppressing and/or extinguishing composition lacks a surfactant.

In some embodiments, Cocobetaine is selected as the bio-surfactant (or as one of the surfactants) because of its high level of biodegradability and biocompatibility. In some embodiments, cocobetaine has both wettability and foaming properties (for foam and foam stability) and good viscosity building. The foam is particularly resistant to hard water and extreme pH. In some embodiments, cocobetaine is selected as a surfactant due to its amphoteric properties and/or compatibility with anionic, non-ionic, and other cationic surfactants. Amphoteric surfactants possess both positive and negative charged groups in the same molecule.

Cocobetaine is also a good foam booster and it is derived from coconut oil and is water soluble (with a pH of 5 to 6). In some embodiments, the surfactant is decyl glucoside sodium lauroyl lactylate. Decyl glucoside lauroyl lactylate is a non-ionic surfactant blend consisting of decyl glucoside and sodium lauroyl lactylate. Decyl glucoside can be made from coconut and corn starch. Sodium lauroyl lactylate is the sodium salt of lactic acid. In some embodiments, sodium oleate and/or potassium laurate can be used as a surfactant.

In some embodiments, a surfactant comprises a mild anionic, foaming, and/or emulsifying surfactant (e.g., alpha olein sulfonate). Alpha olein sulfonate is made primarily from coconut oils. In some embodiments, the surfactant as a wetting effect, foam booster properties, and/or has good compatibility with other surfactants including non-ionic, amphoteric, or anionic co-surfactants. In some embodiments, the weight percent of alpha olein in the concentrated fire suppressing and/or extinguishing composition is equal to or less than about: 1%, 4%, 5%, 10%, 15%, 20%, 30%, 40%, or ranges including and/or spanning the aforementioned values. In some embodiments, the weight percent of alpha olein sulfonate in the diluted fire suppressing and/or extinguishing compositions is equal to or less than about: 0.1%, 0.4%, 0.5%, 1.0%, 1.5%, 2.0%, 3.0%, 4.0%, or ranges including and/or spanning the aforementioned values. In some embodiments, the weight percent of the surfactant(s) (e.g., cocoglucose, sodium cocoamphoacetate, lauryl glycoside, sodium cocoyl glutamate, and/or sodium lauryl glucose carboxylate, individually or collectively), in the diluted fire suppressing and/or extinguishing composition is equal to or at least about: 0.1%, 0.4%, 0.5%. 1.0%, 1.5%, 2.0%, 3.0%, 4.0%, or ranges including and/or spanning the aforementioned values. In some embodiments, the weight percent of the surfactant(s) (e.g., cocoglucose, sodium cocoamphoacetate, lauryl glycoside, sodium cocoyl glutamate, and/or sodium lauryl glucose carboxylate individually or collectively) in the concentrated composition is disclosed elsewhere herein.

While several embodiments described herein comprises a surfactant, in some embodiments, the fire suppressing and/or extinguishing composition lacks a surfactant, including any one or more of the surfactants disclosed elsewhere herein.

As disclosed elsewhere herein, in some embodiments, the composition comprises one or more humectants. Some embodiments of the composition comprise one or more emollients (e.g., humectants and/or wetting agents). In some embodiments, the humectant comprises one or more of 1,3-propanediol, 1,2-propanediol and/or isopropyl isostearate. In some embodiments, the composition lacks 1,2-propanediol (e.g., propylene glycol). In some embodiments, the weight percent of the humectant or humectants in the concentrated fire suppressing and/or extinguishing composition, individually or collectively, is equal or at least about: 1%, 5%, 10%, 15%, 20%, 25%, 35%, or ranges including and/or spanning the aforementioned values. In some embodiments, the weight percent of the humectant or humectants in the diluted fire suppressing and/or extinguishing composition, individually or collectively, is equal to or at least about: 0.05%, 0.1%, 0.5%, 1.0%, 1.5%, 2.0%, 2.5%, 3.5%, or ranges including and/or spanning the aforementioned values. In some embodiments, the weight percent of the humectant or humectants in the diluted fire suppression and/or extinguishing composition, individually or collectively, is equal to or less than about: 0.05%, 0.1%, 0.5%, 1.0%, 1.5%, 2.0%, 2.5%, 3.5%, or ranges including and/or spanning the aforementioned values. In some embodiments, where used, the 1,3-propanediol also adds fluidity properties, antifreeze properties, and/or a preservative boosting efficacity.

In some embodiments, 1,3-propanediol advantageously affects the performances of the bio-surfactant. The hydrophile-lipophile balance (HLB) value of surfactant is important to predict performance of, for example, emulsifiers, solubilizers and wetting agents. The HLB value is important to predict the micellization, and encapsulation at the interface. The micellization of surfactants in aqueous solution is regulated by the balance between 2 opposing forces: the cohesive force between the hydrophobic groups and the attractive forces between the hydrophilic groups and water molecules. In some embodiments it is believed that 1,3-propanediol raises the HLB value of the surfactant in solution, therefore its water solubility. In some embodiments, it is believed that 1,3-propanediol advantageously affects the conformation of the polysaccharide or botanical in solution, allowing it to expand and deliver water more effectively. In some embodiments, it is believed that 1,3-propanediol enhances the heat adsorption capacity of the fire suppressing and/or extinguishing composition.

In some embodiments, the humectant comprises glycerol. In some embodiments, the humectant lacks glycerol. In some embodiments, the fire suppressing and/or extinguishing composition lacks a humectant.

While several embodiments described herein comprise a humectant, in some embodiments, the fire suppressing and/or extinguishing composition lacks a humectant, including any or more of the humectants disclosed elsewhere herein.

As disclosed elsewhere herein, the composition comprises one or more low freeze agent. The low freezing agent comprises Potassium lactate 60% in water solution, sodium lactate 60% in water solution. In some embodiments, the weight percent of the low freeze agent or low freeze agents in the fire suppressing and/or extinguishing concentrate, individually or collectively, is equal to or at least about: 0.01%, 0.1%, 1.0%, 2.5%, 5.0%, 10%, 20%, 25%, 30%, or ranges including and/or spanning the aforementioned values. In some embodiments, the weight percent of the low freeze agent or low freeze agents in the fire suppressing and/or extinguishing concentrate, individually or collectively, is equal to or less than about: 0.01%, 0.1%, 0.3%, 0.5%, 1.0%, 2.5%, 5.0%, 10%, 20%, 25%, 30%, or ranges including and/or spanning the aforementioned values. In some embodiments, the weight percent of the low freeze agent or low freezes agents in the diluted fire suppressing and/or extinguishing composition, individually or collectively is equal to or at least about: 0.001%, 0.01%, 0.025%, 0.05%, 0.5%, 1.0%, 2.0%, 2.5%, 3.0%, or ranges including and/or spanning the aforementioned values. In some embodiments, the weight percent of the low freeze agent in the diluted fire suppressing and/or extinguishing composition individually or collectively, is equal to or less than about: 0.001%, 0.01%, 0.025%, 0.05%, 0.1%, 2.0%, 2.5%, 3.0%, or ranges including and/or spanning the aforementioned values.

As disclosed elsewhere herein, in some embodiments, the composition comprises one or more pH adjusting agents. In some embodiments, the pH adjusting agent comprises one or more of triethylamine, triethanolamine, sodium gluconate, gluconic acid, and/or citric acid. Sodium gluconate is the sodium salt of gluconic acid. In addition to pH adjusting capabilities, sodium gluconate has chelating properties over a wide pH range and/or it also reacts as a pH regulator as well as a humectant. Citric acid is naturally produced (e.g., by fermentation of carbohydrates) and is another biocompatible pH adjusting agent. In some embodiments, the weight percent of the pH adjusting agent or pH adjusting agents in the fire suppressing and/or extinguishing concentrate, individually or collectively, is equal to or at least about: 0.01%, 0.1%, 1%, 2%, 3%, 5%, or ranges including and/or spanning the aforementioned values. In some embodiments, the weight percent of the pH adjusting or pH adjusting agents in the diluted fire suppression and/or extinguishing composition, individually or collectively, is equal to or at least about: 0.001%, 0.01%, 0.1%, 0.2%, 0.3%, 0.5%, or ranges including and/or spanning the aforementioned values. In some embodiments, the pH adjusting agent (e.g., acidulant) also has chelating effects as well as buffering properties (helps to maintain pH). In some embodiments, the fire suppression and/or suppressing extinguishing composition lacks a pH adjusting agent.

While several embodiments described herein comprise a pH adjusting agent, in some embodiments, the fire suppression and/or extinguishing composition lacks a pH adjusting agent, including one or more of the pH adjusting agents disclosed elsewhere herein.

In some embodiments, the fire suppressing and/or extinguishing composition further comprises one or more foaming agents (e.g., an agent or agents that give the composition foaming properties and/or boost the foaming properties of the composition). In some embodiments, the foaming agent comprises one or more of alfalfa extract, *Medicago sativa*, hydroxypropyl methylcellulose (HPMC), methylcellulose, non-ionic water-soluble polymers, ionic water-soluble polymers or the like. In some embodiments, the foaming agent has antibacterial and foaming properties. In some embodiments, in addition or instead of being used as a foaming enhancer, HPMC can be used as a non-ionic water-soluble polymer that has thickening properties. In some embodiments, the weight percent of the foaming agent or foaming agents in the fire suppressing and/or extinguishing concentrate, individually or collectively, is equal to or at least about: 0.2%, 1%, 5%, 10%, 15%, or ranges including and/or spanning the aforementioned values. In some embodiments, the weight percent of the foaming agent or the foaming agents in the diluted fire suppression and/or extinguishing concentrate, individually or collectively, is equal to or less than about: 0.02%, 0.1%, 0.5%, 1.0%, 1.5%, or ranges including and/or spanning the aforementioned values. In some embodiments, the fire suppressing and/or extinguishing composition lacks a foaming agent.

While several embodiments described herein comprises a foaming agent, in some embodiments, the fire suppressing and/or extinguishing composition lacks a foaming agent, including any one or more of the foaming agents disclosed elsewhere herein.

In some embodiments, the fire suppressing and/or extinguishing composition further comprises one or more foam stabilizers. In some embodiments, the foaming agents acts as foam stabilizer. In some embodiments, the weight percent of the foam stabilizer(s) in the concentrated fire suppressing and/or extinguishing composition, individually or collectively, is equal to or at least about: 1%, 5%, 10%, 15%, or ranges including and/or spanning the aforementioned values. In some embodiments, the weight percent of the foam stabilizer(s) in the diluted fire suppressing and/or extinguishing composition, individually, or collectively, is equal to or at least about: 0.1%, 0.5%, 1.0%, 1.5%, or ranges including and/or spanning the aforementioned values. In some embodiments, the weight percent of the foam stabilizer(s) in the diluted fire suppressing and/or extinguishing concentrate, individually or collectively, is equal to or less than about: 0.1%, 0.5%, 1.0%, 1.5% or ranges including and/or spanning the aforementioned values. In some embodiments, the fire suppressing and/or extinguishing composition lacks a foam stabilizer, including any or more of the foam stabilizers disclosed herein. In some embodiments, the foam stabilizer comprises one or more of EDTA (ethylenediaminetetraacetic acid salt) or sodium gluconate.

In some embodiments, the fire suppressing and/or extinguishing composition further comprises one or more emulsifying agents. In some embodiments, the emulsifying agent comprises one or more of ceteareth 20, non-ionic polyoxyethylene ether of higher saturated fatty alcohols (e.g., cetyl/stearyl alcohol), or the like. In some embodiments, the emulsifying agent is one that dissolves in water and/or alcohol to form a colloid solution. In some embodiments, the emulsifying agent can be mixed with mineral, vegetable or synthetic fats and oils. In some embodiments, the emulsifying agent has an HLB (Hydrophile-Lipophile-Balance) value of about 15-17 (gives oil in water emulsions). In some embodiments, the weight percent of the emulsifying agent or emulsifying agents in the concentrated fire suppression and/or extinguishing composition (e.g., the concentrate), individually or collectively, is equal to or at least about: 0.5%, 1%, 5%, 10%, 15%, 30%, or ranges including and/or spanning the aforementioned values. In some embodiments, the weight percent of the emulsifying agent or emulsifying agents in the concentrate fire suppressing and/or extinguishing composition (e.g., the concentrate), individually or collectively, is equal to or less than about: 0.5%, 1%, 5%, 10%, 15%, 30%, or ranges including and/or spanning the aforementioned values. In some embodiments, the weight percent of the emulsifying agent or emulsifying agents in the diluted fire suppressing and/or extinguishing concentrate, individually or collectively, is equal to or at least about: 0.05%, 0.1%, 0.5%, 1.0%, 3.0% or ranges including and/or spanning the aforementioned values. In some embodiments, the fire suppressing and/or extinguishing composition lacks an emulsifying agent, including lacking any one or more of the emulsifying agents disclosed herein.

In some embodiments, the fire suppressing and/or extinguishing composition further comprises one or more chelating agents. In some embodiments, the chelating agent comprises one or more of ethylenediaminetetraacetic acid salt ("EDTA"), sodium gluconate, or the like. In some embodiments, EDTA is used as a chelating agent. In some embodiments, EDTA is used as a co-preservative. In some embodiments, EDTA is used as an emulsifier. In some embodiments, EDTA is used as a foam stabilizer. In some embodiments, the weight percent of the chelating agent or chelating agents in the concentrated fire suppressing and/or extinguishing composition, individually or collectively, is equal to or at least about: 0.1%, 1%, 5%, or ranges including and/or spanning the aforementioned values. In some embodiments, the weight percent of the chelating agent or chelating agents in the concentrated fire suppressing and/or extinguishing composition, individually or collectively, is equal to or less than about: 0.1%, 1%, 5%, or ranges including and/or spanning the aforementioned values. In some embodiments, the weight percent of the chelating agent or chelating agents in the diluted fire suppressing and/or extinguishing concentrate, individually or collectively, is equal to or less than about: 0.01%, 0.1%, 0.5%, or ranges including and/or spanning the aforementioned values. In some embodiments, the weight percent of the chelating agent or chelating agents in the diluted fire suppressing and/or extinguishing concentrate, individually or collectively, is equal to or less than about: 0.01%, 0.1%, 0.5%, or ranges including and/or spanning the aforementioned values. In some embodiments, the fire suppressing and/or extinguishing composition lacks a chelating agent, including lacking one or more of the chelating agents disclosed herein.

In some embodiments, the fire suppressing and/or fire extinguishing composition further comprises one or more preservatives. In some embodiments, the preservative comprises one or more of sodium phenoxyethanol, phenoxyethanol, caprylyl glycol, and/or sorbic acid as a preservative. In some embodiments, the weight percent of the preservative or preservatives in the concentrated fire suppressing and/or extinguishing composition (e.g., the concentrate), individually or collectively, is equal to or at least about: 0.5%, 1%, 2%, 4%, 10%, or ranges including and/or spanning the aforementioned values. In some embodiments, the weight percent of the preservative or preservatives in the concentrated fire suppressing and/or extinguishing composition (e.g., the concentrate), individually or collectively, is equal to or less than about: 0.5%, 1%, 2%, 4%, 10%, or ranges including and/or spanning the aforementioned values. In some embodiments, the weight percent of the preservative or preservatives in the diluted fire suppressing and/or extinguishing concentrate, individually or collectively, is equal to or at least about: 0.005%, 0.05%, 0.1%, 0.2%, 0.4%, 1.0%, 1.5%, 2.0%, or ranges including and/or spanning the aforementioned values. In some embodiments, the weight percent of the preservatives or preservatives in the diluted fire suppressing and/or extinguishing concentrate, individually or collectively, is equal to or less than about: 0.005%, 0.05%, 0.1%, 0.2%, 0.4%, 1.0%, 1.5%, 2.0%, or ranges including and/or spanning the aforementioned values. In some embodiments, preservatives (e.g., phenoxyethanol) provide effective broad spectrum protection against gram positive and negative bacteria, yeast, and mold while imparting emolliency to the formulation. Caprylyl glycol is a mild humectant that improves the efficacy of preservatives. In some embodiments, caprylyl glycol is used with phenoxyethanol at 1-2 weight percent of the concentrated formulation together. In some embodiments, the fire suppressing and/or extinguishing composition lacks a preservative, including lacking any one or more of the preservatives disclosed herein.

In some embodiments, additional extracts are added to the fire suppressing and/or extinguishing composition to improve its compatibility with users (e.g., to further protect or condition the skin of the user, etc.). In some embodiments, the composition comprises bamboo extract, algae extract (*Laminaria*), Quandong (*Santalum acuminatum*), Desert Lime (*Citrus Glauca*), wattle seed (*Acacia victoriae*) extract, and/or cactus extract. In some embodiments, the weight percent of the additional extract(s) in the concentrated fire suppressing and/or extinguishing composition (e.g., the concentrate), individually or collectively, is equal to or at least about: 0.5%, 1%, 2%, 5%, 10%, or ranges including and/or spanning the aforementioned values. In some embodiments, the weight percent of the additional extract(s) in the diluted fire suppressing and/or extinguishing concentrate, individually or collectively, is equal to or at least about: 0.05%, 0.1%, 0.2%, 0.5%, 1.0%, or ranges including and/or spanning the aforementioned values. In some embodiments, the fire suppressing and/or extinguishing composition lacks additional extracts.

In some embodiments, psicose is used as an additive. Psicose (e.g. allulose, ribo-2-hexulose, $C_6H_{12}O_6$) is a low-energy monosaccharide sugar present in small quantities in natural products. In some embodiments, the weight percent of the psicose in the concentrated fire suppressing and/or extinguishing composition (e.g., the concentrate), individually or collectively, is equal to or at least about: 0.5%, 1%, 2%, 4%, 10%, or ranges including and/or spanning the aforementioned values.

In some embodiments, the concentrate comprises deionized water. In some embodiments, water is added as a diluting agent to the fire suppressing and/or extinguishing composition to prepare the concentrate. In some embodiments, the fire suppressing and/or extinguishing composition (e.g., the concentrate) comprises water at a weight percent equal to or less than about: 10%, 20%, 40%, 50%, 60%, 65%, 70%, 80%, 85%, 90%, 98%, or ranges including and/or spanning the aforementioned values. In some embodiments, the fire suppressing and/or extinguishing composition (e.g., the concentrate) comprises water at a weight percent equal to or at least about: 10%, 20%, 40%, 60%, 70%, 80%, 90%, 98%, or ranges including and/or spanning the aforementioned values. In some embodiments, the fire suppressing and/or extinguishing concentrate is diluted with deionized water. Deionized is non-conductive and can be used with the composition to extinguish Class C fires with a unique mist spray nozzle. When discharged, the diluted composition releases micro-droplets, creating intense cooling to the fire and suffocating the fire by depleting the oxygen.

In some embodiments, the concentrated fire suppressing and/or extinguishing (e.g., the concentrate) is diluted with additional water to prepare a dilute composition. In some embodiments, the concentrated fire suppressing and/or extinguishing (e.g., the concentrate) is diluted to a weight percent (wt %) of equal or less than about: 0.25%, 3%, 6%, 10%, 20%, 40%, 60%, 80%, 90%, 98%, or ranges including the aforementioned values. For instance, for a 10 wt % solution of the fire suppressing and/or extinguishing composition can be prepared by diluting 100 g of the concentrated fire suppressing and/or extinguishing composition (e.g., the concentrate) with 900 g of water.

In some embodiments, the concentrated fire suppressing and/or extinguishing composition is diluted with water to a volume percent (vol %) of equal to or less than about: 0.25%, 1%, 3%, 5%, 6%, 9%, 10%, 20%, 40%, 60%, 80%, 90%, 98%, or ranges including and/or spanning of the aforementioned values. For instance, for a 10 vol % solution of the fire suppressing and/or extinguishing composition can be prepared by diluting 1 quart of the concentrated fire suppressing and/or extinguishing composition (e.g., the concentrate) with 9 quarts of water.

In some embodiments, the concentrated fire suppressing and/or extinguishing composition is diluted with water to a weight volume (or w/v) of equal to or less than about: 2%, 10%, 20%, 40%, 60%, 80%, 90%, 98%, or ranges including and/or spanning the aforementioned values. For instance, for a 10% w/v solution of the composition can be prepared by diluting 10 g of the concentrated fire suppressing and/or extinguishing composition (e.g., the concentrate) to a volume of 100 mL using water. In some embodiments, the concentrated fire suppressing and/or extinguishing composition is used without dilution.

For brevity, only certain exemplary wt % values for each possible ingredient in the diluted formulations have been provided above. However, in view of the dilution levels disclosed above, the wt %, vol %, and % w/v value for each particular ingredient in a diluted formulation (from concentrate as disclosed elsewhere herein). In other words, it should be appreciated that the total concentration of each ingredient disclosed elsewhere herein can be expressed as a proportion of the diluted formulation. For example, where a concentrate is disclosed as comprising 50 wt % of botanical material, and where a concentrate is disclosed being dilutable at 10 wt % solution with water, while not expressly written, a diluted formulation comprising botanical material at 5 wt % is also disclosed. The following paragraph also illustrates the concept of dilution contemplated herein.

For instance, 100 g of concentrate can be prepared by adding 50 g of botanical material to 50 g of other ingredients (e.g., a thickening agent, a surfactant, a humectant, an antifreeze agent, a pH adjusting agent, etc.). This concentrate is 50 wt % botanical material. If that concentrate is then diluted with 900 g of water, the wt % of the botanical material is 5 wt % of the diluted formulation. Similarly, where that same 100 g of concentrate is diluted with 1900 g of water, the wt % of the botanical material is 2.5% wt % of the diluted formulation. The wt % of the botanical materials to the diluted solution may be expressed in terms of a weight ratio. For instance, in the first example above, the ratio of diluted solution to botanical material is 20:1. Also, in the second example, the weight ratio is 40:1. In some embodiments, the weight ratio is equal to or about: 1:1, 2:1, 3:1, 4:1, 5:1, 6:1, 7:1, 8:1, 9:1, 10:1, 15:1, 20:1, 25:1, 30:1, 40:1, 50:1, or ranges including and/or spanning the aforementioned values.

Without being bound to any mechanism, it is believed that the fire suppressing and/or extinguishing composition acts, at least in part, as water delivery agent and/or that evaporating cooling aids in the cooling of the fire. In some embodiments, prior to deploying the composition, it is diluted with water.

As discussed elsewhere herein, some embodiments of the fire suppressing and/or extinguishing composition disclosed herein are not toxic. In some embodiments, small quantities (e.g., less than 5 g, 10 g, 50 g, 100 g) can be ingested safely (e.g., by a human, mammal, or other animal). In some embodiments, the fire suppressing and/or extinguishing compositions disclosed herein can be applied to the skin of humans or other mammals and animals (e.g., dogs, cats, livestock, birds, reptiles, fish, etc.) safely and/or substantially without reaction (e.g., a skin reaction such as a rash or burn). In some embodiments, applications of at least 5 g of the composition to the skin (e.g., by rubbing a person's arm with the composition) leaves no lasting or visible residue on the skin after less than or equal to (about: 5 minutes, 15 minutes, 30 minutes, or ranges including and/or spanning the aforementioned values. In some embodiments, the fire suppressing and/or extinguishing composition is environmentally friendly. In some embodiments, the fire suppressing and/or extinguishing composition is biodegradable and does not substantially harm the environment. In some embodiments, the fire suppressing and/or extinguishing composition is composed primarily or substantially completely of naturally occurring ingredients (e.g., those found in nature).

In some embodiments, the fire suppressing and/or extinguishing composition is halogen-free. In some embodiments, the fire suppressing and/or extinguishing composition lacks compounds having halogen atoms. In some embodiments, the fire suppressing and/or extinguishing composition lacks compounds having —F, —Cl, —Br, and/or —I. In some embodiments, the fire suppressing and/or extinguishing composition is free of sugar alcohols. In some embodiments, the fire suppressing and/or extinguishing composition lacks dulcitol, iditol, mannitol, erythritol, threitol, arabitol, ribitol, sorbitol, and/or xylitol. In some embodiments, the fire suppressing and/or extinguishing composition lacks and/or is free of halogen containing ingredients. In some embodiments, the fire suppressing and/or extinguishing composition lacks and/or is free of sugar alcohols.

In some embodiments, the fire suppressing and/or extinguishing composition has a heat capacity that is higher than the heat capacity of water (e.g., 4.184 Joules/g·K). In some embodiments, the heat capacity of the fire suppressing and/or extinguishing composition is at least 5 Joules/g·K, 8 Joules/g·K, 11 Joules/g·K, 14 Joules/g·K, or ranges including and/or spanning the aforementioned values.

In some embodiments, the fire suppressing and/or extinguishing composition has a rapid cooling effect, lowering the temperature of the burning material below its flashpoint. In some embodiments, the fire suppressing and/or extinguishing composition also rapidly cools the material that was burning after the fire is extinguished. In some embodiments, the temperature of the material after the fire has been put out is decreased to a temperature at or below room temperature (e.g. about 73° F.). In some embodiments, application of the fire suppressing and/or extinguishing composition extinguishes fire fueled by a flaming object and simultaneously, cools the object after the fire is extinguished to a temperature below about 300° F., 200° F., 100° F., 72° F., or ranges including and/or spanning the aforementioned values. In some embodiments, the temperature of the object is decreased to below 100° F. within a time after the fire is extinguished of about: 1 s, 5 s, 10 s, 30 s, or ranges including and/or spanning the aforementioned values. In some embodiments, the temperature of the extinguished material (e.g., magnesium metal) decreases to below room temperature (e.g. about 72° F.) at a time after the fire is extinguished of about: 1 s, 5 s, 10 s, 30 s, or ranges including and/or spanning the aforementioned values.

Some embodiments pertain to methods of preparing the fire suppressing and/or extinguishing composition. In some embodiments, a temperature suppressing agent and/or water delivery agent is mixed with stirring. In some embodiments, where the temperature suppressing agent and/or water delivery agent is in powder form, it is mixed in a sufficient quantity of water, as described elsewhere herein, to dissolve the water or suspend the powder. In some embodiments, a thickening agent is added while mixing. In some embodiments, a surfactant is added while mixing. In some embodiments, a humectant is added while mixing. In some embodiments, an agent that prevents the crystallization of water (e.g., an antifreeze agent) is added while mixing. In some embodiments, a pH adjusting agent is added while mixing. In some embodiments, the composition is diluted with water, as described elsewhere herein.

In some embodiments, the formulation is placed in a canister (e.g., a fire extinguisher) for deployment as a concentrate or diluted formulation. In some embodiments, the container (e.g., canister) is pressurized using a compressed gas (e.g., air, $CO_2$, $N_2$, etc.). In some embodiments, the composition deploys as a mist, spray, liquid, gel or aerogel. In some embodiments, the fire suppressing and/or extinguishing composition is placed within a fire extinguisher canister. In some embodiments, the canister is pressurized to a pressure of equal to or at least about 80 psi, 100 psi, 120 psi, 150 psi, or ranges including and/or spanning the aforementioned values. For example, in some embodiments, using a 2.5 gallons extinguisher about 1 quart of fire suppressing and/or extinguishing composition is added. In some embodiments, about 9 quarts of water (e.g., tap water, distilled water and/or deionized water) is then added. In some embodiments, the dilution is performed in the canister. In some embodiments, the fire extinguisher is then sealed and pressurized to about 120 psi using, for example, a compressor.

In some embodiments, the concentrate can be distributed as a foam using a proportioner (e.g., FoamPro or similar proportioners). Proportioners can be attached to fire hoses and/or fire extinguishers to distribute a concentrate into a flowing liquid stream (e.g., water), diluting the concentrate to a desired level. In some embodiments, the proportioner dilutes the composition concentrate by vol %. In some embodiments, the proportioner dilutes the composition concentrate by a vol %. In some embodiments, the proportioner dilutes the concentrated fire suppressing and/or extinguishing composition to a volume percent (vol %) of equal to or less than about: 0.25%, 1%, 3%, 5%, 6%, 9%, 10%, 20%, 40%, 69%, 80%, 90%, 98%, or ranges including and/or spanning the aforementioned values. In some embodiments, the formulation is miscible with water. In some embodiments, the composition stays miscible in water when deployed by a proportioner into a stream of water. In some embodiments, the polymeric components of the composition are mutually miscible. In some embodiments, the polymeric components of the composition remain mutually miscible when deployed by a proportioner.

In some embodiments, the proportioner discharges the concentrate into a discharge side of the nozzle. By injecting into the discharged side, proportioning performance is not affected by external factors such as nozzle, length of hose lay, nozzle elevation or incoming pressure to water pump. In some embodiments, the proportioning system automatically reads water flow and injects concentrate: from 0.1% to 10.0%.

In some embodiments, a polymeric temperature suppressing agent and/or water delivery agent (e.g., botanical material) and polymeric thickening agent (e.g., polysaccharide) are mutually miscible. Mutual miscibility beneficially provides an extinguishing agent that is distributed uniformly and reproducibly when used. In some embodiments, the temperature suppressing agent and/or water delivery agent (e.g., botanical material) and the thickening agent (e.g., polysaccharide) are mutually miscible in the composition at a concentration of at least about 0.25% and at least about 0.25% respectively. In some embodiments, the temperature suppressing agent and/or water delivery agent and the thickening agent are mutually miscible in the composition at a concentration of at least about 0.1% and at least 0.1% respectively.

Some embodiments pertain to methods of suppressing and/or extinguishing fires. In some embodiments, the method involves contacting a fire fuel source (e.g., a Class A, B, C, D, K fire sources) with a fire suppressing and/or extinguishing composition as described elsewhere herein. In some embodiments, the method for suppressing and/or extinguishing the fire includes a step of applying a fire suppressing and/or extinguishing composition to an object or person at risk of catching fire (e.g., to extinguish the fire). For example, in some embodiments, the composition can be applied to the skin, the clothing (e.g., the uniform of a firefighter, military personnel, police, etc.), fabrics (e.g., burlap, cotton cloth, synthetic fabrics, etc.), fur, a vehicle (e.g., tires, exterior surfaces, interior surfaces, etc.), buildings (e.g., a roof, exterior surfaces, interior surfaces, etc.), or raw materials for fabricating any of the foregoing (e.g., magnesium wheel frames, wood piles, textiles, cloth, etc.), wherein the composition is applied prior to exposure to an ignition source or fire, or while the burning article is on fire.

For example, in some embodiments, the compositions disclosed herein (concentrated or diluted) can be applied to textiles that are used as building materials. In some embodiments, the compositions disclosed herein (concentrated or diluted) can be used to coat (e.g., can be applied to) structures, including homes, armories, storage facilities (e.g., for ordinances), or the like to prevent burning.

In some embodiments, the compositions disclosed herein (concentrated or diluted) can be used as an additive. In some embodiments, the compositions disclosed herein can be added to paint to provide a flame retardant or suppressive paint. In some embodiments, these paints can be used for vehicles, houses, etc. to provide fire suppression protection.

In some embodiments, the fire suppressing and/or extinguishing composition is effective in extinguishing or suppressing fire events likely to be encountered during military operations. In some embodiments, the fire suppressing and/or extinguishing composition is effective for used across fire classes. In some embodiments, the fire suppressing and/or extinguishing is organic-halide free (e.g., fluorocarbon-free and/or halon-free). In some embodiments, the fire suppressing and/or extinguishing composition is sugar-alcohol free. In some embodiments, the fire suppressing and/or extinguishing composition is composed of natural-products and/or is safe to the environment and to mammals and/or animals (e.g., humans, dogs, cats, livestock, birds, reptiles, fish, etc.). In some embodiments, the fire suppressing and/or extinguishing composition is safe to deploy around or on humans. In some embodiments, upon being deployed, the fire suppressing and/or extinguishing composition can be inhaled without damage and/or without substantial damage to the lungs. In some embodiments, the fire suppressing and/or extinguishing composition deploys without requiring the explosive forces typical of those used to deploy fluorocarbon- and halon-based compositions. In some embodiments, the fire suppressing and/or extinguishing composition is safe to ingest. In some embodiments, the fire suppressing and/or extinguishing composition remains in an aqueous state as it is being deployed from its storage means in response to a fire event. In some embodiments, the fire suppressing and/or extinguishing composition does not produce any acid gases when exposed to the high heat and temperatures associated with fire events.

In some embodiments, the fire suppressing and/or extinguishing composition instantaneously or substantially instantaneously deploys from a storage means (e.g., a container) typically used in fire suppression systems-including but not limited to fire extinguishers, extinguishers, backpacks, holding tanks, and building and vehicle fire suppression piping systems, without the need for the high forces required by fluorocarbon and halon-based compositions. In some embodiments, the fire suppressing and/or extinguishing composition can be stored for relatively long periods of time and in a wide range of temperatures conditions yet retain fire suppression characteristics and remain in an immediately deployable state.

Any portions of any of the steps, processes, structures, and or devices disclosed or illustrated in one embodiment, flowchart, or example in this disclosure can be combined or used with (or instead of) any other portion of any of the steps, processes, structures, and/or devices disclosed or illustrated in a different embodiment, flowchart, or example. The embodiments and examples described herein are not intended to be discrete and separate from each other. Combinations, variations and other implementations of the disclosed features are within the scope of this disclosure. For the methods disclosed herein, the functions performed in the processes and methods may be implemented in differing order. This disclosure of methods or uses may also include instructing the method or use (for example, in instructions for use).

In addition, where features or aspects of the disclosure are described in terms of Markush groups, those skilled in the art will recognize that the disclosure is also thereby described in terms of any individual member or subgroup members of the Markush group.

With respect to the use of substantially any plural and/or singular terms herein, those having skill in the art can translate from the plural and/or singular terms herein, those having skill in the art can translate from the plural to the singular and/or from the singular to the plural as is appropriate to the context and/or application.

EXAMPLES

Example 1

A fire suppressing and/or extinguishing composition ("E1.1 composition") was prepared by mixing the following ingredients: 34 oz. *Aloe vera* gel (store bought from Aloefarm Texas); 6.4 oz. cocobetaine, 0.17 oz. propylene glycol. The process comprises adding the 34 oz. of *Aloe vera* to a 10 qt commercial mixing bowl and stirring with a commercial mixer (e.g., a KitchenAid mixer). Then, the 0.17 oz. of propylene glycol was added to the mixture with mixing for 2 minutes on low speed. Thereafter, the 6.4 oz. of cocobetaine was added to the mixture with mixing for an additional minute at the lowest speed (to prevent foaming) to generate the composition (i.e. extinguishing agent). A second formulation ("E1.2 Composition") was made using the same procedures and ingredients above but by also adding 2 oz. of glycerin.

The fire extinguishing capabilities of the above compositions were tested on Class A, B, C, D, and K fires. Briefly, in each case, a 2.5-gallon fire extinguisher was loaded with a quart of the extinguishing agent (either the E1.1 Composition or the E1.2 Composition) and 9 quarts of tap water. In each case, the canister was then pressurized with an air compressor to about 120 psi. The fire extinguisher was a smooth bore nozzle; however, any style nozzle can be used with similar and/or the same results.

For the class A fire testing, a regular sized campfire was made using 2 wood pallets broken down into pieces. The fire was set using paper and a torch. Once the wood was totally engulfed in flames, the E1.1 Composition or the E1.2 Composition was sprayed at about a 45° angle from about 4 feet away from the fire. Approximately ⅓ of the canister (about 106 oz.) of fluid was used in each test. The E1.1 and E1.2 composition each extinguished the Class A fire in about 5 seconds.

For class B fire test, 2 quarts of fuel (gasoline) was used. For each test the fuel was set on fire with a torch and allowed to burn for a few minutes until reaching a temperature of about 1500° F. The fire was then sprayed with a fire extinguisher (as prepared above) at about a 45° angle from about 5 feet away. The E1.1 Composition and E1.2 Composition each extinguished the class B fire in about 5 seconds. Using the ignition source (e.g., the torch), attempts were made to reignite the fuel, but the fuel could not be reignited with either composition. After about 10 seconds, the temperature of the fuel dropped to about 51° F. for each of the E1.1 Composition and the E1.2 Composition. It was noted that the fuel was cool to the touch (via the sides of the metal barrel containing the fuel).

For a second type of Class B fire test, 2 quarts of ethanol was ignited in a metal barrel with a torch and let burn for a few minutes until a temperature of about 2000° F. was reached (the upper temperature of the fire was limited by the range of the heat detector used; the temperature was more likely 3400° F.). The fire was then sprayed with a fire extinguisher of the E1.1 Composition or the E1.2 Composition at an angle of about 45° and at about 5 feet away. The fire extinguished in about 5 seconds and the final temperature after about 10 seconds was about 49° F. for each of the E1.1 composition and the E1.2 Composition.

For class D fire tests, a 500 g pile of magnesium shaving was ignited with a torch. The fire was then sprayed with one of the fire extinguishing solutions at about a 45° angle from about 5 feet away. The fire extinguished in about 7 seconds using less than a quart of the E1.1 Composition of the E1.2 composition.

For a second Class D fire, a 500 g magnesium block was ignited and let burn for a few seconds until it was engulfed by fire. The fire was then sprayed with a fire extinguishing solution at about a 45° angle from about 5 feet away. The fire formed a crust on top of the block. The E1.1 composition and E1.2 composition each extinguished the fire on the block in about 5 seconds before penetrating the crust and extinguishing the metal under the crust in about 7 additional seconds. About 2 quarts of each of the E1.1 Composition and the E1.2 Composition was used in each test and the extinguished block was cool to the touch (it could be picked up) after about 10 seconds. In each case, the temperature dropped from an estimated 3100° F. to about 56° F.

For Class K fire, about 1 quart of cooking oil was set on fire with a torch and let burn until the temperature reached about 1000° F. The fire was then sprayed with the E1.1 Composition or the E1.2 Composition at about a 45° angle from about 6 feet away. For each of the E1.1 Composition and the E1.2 Composition, the fire extinguished in about 4 seconds using about 16 ounces of the E1.1 Composition or the E1.2 Composition and could not be reignited. The temperature reduced to about 85° F. in less than 10 s in each case.

For a second test, 250 g of lard was ignited and allowed to burn until reaching a temperature above 1000° F. The fire was then sprayed with a fire extinguishing solution at about a 45° angle from about 6 feet away. For each of the E1.1 Composition and E1.2 Composition, the fire extinguished in about 6 seconds using about 16 ounces of the formulation and could not be reignited. The temperature of the lard dropped to about 184° F. after 15 seconds in each case.

Table 1 below summarizes the results of the testing for each of the E1.1 Composition and the E1.2 Composition.

While the invention herein disclosed has been described by means of specific embodiments and applications thereof, numerous modifications and variations could be made thereto by those skilled in the art without departing from the scope of the invention set forth in the claims.

TABLE 1

| Fire Class | Fuel Source | Time to Extinguish |
|---|---|---|
| Class A | Wood Planks | 5 s |
| Class B | Gasoline (2 quarts) | 5 s |
| Class B | Ethanol (2 quarts) | 5 s |
| Class D | Magnesium shavings (500 g) | 7 s |
| Class D | Magnesium Block | 11 s |
| Class K | Cooking Oil (1 quart) | 4 s |
| Class K | Lard (250 g) | 6 s |

This test demonstrates the ability to the above compositions to extinguish multiple Class types in short periods of time.

Example 2

Several fire extinguishing formulations were prepared using similar procedures to those described in Example 1. Briefly, 60 oz of *Aloe vera* juice (*Aloe* farm) was placed in the mixer. Then, 0.3 oz of Xanthan gum was sprinkled into the *Aloe vera* and allowed to hydrate for a few minutes. The mixture was then mixed at medium speed until the preparation thickens and xanthan gum was well dissolved (about 5 minutes). Thereafter, 4.8 oz of 1,3-propanediol was added along with 12 oz of cocobetaine and 0.42 oz of triethanolamine. The formulation was mixed on the lowest speed for about 2 minutes. The low mixing rate aided in avoiding foaming. As shown in table 2, the compositions contained different concentrations of ingredients.

The specific heat capacity of each of these formulations was then calculated using the following formula:

$$s = \frac{q}{m * \Delta T}$$

Where s is the specific heat capacity, q is the heat, m is the mass and ΔT is the change in temperature.

To test the heat capacity, 200 g of each of the formulation was placed in an insulated container to reduce heat transfer to the environment (e.g., by evaporation). The formulation was heated using a power supply and a 5×10 Ohm capacitor (the resistor was placed into the cup so that the resistor was submerged). About 7 volts was delivered using the triple linear DC power supply (0-30 V at 5 amps). With a temperature probe and a timer, temperature changes were noted every 2 minutes, until the temperature was at least about 5 degrees over the initial temperature (e.g., at least 6 to 7 degrees difference from the initial temperature (i.e. ambient temperature)). The specific heat of each formulation is also shown in Table 2.

TABLE 2

| Sample | Ingredients | Specific Heat Capacity |
|---|---|---|
| Water (control) | N/R | 4.18 |
| Aloe Juice | Aloe juice from Aloe Farm | 2.92 |
| Formulation 1: | Aloe Juice 60 oz.<br>Xanthan gum 0.3 oz.<br>Cocobetaine 12 oz.<br>Propanediol 4.8 oz.<br>Triethanolamine 0.42 oz. | 11.89 |
| Formulation 2: | Aloe Vera (aloefarm) 8 oz.<br>Carbomer 1.25 oz.<br>Cocobetaine 1.5 oz.<br>Propanediol (1,3) 4.8 oz.<br>Triethanolamine 0.42 oz. | 6.27 |
| Formulation 3: | Aloe Vera (aloefarm) 34 oz.<br>Guar Gum 0.2 oz.<br>Cocobetaine 6.4 oz.<br>Propanediol (1,3) 1.6 oz.<br>Triethanolamine 0.21 oz. | 8.84 |
| Formulation 4: | Water 60 oz.<br>BiAloe (powder) 0.102 oz.<br>Xanthan Gum 0.3 oz.<br>Cocobetaine 12 oz.<br>Propanediol 4.8 oz.<br>Triethanolamine 0.42 oz. | 13.69 |
| Formulation 5: | Water 60 oz.<br>Aloe powder 1:100 0.5 oz<br>Hydroxypropyl methylcellulose 0.3 oz.<br>Cocobetaine 12 oz.<br>Propanediol (1,3) 4.8 oz.<br>pH adjusted to between 6.5 and 7.0 by adding TEA | 6.72 |

Prior to testing the formulation 1 from above, 1 quart of the formulation was mixed with 9 quarts of tap water (a 10% by volume dilution). The extinguisher was loaded with the formulation and pressurized at 120 psi using an air compressor. The extinguishing ability of formulation 1 was tested on a Class D fire. A 500 g solid piece of aluminum (not shavings) was ignited using a torch. The extinguishing formulation was sprayed on the magnesium block a about 45° angle using a smooth bore nozzle, first with a light pressure to extinguish the first layer on fire (on top of the crust created by the magnesium block burning) for about 5 seconds and then with a stronger pressure spray to penetrate the crust and extinguish the fire underneath the crust for another 10 seconds before complete extinction (e.g., with no or very little reaction). The extinguished magnesium could be picked up within the next 10 seconds of extinguishing.

The *Aloe* Juice cooled the magnesium enough to put the fire out, but the second embodiments (*Aloe*+Xanthan gum) worked much faster.

It was concluded that Formulation 1, *Aloe* and the thickening agent (*Aloe* and xanthan gum which forms the gel) works synergistically to cool the magnesium block. The magnesium was instantly cool to the touch (testing by picking up the piece of magnesium with hands). The magnesium was also still a solid piece.

Ethanol (a class B fire agent) was then tested. Briefly, 2 quarts of ethanol was placed in a metal container and lit on fire with a torch. The fire was allowed to burn until reaching over 2000° F. At about a 45° angle, the formulation was then sprayed at the base of the fire. The formulation extinguished the fire in less than 3 seconds with a temperature dropping from over 2000° F. to about 49° F. in less than 10 seconds. It was noted that the oil on the top of the solution was encapsulated. No matter how much it was attempted, the ethanol would not reignite, and it could be touched with bare hands (bare fingers could be submerged in the ethanol). Ethanol is very hard to extinguish due to its high volatility (showing the high efficacy of the formulation). Tests were also performed on 2 quarts of Isopropyl Alcohol as well as 2 quarts of dimethyl ketone.

Upon discharged from the fire extinguisher, the compound produced stable foam with a very slow drainage. Without being bound to a mechanism, it is believed that the foam blankets the fuel surface smothering the fire, separating the flames and ignition source from the fuel surface by encapsulation. It is also believed that the formulation cools the fuel and suppresses the release of flammable vapors that can mix with the air. It was noted that Formulation 1 had high thermal resistance, with a very good viscosity. It was noted that competitor products showed breakage and very poor stability of foam, yet the bubbles created with the disclosed formulation were very strong and the foam had a very slow drainage. It is noted that the foam viscosity doesn't seem to decrease with the foam temperature. When heated by the radiation of the fire, the foam doesn't seem to flow any faster than a cold foam.

The formulation had no slippery feeling and provided a good seal against fuel vapors.

Xanthan gum was selected as a polymeric material because of its ability as a polysaccharide to be water soluble and swellable. It has very good synergy with the active ingredient found in *Aloe vera* (Acemannan), is thermal resistant, pH change, and high salt content (sea water for example). The xanthan gum aids in causing the foam to form a gelatin when it comes in contact with a polar hydrophilic liquid (alcohols, ketones, etc.) Therefore, it acts as a barrier towards the fuel vapors and liquids, binds with the surfactant and prevents the foam blanket from breaking.

Example 3

In the following experiments, different ingredients were tested. One or more embodiments of the composition comprises a temperature suppressing agent and/or water delivery agent. In some embodiments, the temperature suppressing agent and or water delivering agent is *Aloe vera*. Several tests were performed with different *Aloe vera* juice suppliers (e.g., *Aloe vera* gel, *Aloe* Farms *Aloe vera* gel, BiAloe® (i.e. freeze dried powder from organic *Aloe barbadensis* Miller inner leaf) from Loraland Laboratories, bioactive *Aloe* powder from Aloecorp freeze dried powder 100:1, freeze dried powder 200×, gel freeze dried powders, gel spray dried powders, Naturamanan *Aloe* powder from Naturaloe Costa Rica, *Aloe* powder Aloin from Sost Biotech).

One of the main components of *Aloe vera* are polysaccharides. For that reason, one polysaccharide of *Aloe vera* was selected for testing as a temperature suppressing agent and/or water delivery agent: acemannan. It was found that, in some embodiments, acemannan could be used in addition to, or instead of *Aloe vera*. In a commercial mixer, 8 oz of deionized water was added, followed by 0.028 oz of BiAloe® powder. This viscous liquid was mixed on medium speed for a few minutes. To the liquid was added 0.08 oz of hyaluronic acid (HA) which was allowed to hydrate for a minute and then was mixed on medium speed until total dissolution and thickening occurred. Thereafter, 0.04 oz of xanthan gum was added and mixed on medium speed until total dissolution and thickening was observed. Then, 0.32 oz of propanediol (1,3) and 0.35 oz of cocobetaine was added and the liquid was mixed on slow for less than a minute (to avoid foaming).

To test the formulation, it was applied to a piece of plywood (quarter inch piece of untreated pine quarter inch thick 8 inches long). The formulation was applied in a layer about 3 mm thick on half of the piece of wood. Then a MAPP gas torch (which burns at 3670° F.) was ignited and the flame of the torch was moved back-and-forth motion over the treated wood placed at about 45° angle. The untreated part immediately discolored and ignited within 15 seconds. The gelled part stayed stable for over a minute and started to lift up over the wood to create a thermal barrier. The gel started to discolor a little bit after a couple of minutes, but the wood was not touched. The gel was wiped clean from the wood immediately and the wood remained intact and cool to the touch.

A competitor product (commercial formulation 1) was tested in the same manner and the test specimen ignited within 3 minutes (indicating the extinguishing agent itself was flammable under the tested conditions).

As stated above, several types of *Aloe vera* were tested, to select the best type of *Aloe*. To test the temperature suppression capabilities of the composition disclosed herein, 2 oz of each formulation was placed on top of a metal table (steal) as a layer. A thermocouple was placed right underneath the concentrate (to measure the temperature right underneath the gel). Each concentrate was then heated with a MAPP blowtorch at 3800° F. without moving the torch. The temperature and time are recorded in Table 3 below.

TABLE 3

| Formulation A/Aloe type<br>Water: 4 oz.<br>Aloe Vera: 0.04 oz<br>Xanthan Gum 0.1 | Time (minutes) from room temperature to when Temperature spiked over 300° F. |
|---|---|
| BiAloe ® powder (0.014 oz) | 14.57 |
| Aloe Natural leaf spray dried powder | 6.34 |
| Aloe Natural Gel freeze dried powder | 7.27 |
| Sost Biotech powder Aloin | 7.17 |
| Sost Aloe freeze dried 100:1 | 9.30 |
| Aloe Corp Gel matrix 200x | 7.43 |
| Aloe Corp Activaloe SD 100x | 8.30 |
| Activaloe Gel SD 200x | 9.14 |
| Commercial | 3.12 |

BiAloe® powder was selected for its performances. It is noted that BiAloe® contains the most Acemannan.

Some embodiments were prepared using hyaluronic acid (HA). Hyaluronic acid is a large polysaccharide that occurs in various tissues (skin, synovial fluid of joint, connective tissues) and is responsible for tissue hydration and lubrication. The HA used had a molecular weight of 800 to 1200 kDa.

In some testing, it was determined that 1,3 propanediol had emollient, humectant, preservative boosting properties as well as lowering the freezing temperature of the composition. It is also 100% safe and biodegradable, Thus, in some embodiments, 1,3, propanediol was selected for use in the fire extinguishing composition. It is also believed Propanediol (1,3) has an effect on the Hydrophile-lipophile balance of the bio-surfactant, increasing its value, thus helping in the stability of the emulsion, stability of the foam, and increasing the micelle formation, therefore the encapsulation of the oil and gas at air/liquid interface.

In some testing, it was determined that a carbomer could be used as a thickener. Xanthan gum (which is another polysaccharide) was also used as a thickener. It showed good performance in extinguishing fuel fires and was fully biodegradable.

Example 4

Several experiments were performed using a formulation comprising BiAloe powder. To prepare the *Aloe* powder formulation, 60 oz of distilled water was placed in a mixing bowl and 0.0228 oz of BiAloe powder were sprinkled in it with slow mixing until full dissolution. Then 0.3 oz of xanthan gum (prehydrated for easy mixing) was sprinkled in the solution. The mixture was mixed for about 10 minutes until thickening. Then 12 oz of cocobetaine was added and mixed. Then 4.8 oz of propanediol 1,3 was added and mixed. Then 0.42 oz of triethanolamine was added and mixed (to adjust the pH to 7). The formulation (equivalent to "formulation 1" from Table 2) is then ready to use as a 10% by volume dilution in tap water.

The extinguishing agent was placed in a fire extinguisher and pressurized (as described elsewhere herein). As shown in Table 4, several different fire types were tested against the formulation (using the same general procedures described in Example 1).

TABLE 4

| Material | Initial Temperature | Time to extinguish | Temperature after Extinguish |
|---|---|---|---|
| 500 g Mg Block | 3100° F. | 5 s | 56° F. |
| 2 qt. Fuel (gasoil) | 495° F. | 3 s | 51° F. |
| 2 qt Ethanol | 695° F. | 3 s | 49° F. |
| 2 qt. Acetone | 895° F. | 4 s | 62° F. |
| 2 wood logs | 575° F. | 2 s | 52° F. |
| 500 g charcoal | 678° F. | 2 s | 51° F. |

As shown above, each fire was extinguished in a matter of seconds using the tested composition. The previously burning material also rapidly cooled to below room temperature after the fire was extinguished.

Example 5

The fire extinguishing capabilities of several commercially available compositions (shown FIG. 1) were tested on Class A, B, C, D and K fires against a test formulation as described above. Briefly, for each extinguishing composition, a 2.5 Buckeye gallon fire extinguisher was loaded with the extinguishing agent according to manufacturer specifications. The mix ratios of the commercial compositions included 3-6 and 10% volumes diluted in water (as shown in FIG. 1). The test embodiment labeled "APEX-V" in FIG. 1 was prepared as described in Example 4. Each canister was then pressurized with an air compressor to about 120 psi. The fire extinguisher used in each test was a smooth bore nozzle. The testing performed outside at a temperature of about 82° F. with a relative humidity of 20% and calm winds.

For Class A fires, three different materials were set on fire and used to test each formulation: wood, paper, and plastics. For example, a fire using 2 wood pallets broken down into pieces was used for the wood fire. The fire was set using paper and a torch. Once the wood was totally engulfed in flames, a fire extinguishing composition was sprayed from the extinguisher at the burning material. At a 45° angle from about 5 feet away.

For class B fires, the following materials were each set on fire and used to test each formulation separately: oil, gas, diesel, jet fuel, hydraulic oil, ethanol, acetone, and brake kleen. For example, 2 quarts of oil in a metal container was set on fire using a torch. After about 30 seconds, the oil was totally engulfed in flames. At that time, a fire extinguishing composition was sprayed from the extinguisher at the burning material at a 45° angle from about 5 feet away. The results were noted. FIG. 1 shows the results of the test for each composition.

For Class C fires, an electrical fire was started and used to test each formulation separately. Briefly, the fire was started using a 400 amp breaker and a 200 foot length of balled 6 gauge wire. The wire was shorted, igniting it. At that time, a fire extinguishing was sprayed from the extinguisher at the burning material at a 45° angle from about 5 feet away. FIG. 1 shows the results of the test for each composition. It is noted that each of the formulation were diluted with deionized water.

For class D fires, 18 ounces blocks of magnesium were ignited using a torch. Once the block was completely engulfed in flames, a fire extinguishing composition was sprayed from the extinguisher at the burning material at a 45° angle from about 5 feet away. As shown in FIG. 1, only APEX-V test solution was able to extinguish to extinguish the Class D fire.

For the Class D fire, a 10% dilution with the APEX-V composition effectively extinguished the block of magnesium in 10 seconds with massive cooling allowing the block to be picked up immediately after it was extinguished. The only observation of damage to magnesium block was the separation of the crust from the main block. Other than that, there was no explosive reaction during the extinguishing of the magnesium. The material after extinguishing was a silver-colored disc. (see FIG. 2A). It was concluded that APEX-V put the magnesium fire out initially and left the magnesium intact and unreacted.

Figure 2B:
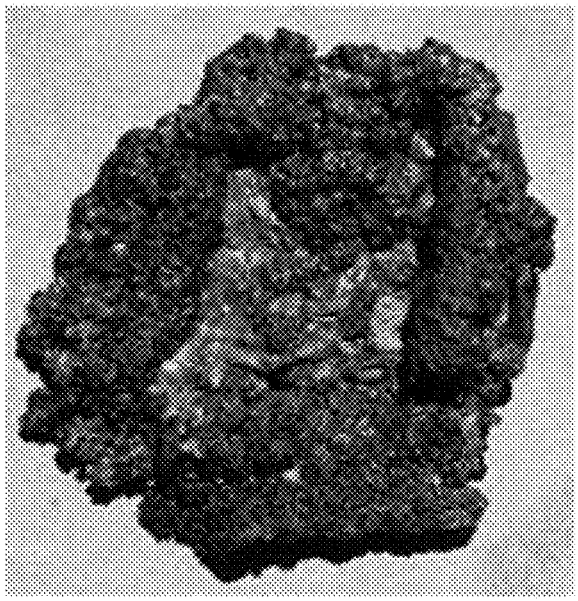

The commercial Formulation 12 manufacturers claim that the composition is suitable for Class A, B and D fires. While using this formulation on class D fires, it was noted that the composition had no effect on putting out the magnesium fire when a block weighing 10 ounces was used. Commercial Formulation 12 composition sat on top of the magnesium as the magnesium continued to burn. It was noted that the composition didn't have an ill effect (as far as causing a reaction like water does which causes a large hot burning fire). Burning the magnesium and trying to suppress it with Commercial Formulation 12 left behind a coal type pile that was hard to the touch (see FIG. 2B). It is also noted that Commercial Formulation 12 is not listed with UL.

Figure 2C:
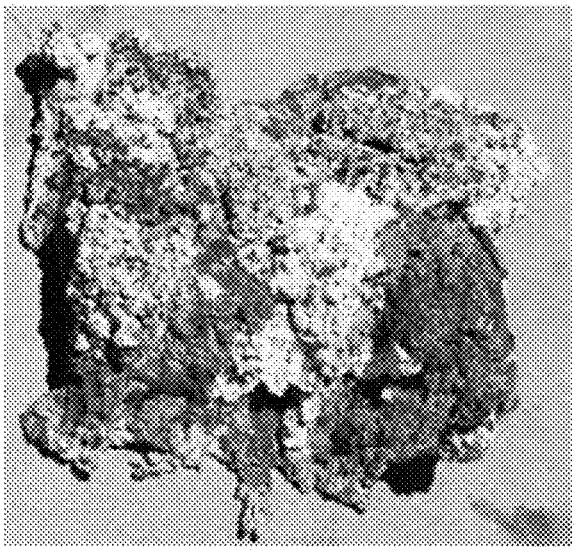

For commercial Formulation 13, the manufacturers claim that it is suitable for Class D fires though it is UL listed for Class A and B only. During the Class D test procedures described above, a 3% mix of Commercial Formulation 13 was used suggested by the manufacturers. During attempted extinguishing, a large explosive reaction (like spraying pure water on magnesium) occurred. To rule out a concentration as the results of this reaction, the dilution was increased to 10%, but the formulation yielded the same results. Burning the magnesium and trying to suppress it with Commercial Formulation 13 left behind a coal type pile that was hard to the touch. (see FIG. 2C).

Class K fire was tested using animal lard on the first test and vegetable oil on the second test. Both were heated up to their flash point and allowed to burn for two minutes before the use of APEX-V, thus allowing for full ignition of the oils and fats with a temperature of about 1100° F. The test results are shown in FIG. 1. For the APEX-V solution, both materials were extinguished with minimal product volume in less than 8 s with a rapid cooling effect that took the temperature from 1100° F. to 64° F. at the end of the eight seconds. There was no reignition no matter how many times we tried due to encapsulation. We could observe a gel layer formed on top of the oils.

For a stability test, the compositions were placed on a wood board. The treated wood was then heated using a torch for 15 seconds. The 15 seconds burn test with superheat at 3623° F. (as shown in FIG. 1), demonstrated APEX-V does not burn-off or boils away and protects the wood from burning. The APEX-V compound has an MSDS of 0-0-0 and is aquatic life friendly.

Unlike the APEX-V composition, during the 15 seconds burn test using superheat a Competitor product (Commercial Formulation 13) composition boils off and allows burning of the wood on which it was placed. The 15 second burn test with superheat, using Commercial Formulation 12 demonstrated that the competition boils-off and allowed burning of the wood on which it was placed.

The Mix Reaction data was gathered by mixing each of the commercial formulations with the APEX-V Formulation. A mix reaction (gelation) was only noted with Commercial Formulation 1.

Example 6

Several experiments were performed using a formulation comprising BiAloe® powder. To prepare the formulations, 93.16 oz of deionized ("DI") water was combined with 0.315 oz of BiAloe® powder. BiAloe® powder was sprinkled into the water with slow mixing in the mixing bowl until total dissolution to create a reconstituted BiAloe solution. Then, in a different container, 0.41 oz of xanthan gum was mixed with 16.44 oz of 1,3 propanediol. The reconstituted BiAloe and the xanthan gum/1,3-propanediol was then combined and stirred. The combination was slowly mixed for about 10 minutes until thickening. Thereafter, 16.44 oz of coco betaine and 1.23 oz of phenoxyethanol was added and mixed. Then Triethanolamine was added to adjust the pH of the formulation to about 6.5. It was noted that pre-mixing the gum and the propanediol advantageously led to less bubble formation in the composition during mixing. The resulting formulation (hereafter the "APEX-V 1 Concentrate") was then ready to use as an extinguishing agent as a concentrate or as a diluted solution. Table 5 shows the proportions of ingredients in tabular form.

TABLE 5

| Sample | Ingredients | Wt % |
|---|---|---|
| APEX-V | Full Concentration | — |
| 1 Concentrate | Deionized water 93.16 oz | 72.8 |
| | BiAloe 0.315 oz | 0.246 |
| | Xanthan Gum 0.41 oz | 0.320 |
| | Cocobetaine 16.44 oz | 12.8 |
| | 1,3 Propanediol 16.44 oz | 12.8 |
| | Phenoxyethanol 1.23 oz | 0.961 |
| | pH adjusted to 6.5 by adding TEA | ~ |

For the purpose of the following testing, dilute solutions were prepared using the APEX-V 1 Concentrate. The density of the APEX-V 1 Concentrate was determined to be about 8.8 pounds per gallon (with a specific gravity of 1.04). The density of water is 8.345 pounds per gallon. The APEX-V 1 Concentrate was diluted to a 6 vol % solution by adding 9.4 quarts of deionized water to 0.6 quarts of APEX-V 1 Concentrate. The 6 vol % solution (hereafter APEX-V 1 ExptSamp 1) was set aside for testing. To prepare an additional test solution, The APEX-V 1 Concentrate was diluted to a 0.25 vol % solution by adding 9.975 quarts of water to 0.025 quarts of APEX-V 1 Concentrate. The 0.25 vol % solution (hereafter APEX-V ExptSamp 2) was set aside for later testing. Table 6 shows the proportions of ingredients in tabular form.

TABLE 6

| | | |
|---|---|---|
| APEX-V | 6% by volume dilution | 6.3 wt % |
| ExptSamp 1 | Deionized water 93.16 oz | 4.59 wt % |
| | BiAloe 0.315 oz | 0.0155 wt % |
| | Xanthan 0.41 oz | 0.0202 wt % |
| | Cocobetaine 16.44 oz | 0.806 wt % |
| | 1,3 Propanediol 16.44 oz | 0.806 wt % |
| | Phenoxyethanol 1.23 oz | 0.0605 wt % |
| | pH adjusted to 6.5 by adding TEA | |
| APEX-V | 0.25% by volume dilution | 0.263 wt % |
| ExptSamp 2 | Deionized water 93.16 oz | 0.191 wt % |
| | BiAloe 0.315 oz | 0.000647 wt % |
| | Xanthan Gum 0.41 oz | 0.000842 wt % |
| | Cocobetaine 16.44 oz | 0.0337 wt % |
| | 1,3 Propanediol 16.44 oz | 0.0337 wt % |
| | Phenoxyethanol 1.23 oz | 0.00252 wt % |
| | pH adjusted to 6.5 by adding TEA | — |

The fire extinguishing capabilities of APEX-V ExptSamp 1 and APEX-V ExptSamp 2 was tested on Class A fires, Class B fires, Class D fires, and Class K fires. Briefly, a 2.5 gallon fire extinguisher was loaded with either APEX-V ExptSamp 1 or APEX-V ExptSamp 2. The canister was then pressurized with an air compressor to about 120 psi.

The Class A fire was conducted at UL (Underwriting Laboratories) on a crib Fire. The wood Crib consists of 18 layers of 8 evenly spaced 38 by 38 by 735 mm trade size (2 by 2 by 29 inches) kiln dried spruce or fir lumber with alternate layers placed at right angles to one another and the outside edges of the crib stapled or nailed together. Two Class A tests were conducted. In the first test, the wood crib was placed on an angle iron frame, mounted on a weighing platform at a height of 400 mm (16 inches) above the floor. A steel square pan was used to start the fire. The pan was ignited and placed symmetrically under the vertical axis of each wood crib. Commercial grade Heptane was placed in the pan and used for ignition. A 2.5 gallons buckeye fire extinguisher is prepared with 3% solution in water (APEX-V ExptSamp 3) and pressurized at 100 psi. The crib is ignited with the heptane fuel until burn out of the heptane. The crib is thus well engulfed by the flames. The solution (i.e., APEX-V ExptSamp 3) was then applied with the fire extinguisher. The result was that the fire was controlled in about 11 seconds with no reignition.

The second test was performed in a closed container to recreate a flashover. The fire was started in the back of the container, and was allowed to grow, heating up the inside of the container and releasing hot gases. The hot gases collect near the top of the container until the energy starts to transfer to plywood sheets inside the container. The inside of the container was engulfed in flames in a matter of minutes. A 10% APEX-V solution was prepared (APEX-V ExptSamp 4) prepared using tap water was placed in a 2.5 gallons buckeye fire extinguisher and pressurized at 120 psi. A smooth bore nozzle was used. In this configuration, the fire was extinguished in 6 seconds and no reignition occurred.

For Class B fires, a UL (Underwriters Laboratories, Inc.) Class B fire test was performed (similar to the testing described above). The results were noted. Both APEX-V ExptSamp 1 or APEX-V ExptSamp 2 extinguish Class B fires in the UL testing. The APEX-V ExptSamp 1 extinguished the fire within one minute 13 seconds. APEX-V ExptSamp 2 extinguished the fire within 5 minutes. The test was conducted in a 50 square foot draft free room, using a steel pan, square in shape, and 305 mm in depth. The fuel test is commercial grade heptane, which reproduces a deep seated fire. The wetting agent was prepared at 6% solution. The fuel in the pan is ignited and allowed to free burn for about 60 s before attacking the fire. The flow rate was 10 gallons per minute set at 5 minutes maximum delivery time, with the nozzle fixed in position at an angle above the horizontal in order to direct the discharge across the pan on to the backboard. The fire was totally extinguished in about 75 seconds.

The same test was done at 0.25% dilution and the fire was extinguished in 5 minutes.

Figure 3A:
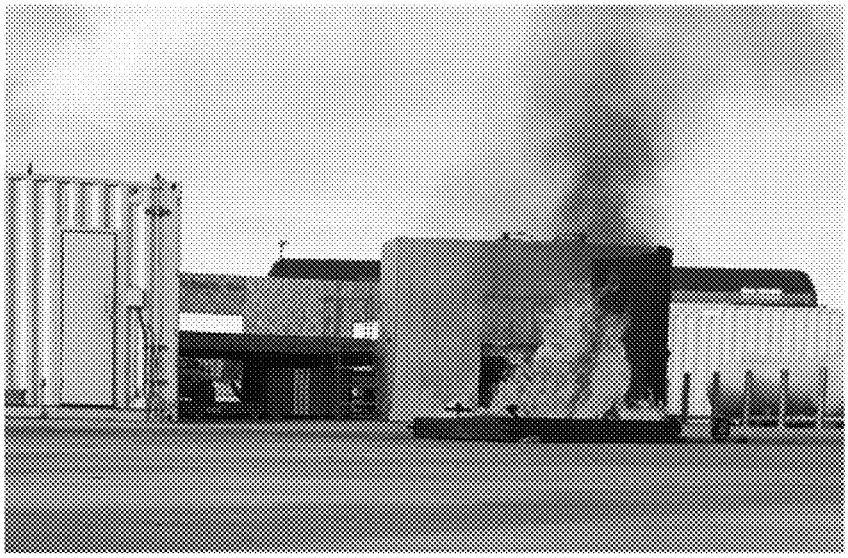
FIGS. 3A-C show the stage and results of application of an embodiment of an extinguishing composition on a diesel/fuel fire.
Figure 3B:
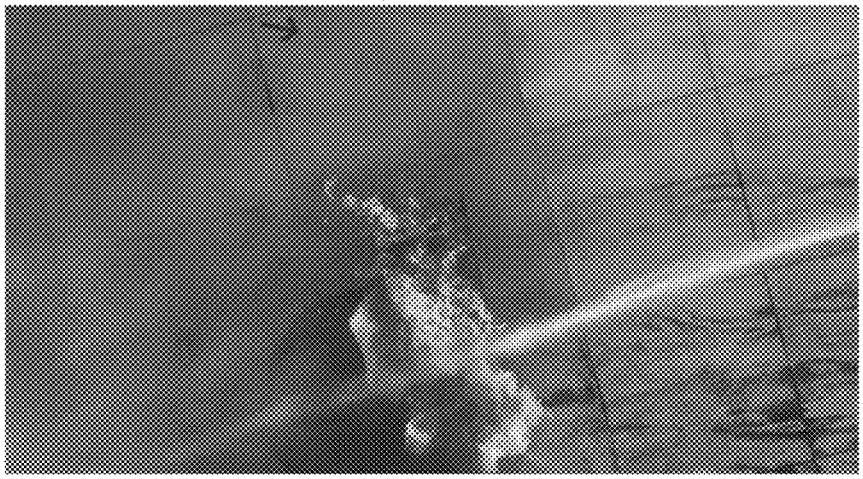
Figure 3C:
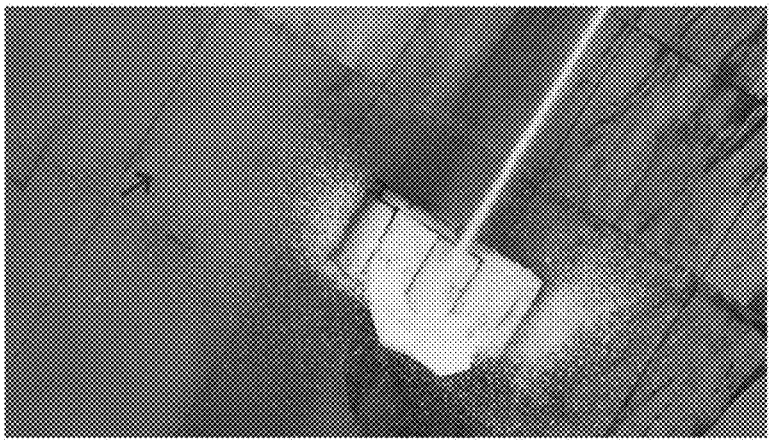

Another test was performed on diesel/fuel, floating on water in a 40 square feet metal pan, to reproduce again a deep seated fire. The flow rate was 95 gallons per minute, set at 6% dilution for the wetting agent (APEX-V ExptSamp 1), The fire was extinguished in 5 seconds, with no reignition, no matter how many attempts to force reignition, thus confirming total encapsulation. The results are shown in FIG. 3A-C.

For class C fires, an electrical fire was started and used to test each formulation separately. Briefly, the fire was started using a 400 amp breaker and a 200 feet length of balled gauge wire. The wire was shorted, thereby igniting it. At that time, a fire extinguishing composition was sprayed from the extinguisher at the burning material at a 45° angle from about 5 feet away. The APEX-V ExptSamp 1 successfully extinguished the fire and no charge back was noted on the open circuit fire.

Figure 4A:
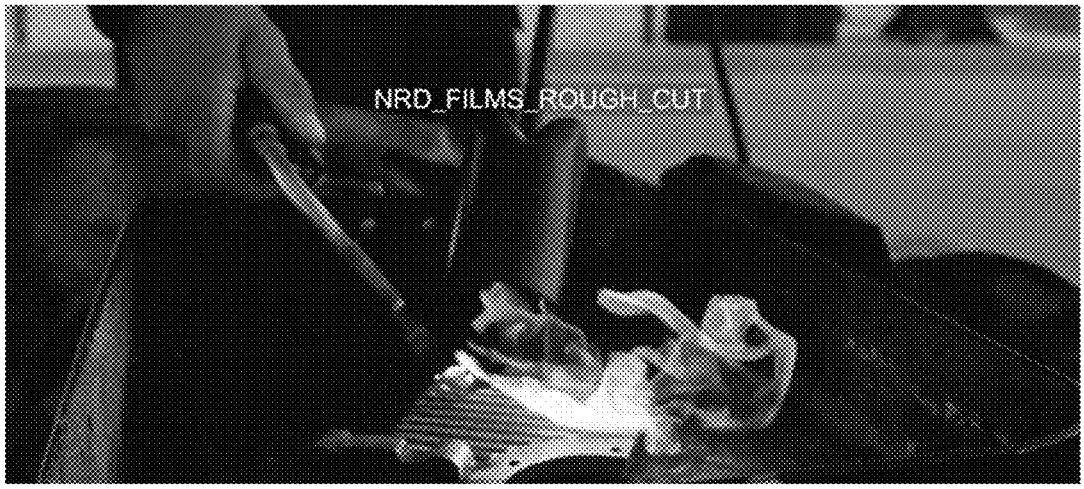
FIGS. 4A-C show the stage and results of application of an embodiment of an extinguishing composition on a magnesium metal fire.
Figure 4B:
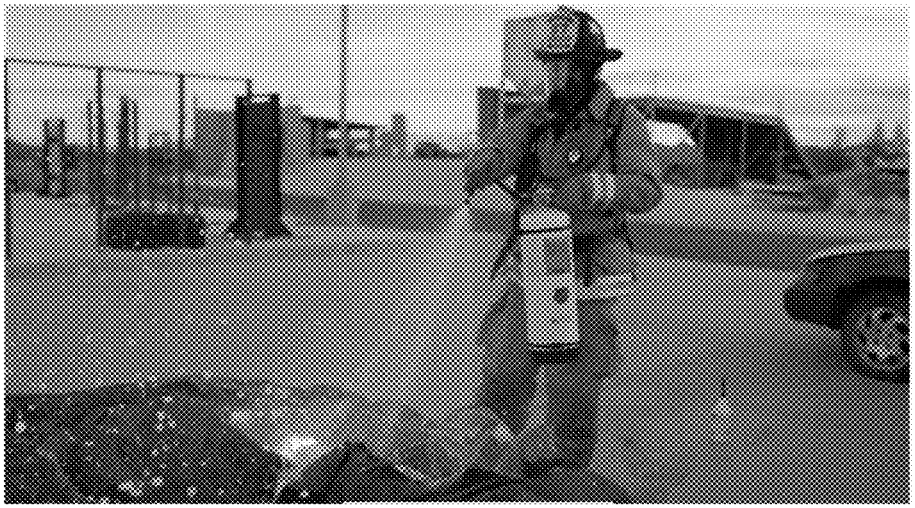
Figure 4C:
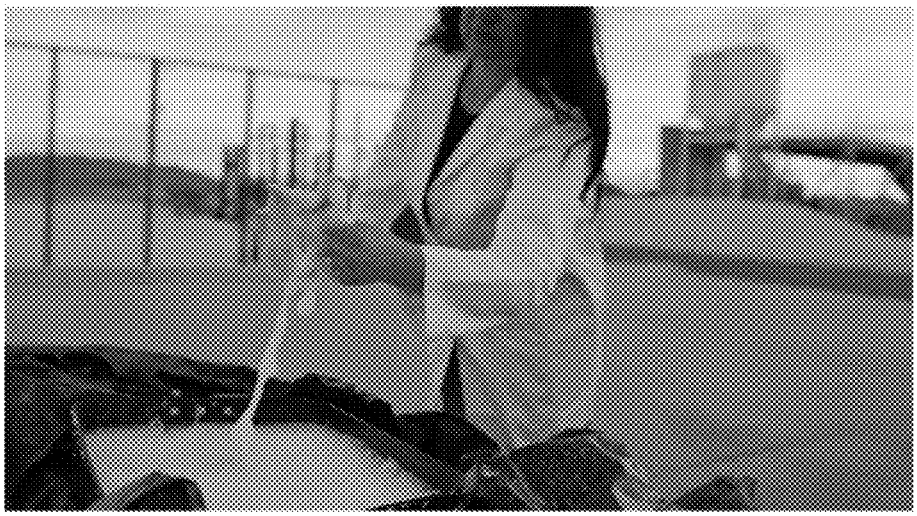

For a class D fire: a 500 g piece of magnesium was ignited with a torch and allowed to be well inflamed in a few seconds (FIG. 4A). A 2.5 gallons buckeye fire extinguisher was prepared with APEX-V ExptSamp 4 and tap water and pressurized at 120 psi. A smooth bore nozzle was used. The solution was then applied to the magnesium fire, and it extinguished it in less than 6 seconds (FIG. 4B). The piece of magnesium was then immediately picked up with bare hands (FIG. 4C).

For Class K fire: a kitchen fire simulation was performed with a turkey fryer by placing a propane tabletop stove on a metal table inside a semi-enclosed room. The turkey fryer was filled with vegetable oil and heated up for 30 minutes until it reached ignition point. The oil ignited on fire and left to burn for one minute. A prior art fire suppression system on the ceiling had been previously installed directly on top of the kitchen table. When the suppressing agent was delivered at 400 psi pressure onto the engulfed cooking oil it caused a total displacement of the oil out of the fryer and engulfing the whole kitchen.

Subsequently, 2 buckeye 2.5 gallons fire extinguishers filled with APEX-V ExptSamp 4 and tap water, pressurized at 120 psi, using a smooth bore nozzle was then applied onto the fire. The engulfed fire was extinguished with no reignition in less than a minute with the second fire extinguisher still about 50% remaining.

In a test that involves most class of fire, a car fire was recreated by first pouring 10 gallons of diesel fuel inside of a car to saturate the seats. The fire was started and left to burn for a few minutes until it was fully engulfed. The APEX-V ExptSamp 1 solution was applied from an induction system in a fire truck set at 95 gallons per minute at a 6% dilution.

The fire was out in less than 30 seconds. No toxic fumes were visually noticeable, just water vapor dissipating in seconds, demonstrating the level of encapsulation of the solution applied.

The APEX-V Solution concentrate formulation was tested in two real life fire situations. The first one was on a golf course, where big piles of debris had been burning for 2 days, creating a deep hot coal fire. Two firefighting crews had been working on it for two days and two helicopter loads each of 1000 gallons of water had been dropped on the piles with no effect. Using APEX-V ExptSamp 1 solution out of a type 6 truck, a firefighter extinguished the two piles in less than 3 hours using 800 gallons of water and 17 gallons of solution.

The second fire was the Lilac fire in San Diego, for structure protection on a house during a firestorm. The fire was raging coming from three sides towards the house during a fire storm.

APEX-V ExptSamp 1 and APEX-V Gel (discussed below) were used on the house out of a type 6 truck. The house was 100% saved with absolutely no burn mark anywhere on the house, or on the deck. Five (5) gallons of APEX-V ExptSamp 1 solution and 3 gallons of APEX-V Gel were used with 100 gallons of water.

In the suppressant configuration (e.g., the dilute formulation), the addition of surfactant helps the medium to reduce surface tension. Polysaccharides can act as a protective colloid and can also provide transport channel for oil and gas. As a result, it is believed that the surface molecules are attracted toward the interior of the composition, lowering the contact angle, which enables liquid and gas to spread over each other and make the phases mutually miscible. In some embodiments, polysaccharides (such as those in *Aloe vera* and xanthan gum) are thought to interface with water and 1,3 propanediol and that the surfactant acts as an absorbent compound. The interface is then a dynamic site of competing forces. Without being bound to a particular mechanism, it is thought that, as adsorbate, the composition undergoes a non-equilibrium multilayer accumulation of like macromolecules, forming a film with low permeability to oxygen and very strong encapsulating properties by entrapping any dissolved or emulsified solutes (gas and liquids) blocking them from the fuel source.

Several formulations were also tested by increasing the percentage (%) of the surfactant. It is noted that increasing the surfactant concentration in the APEX-V concentrate, will increase the amount of foam created. However, the foam is very unstable, with large bubbles, and dissipates rapidly, comparable to foam made with only water/surfactant complex, allowing quick reignition for example in a Class B fire. It is believed that the Acemannan/polysaccharides/surfactant complex at high concentrations of surfactant is very unstable and the surfactant imposes its foaming behavior.

The APEX-V concentrate passed UL stability and separation testing at 0° C. and 50° C. with no separation for 30 days.

Multiple formulations were tested, varying concentrations and nature of polysaccharides.

Viscosities of the different formulations were tested and compared over a range of shear rates.

At low shear rates, solutions with xanthan gum have a much higher viscosity (about 15 times the viscosity of guar gum and significantly more viscosity than carboxymethylcellulose (CMC).

This explains xanthan's superior performance in stabilizing suspensions. The polysaccharides main function is to suspend and stabilize the dispersion of solids, immiscible liquids and gas in aqueous systems, thus the encapsulation of the fuel at the liquid/air interface.

When high shear is applied, the viscosity of the solution with xanthan solution drops, which gives those formulations using xanthan easier to pump, or spray.

In the presence of most organic acids, the stability of xanthan gum is also excellent (e.g., acetic acid, tartaric acid, sulfuric acid, phosphorus acid, citric acid, hydrochloric acid).

Xanthan gum is also compatible with a variety of basic compounds (for example, 10% sodium hydroxide, 5% sodium carbonate, 5% sodium phosphate, 5% sodium metasilicate, and concentrated ammonium hydroxide).

Xanthan gum solutions are stable in the presence of most salts. In many cases, compatibility is limited only by the solubility of the salt (Ammonium chloride, Barium chloride, Calcium chloride Cupric chloride, Magnesium chloride, Potassium chloride, Sodium chloride, Zinc chloride Diammonium phosphate, Disodium hydrogen phosphate, Sodium bisulfite, Sodium carbonate Sodium citrate, Sodium sulfate, Sodium tetraborate).

A synergistic interaction occurs between xanthan gum and galactomannans such as acemannan. Cellulose can cause depolymerization of galactomannans such as acemannan.

The extinguishing capabilities of multiple formulations were tested varying concentrations and nature of the individual constituents were tested on Class B fires using Sea water to test the resistance and performance of the formulations in a high salt concentration. For the application testing of each formulation, a 10% solution containing each of the formulations were prepared with Sea water in a 2.5 gallon, buckeye fire extinguisher. Prior to fire testing, the below mentioned formulations were prepared (using procedures as disclosed elsewhere herein).

Formulation A:

| Component | Wt/Gallon (oz) | Wt % |
|---|---|---|
| BiAloe Powder | 0.32 | 0.25 |
| Xanthan | 0.41 | 0.32 |
| cocobetaine | 16.44 | 12.84 |
| Propanediol | 16.44 | 12.84 |
| Phenoxyethanol | 1.23 | 0.96 |
| DI Water | 93.16 | 72.78 |
| Total | 128 | 100 |

Formulation B1

| Component | Wt/Gallon (oz) | Wt % |
|---|---|---|
| BiAloe Powder | 0.32 | 0.25 |
| Cocobetaine | 16.44 | 12.89 |
| Propanediol | 16.44 | 12.89 |
| Phenoxyethanol | 1.23 | 0.96 |
| DI Water | 93.16 | 73.02 |
| Total: | 127.59 | 100 |

Formulation B2

| Component | Wt/Gallon (oz) | Wt % |
|---|---|---|
| BiAloe Powder | 0.72 | 0.57 |
| Cocobetaine | 24.66 | 19.30 |
| Propanediol | 16.44 | 12.86 |
| Phenoxyethanol | 1.23 | 0.96 |
| DI Water | 84.75 | 66.31 |
| Total: | 127.80 | 100 |

Formulation B3

| Component | Wt/Gallon (oz) | Wt % |
|---|---|---|
| BiAloe Powder | 1.35 | 1.06 |
| Cocobetaine | 32.88 | 25.73 |
| Propanediol | 32.88 | 25.73 |
| Phenoxyethanol | 1.23 | 0.96 |
| DI Water | 59.46 | 46.52 |
| Total: | 127.80 | 100 |

Formulation B4

| Component | Wt/Gallon (oz) | Wt % |
|---|---|---|
| BiAloe Powder | 1.28 | 1 |
| Cocobetaine | 24.66 | 19.30 |
| Propanediol | 31.24 | 24.44 |
| Phenoxyethanol | 0.66 | 0.52 |
| DI Water | 69.96 | 54.74 |
| Total: | 127.80 | 100 |

Formulation C

| Component | Wt/Gallon (oz) | Wt % |
|---|---|---|
| BiAloe Powder | 0.315 | 0.25 |
| Xanthan Gum | 0.140 | 0.11 |
| Cocobetaine | 16.44 | 12.87 |
| Propanediol | 16.44 | 12.87 |
| Phenoxyethanol | 1.23 | 0.96 |
| DI Water | 93.16 | 72.94 |
| Total: | 127.725 | 100 |

Formulation D

| Component | Wt/Gallon (oz) | Wt % |
|---|---|---|
| BiAloe Powder | 0.315 | 0.25 |
| Xanthan Gum | 0.105 | 0.08 |
| Cocobetaine | 16.44 | 12.87 |
| Propanediol | 16.44 | 12.87 |
| Phenoxyethanol | 1.23 | 0.96 |
| DI Water | 93.16 | 72.96 |
| Total: | 127.690 | 100 |

Formulation E

| Component | Wt/Gallon (oz) | Wt % |
|---|---|---|
| BiAloe Powder | 0.315 | 0.25 |
| Xanthan Gum | 0.070 | 0.05 |
| Cocobetaine | 16.44 | 12.88 |
| Propanediol | 16.44 | 12.88 |
| Phenoxyethanol | 1.23 | 0.96 |
| DI Water | 93.16 | 72.98 |
| Total: | 127.655 | 100 |

Formulation F

| Component | Wt/Gallon (oz) | Wt % |
|---|---|---|
| BiAloe Powder | 0.315 | 0.25 |
| Xanthan Gum | 0.035 | 0.03 |
| Cocobetaine | 16.44 | 12.88 |
| Propanediol | 16.44 | 12.88 |
| Phenoxyethanol | 1.23 | 0.96 |
| DI Water | 93.16 | 73.00 |
| Total: | 127.620 | 100 |

Formulation G

| Component | Wt/Gallon (oz) | Wt % |
|---|---|---|
| BiAloe Powder | 0.315 | 0.25 |
| Xanthan Gum | 0.014 | 0.01 |
| Cocobetaine | 16.44 | 12.88 |
| Propanediol | 16.44 | 12.88 |
| Phenoxyethanol | 1.23 | 0.96 |
| DI Water | 93.16 | 73.01 |
| Total: | 127.725 | 100 |

Formulation H1

| Component | Wt/Gallon (oz) | Wt % |
|---|---|---|
| BiAloe Powder | 0.32 | 0.25 |
| Methyl Cellulose | 0.41 | 0.32 |
| Cocobetaine | 16.44 | 12.84 |
| Propanediol | 16.44 | 12.84 |
| Phenoxyethanol | 1.23 | 0.96 |
| DI Water | 93.16 | 72.78 |
| Total: | 127.725 | 100 |

Formulation H2

| Component | Wt/Gallon (oz) | Wt % |
|---|---|---|
| BiAloe Powder | 0.32 | 0.25 |
| Methyl Cellulose | 0.31 | 0.24 |
| Cocobetaine | 16.44 | 12.85 |
| Propanediol | 16.44 | 12.85 |
| Phenoxyethanol | 1.23 | 0.96 |
| DI Water | 93.16 | 72.84 |
| Total: | 128 | 100 |

Formulation H3

| Component | Wt/Gallon (oz) | Wt % |
|---|---|---|
| BiAloe Powder | 0.32 | 0.25 |
| Methyl Cellulose | 0.21 | 0.16 |
| Cocobetaine | 16.44 | 12.86 |
| Propanediol | 16.44 | 12.86 |
| Phenoxyethanol | 1.23 | 0.96 |
| DI Water | 93.16 | 72.90 |
| Total: | 127.180 | 100 |

Formulation H4

| Component | Wt/Gallon (oz) | Wt % |
|---|---|---|
| BiAloe Powder | 0.32 | 0.25 |
| Methyl Cellulose | 0.10 | 0.08 |
| Cocobetaine | 16.44 | 12.88 |
| Propanediol | 16.44 | 12.88 |
| Phenoxyethanol | 1.23 | 0.96 |
| DI Water | 93.16 | 72.96 |
| Total: | 127.725 | 100 |

Formulation H5

| Component | Wt/Gallon (oz) | Wt % |
|---|---|---|
| BiAloe Powder | 0.32 | 0.25 |
| Methyl Cellulose | 0.04 | 0.03 |
| Cocobetaine | 16.44 | 12.88 |
| Propanediol | 16.44 | 12.88 |
| Phenoxyethanol | 1.23 | 0.96 |
| DI Water | 93.16 | 73 |
| Total: | 127.63 | 100 |

Formulation I1

| Component | Wt/Gallon (oz) | Wt % |
|---|---|---|
| BiAloe Powder | 0.32 | 0.25 |
| Sodium Carboxymethylcellulose | 0.41 | 0.32 |
| Cocobetaine | 16.44 | 12.84 |
| Propanediol | 16.44 | 12.84 |
| Phenoxyethanol | 1.23 | 0.96 |
| DI Water | 93.16 | 72.78 |
| Total: | 127.725 | 100 |

Formulation I2

| Component | Wt/Gallon (oz) | Wt % |
|---|---|---|
| BiAloe Powder | 0.32 | 0.25 |
| Sodium Carboxymethylcellulose | 0.31 | 0.24 |
| Cocobetaine | 16.44 | 12.85 |
| Propanediol | 16.44 | 12.85 |
| Phenoxyethanol | 1.23 | 0.96 |
| DI Water | 93.16 | 72.84 |
| Total: | 127.90 | 100 |

Formulation I3

| Component | Wt/Gallon (oz) | Wt % |
|---|---|---|
| BiAloe Powder | 0.32 | 0.25 |
| Sodium Carboxymethylcellulose | 0.21 | 0.16 |
| Cocobetaine | 16.44 | 12.86 |
| Propanediol | 16.44 | 12.86 |
| Phenoxyethanol | 1.23 | 0.96 |
| DI Water | 93.16 | 72.90 |
| Total: | 127.90 | 100 |

Formulation I4

| Component | Wt/Gallon (oz) | Wt % |
|---|---|---|
| BiAloe Powder | 0.32 | 0.25 |
| Sodium Carboxymethylcellulose | 0.10 | 0.08 |
| Cocobetaine | 16.44 | 12.88 |
| Propanediol | 16.44 | 12.88 |
| Phenoxyethanol | 1.23 | 0.96 |
| DI Water | 93.16 | 72.94 |
| Total: | 127.69 | 100 |

Formulation I5

| Component | Wt/Gallon (oz) | Wt % |
|---|---|---|
| BiAloe Powder | 0.32 | 0.25 |
| Sodium Carboxymethylcellulose | 0.04 | 0.03 |
| Cocobetaine | 16.44 | 12.88 |
| Propanediol | 16.44 | 12.88 |
| Phenoxyethanol | 1.23 | 0.96 |
| DI Water | 93.16 | 73 |
| Total: | 127.63 | 100 |

Formulation I6

| Component | Wt/Gallon (oz) | Wt % |
|---|---|---|
| BiAloe Powder | 0.32 | 0.25 |
| Sodium Carboxymethylcellulose | 0.56 | 0.44 |
| Cocobetaine | 16.44 | 12.83 |
| Propanediol | 16.44 | 12.83 |
| Phenoxyethanol | 1.23 | 0.96 |
| DI Water | 93.16 | 72.70 |
| Total: | 128.15 | 100 |

Formulation J1

| Component | Wt/Gallon (oz) | Wt % |
|---|---|---|
| BiAloe Powder | 0.32 | 0.25 |
| Gellan Gum | 0.04 | 0.03 |
| Cocobetaine | 16.44 | 12.88 |

-continued

Formulation J1

| Component | Wt/Gallon (oz) | Wt % |
|---|---|---|
| Propanediol | 16.44 | 12.88 |
| Phenoxyethanol | 1.23 | 0.96 |
| DI Water | 93.16 | 73 |
| Total: | 127.63 | 100 |

Formulation J2

| Component | Wt/Gallon (oz) | Wt % |
|---|---|---|
| BiAloe Powder | 0.32 | 0.25 |
| Gellan Gum | 0.10 | 0.08 |
| Cocobetaine | 16.44 | 12.88 |
| Propanediol | 16.44 | 12.88 |
| Phenoxyethanol | 1.23 | 0.96 |
| DI Water | 93.16 | 72.96 |
| Total: | 127.725 | 100 |

Formulation J3

| Component | Wt/Gallon (oz) | Wt % |
|---|---|---|
| BiAloe Powder | 0.315 | 0.25 |
| Gellan Gum | 0.21 | 0.16 |
| Cocobetaine | 16.44 | 12.86 |
| Propanediol | 16.44 | 12.86 |
| Phenoxyethanol | 1.23 | 0.96 |
| DI Water | 93.16 | 72.90 |
| Total: | 127.80 | 100 |

Formulation J4

| Component | Wt/Gallon (oz) | Wt % |
|---|---|---|
| BiAloe Powder | 0.32 | 0.25 |
| Gellan Gum | 0.31 | 0.24 |
| Cocobetaine | 16.44 | 12.85 |
| Propanediol | 16.44 | 12.85 |
| Phenoxyethanol | 1.23 | 0.96 |
| DI Water | 93.16 | 72.84 |
| Total: | 127.90 | 100 |

Formulation J5

| Component | Wt/Gallon (oz) | Wt % |
|---|---|---|
| BiAloe Powder | 0.32 | 0.25 |
| Gellan Gum | 0.41 | 0.32 |
| Cocobetaine | 16.44 | 12.87 |
| Propanediol | 16.44 | 12.87 |
| Phenoxyethanol | 1.23 | 0.96 |
| DI Water | 93.16 | 72.78 |
| Total: | 128 | 100 |

Formulation K1

| Component | Wt/Gallon (oz) | Wt % |
|---|---|---|
| BiAloe Powder | 0.32 | 0.22 |
| Sodium Carboxymethylcellulose | 0.21 | 0.15 |
| Cocobetaine | 16.44 | 11.40 |
| Propanediol | 32.88 | 22.80 |
| Phenoxyethanol | 1.23 | 0.85 |
| DI Water | 93.16 | 64.59 |
| Total: | 127.725 | 100 |

Formulation K2

| Component | Wt/Gallon (oz) | Wt % |
|---|---|---|
| BiAloe Powder | 0.32 | 0.26 |
| Sodium Carboxymethylcellulose | 0.21 | 0.18 |
| Cocobetaine | 16.44 | 13.75 |
| Propanediol | 8.22 | 6.87 |
| Phenoxyethanol | 1.23 | 1.03 |
| DI Water | 93.16 | 77.91 |
| Total: | 119.58 | 100 |

Formulation L

| Component | Weight | Wt % |
|---|---|---|
| DI water | 20 oz (566.99 g) | 70.70 |
| BiAloe Powder | 0.068 oz (1.92 g) | 0.24 |
| Xanthan Gum | 0.29 g | 0.036 |
| Cocobetaine | 4 oz (113.4 g) | 14.1 |
| Propanediol | 4 oz (113.4 g) | 14.1 |
| Sodium Gluconate | 0.2 oz | 0.71 |
| TEA to adjust pH to 6.5 | ~~ | ~~ |

Formulation M

| Component | Weight | Wt % |
|---|---|---|
| DI water | 20 oz (566.99 g) | 70.70 |
| BiAloe Powder | 0.068 oz (1.92 g) | 0.24 |
| Hydrolyzed Cellulose | 1.32 g | 0.16 |
| Cocobetaine | 4 oz (113.4 g) | 14.1 |
| Propanediol | 4 oz (113.4 g) | 14.1 |
| Sodium Gluconate | 0.2 oz | 0.71 |
| TEA to adjust pH to 6.5 | ~~ | ~~ |

Formulation N

| Component | Weight | Wt % |
|---|---|---|
| DI water | 20 oz (566.99 g) | 70.70 |
| BiAloe Powder | 0.068 oz (1.92 g) | 0.24 |
| Hydroxypropyl Guar | 1.29 g | 0.16 |
| Cocobetaine | 4 oz (113.4 g) | 14.1 |
| Propanediol | 4 oz (113.4 g) | 14.1 |
| Sodium Gluconate | 0.2 oz | 0.71 |
| TEA to adjust pH to 6.5 | ~~ | ~~ |

Formulation O

| Component | Weight | Wt % |
|---|---|---|
| DI water | 20 oz (566.99 g) | 66.1 |
| BiAloe Powder | 0.068 oz (1.92 g) | 0.22 |
| Pectin | 0.10 g | 0.012 |
| Cocobetaine | 5 oz (113.4 g) | 16.5 |
| Propanediol | 4 oz (113.4 g) | 13.2 |
| Hydroxypropyltrimonium | 1 oz | 3.3 |
| Sodium Gluconate | 0.2 oz | 0.66 |
| TEA to adjust pH to 6.5 | ~~ | ~~ |

Formulation P

| Component | Weight | Wt % |
|---|---|---|
| DI water | 20 oz (566.99 g) | 66.0 |
| BiAloe Powder | 0.068 oz (1.92 g) | 0.22 |
| Guar Gum | 1 g | 0.12 |
| Cocobetaine | 5 oz (113.4 g) | 16.5 |
| Propanediol | 4 oz (113.4 g) | 13.2 |
| Hydroxypropyltrimonium | 1 oz (28.3 g) | 3.2 |
| Sodium Gluconate | 0.2 oz | 0.66 |
| TEA to adjust pH to 6.5 | ~~ | ~~ |

Formulation Q

| Component | Weight | Wt % |
|---|---|---|
| DI water | 20 oz (566.99 g) | 66.1 |
| BiAloe Powder | 0.068 oz (1.92 g) | 0.22 |
| Sodium Hyaluronate | 0.3 g | 0.034 |
| Cocobetaine | 5 oz (113.4 g) | 16.5 |
| Propanediol | 4 oz (113.4 g) | 13.2 |
| Sodium Gluconate | 0.2 oz | 0.66 |
| TEA to adjust pH to 6.5 | ~~ | ~~ |

For formulations A, C, D, E, F, G and L, Xanthan Gum was used as a thickener to not only increase the heat capacity of the mixture but also hinder the concentrate from separating over time.

Figure 5B:
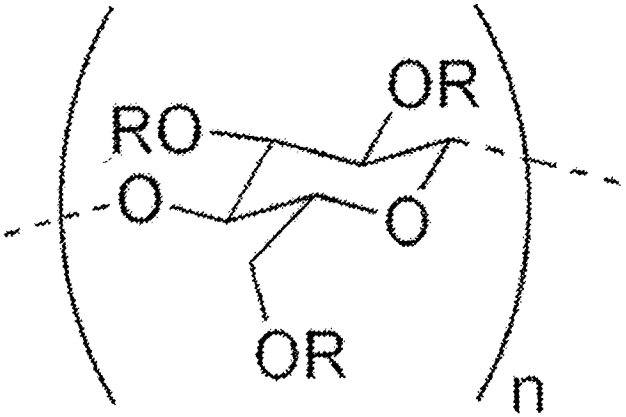
FIGS. 5A-C show various polysaccharides.
Figure 5A:
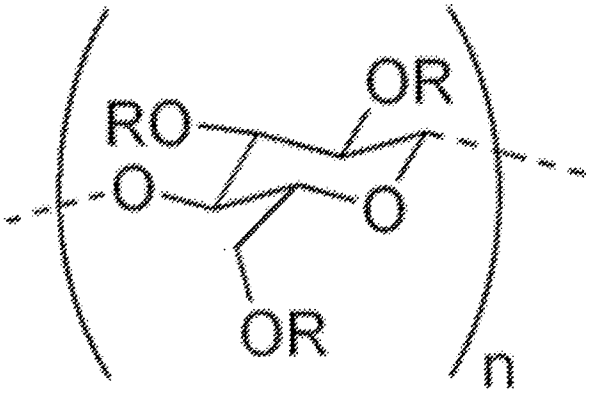
Figure 5C:
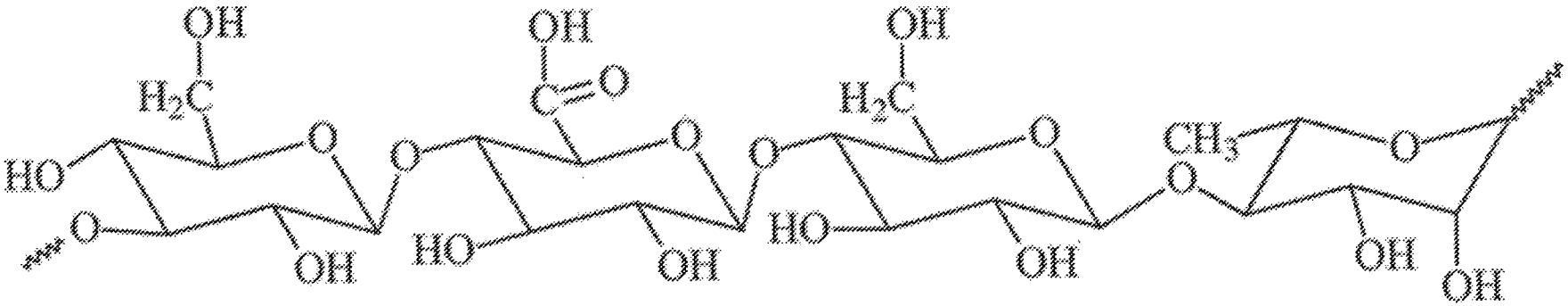

As alternative Thickening agents, additional cellulose was selected. In some embodiments, saccharides are used as thickeners. In some embodiments, the saccharides are celluloses. In some embodiments, the celluloses are synthetic. Without being bound to any particular theory, it was proposed that, with a simpler structure off the cellulose backbone, higher miscibility could be achieved along with good thermal stability using one or more of methylcellulose, carboxymethylcellulose (e.g., the sodium salt or potassium salt), and/or gellan gum. Three derivatives selected for testing were methylcellulose (FIG. 5A (where R=H or $CH_3$). Series H; properties: hydrophilic, soluble in cold water (may precipitate at 40° C. or higher, can act as a thickener and/or and emulsifier), sodium carboxymethylcellulose (FIG. 5B (where R=H or $CH_2CO_2H$); Series I; properties: hydrophilic, readily soluble in hot and cold water; good compatibility with glycols and other cellulose derivatives, anionic), and low acyl gellan gum (FIG. 5C; Series J; Properties: readily soluble in water, holds particles in suspension well without significantly increasing viscosity, part of class of hydrogels with good heat resistance). All of these celluloses were chosen because they have favorable properties for the tests being considered.

A series of formulations with cellulose, cellulose derivatives, gums, sodium hyaluronate, was made to assess each formulation's ability to extinguish Class A, Class B, Class D, and Class K Fires along with their ability to remain an homogenous concentrate/solution over 90 days periods (separation test).

Figure 6A:
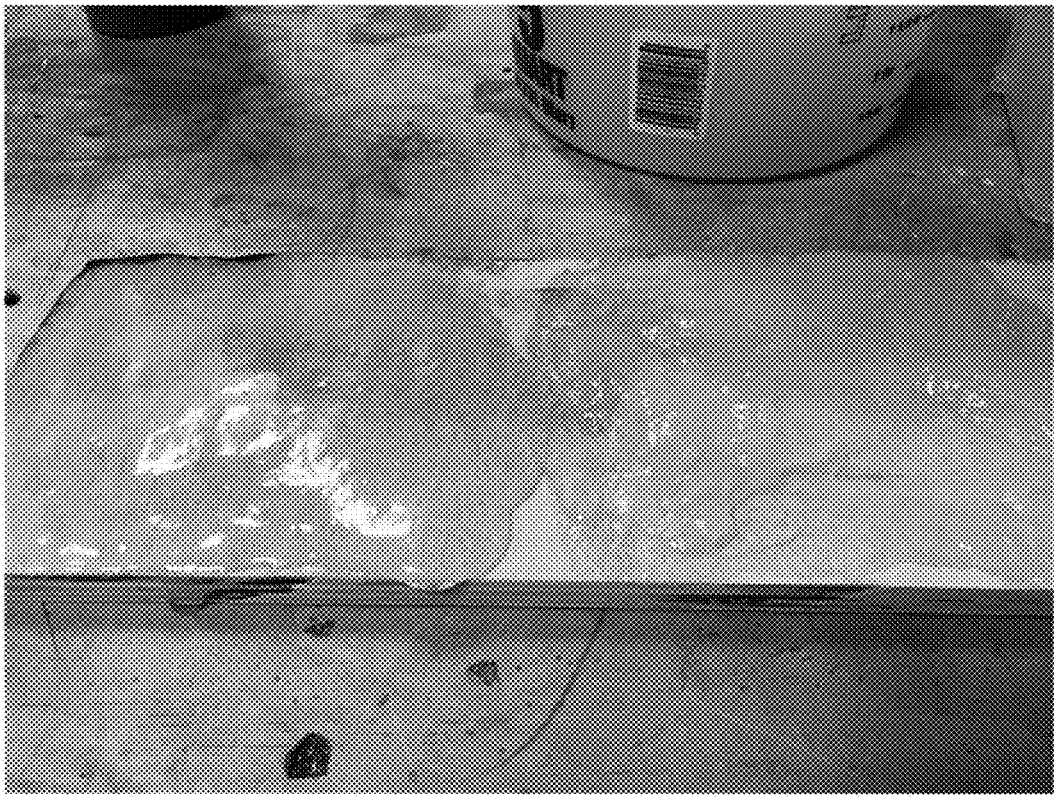
FIGS. 6A-B show embodiments of compositions disclosed herein before (FIG. 6A) and after (FIG. 6B) heat treatment.
Figure 6B:
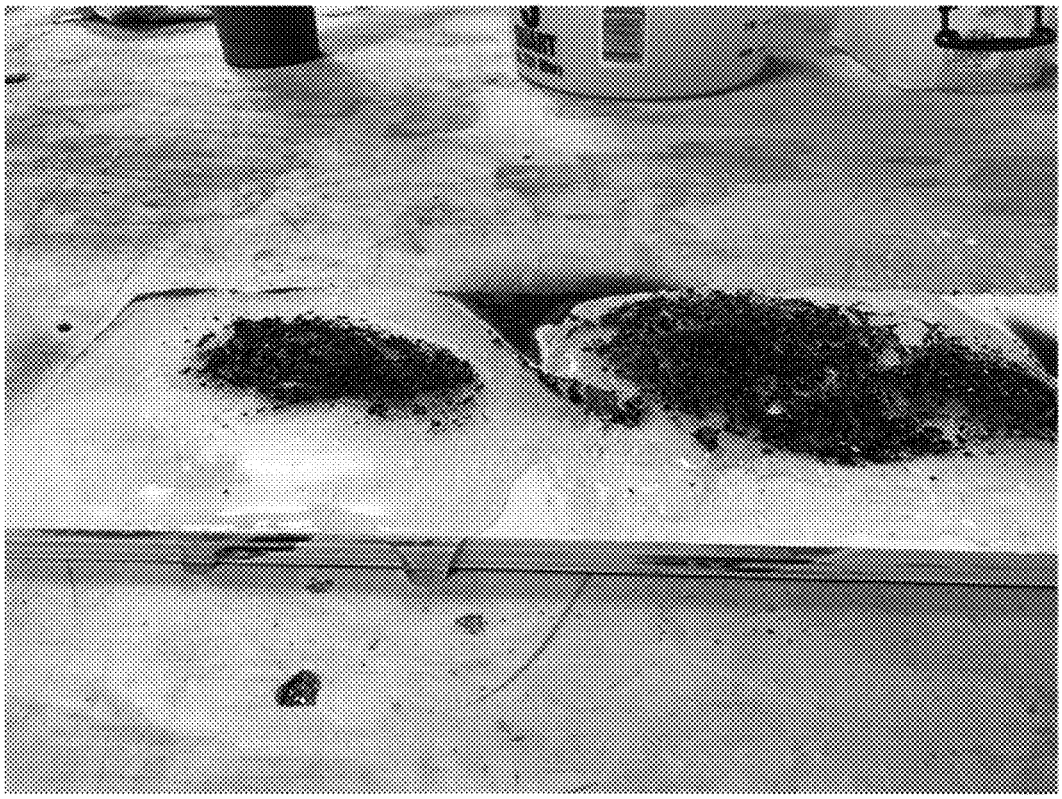

Utilizing Sodium Carboxymethylcellulose as a thickening ingredient for the wetting agent, a gel was made to compare its thermal stability with the previous gel made with Xanthan Gum. Each gel was applied to a piece of wood, side by side, to be then exposed to a flame. A torch, with a flame reaching up to 2500° C., was applied to the center of each gel for one minute. As shown in FIG. 6A (before heating) and FIG. 6B (after heating), the gels, made with Sodium Carboxymethylcellulose (Opal Gel) (on the left) and Xanthan Gum (on the right) substantially protected a wood surface below the gels after heating. Both gels retained much of their structure. It was also noted that both had demonstrated extinguishing properties.

Flammable liquids such as gasoline, diesel and several other products have a lower specific gravity than water (they are less dense than water). Consequently, these products will float on top of water so they can continue to release vapors given the correct temperature. Even if a small spill fire was "knocked down" with plain water, fuel vapors can continue to release and reignite or "flashback."

While a plain water fog application may cool the flammable liquid and disrupt vapor (from a small fire), such as when a spill spreads the liquid over a small area, a flammable liquid with greater size or much depth creates a major problem. 1. Water application will not effectively cool the flammable liquid for a positive effect. 2. Water boils at 212° F. If the water reaches 212° F., the boiling will cause major disturbance to the fuel surface allowing more surface to release vapor, thereby increasing fire activity. 3. Any disruption of the fuel's surface increases surface area available to release vapors. While any water stream can increase fire activity, solid streams plunging into the liquid will cause a dramatic increase. 4. Once the flammable liquid fire is of any size, water application is ineffective.

Hydrocarbons are constituted with carbon and hydrogen. Their characteristic is their lack of affinity (doesn't mix) with water. We can identify 3 families: Light hydrocarbons, e.g. gasoline, heptane, cyclohexane, terpene; Heavy hydrocarbons, e.g. fuel-oil, diesel, kerosene; and Aromatic hydrocarbons, e.g. benzene, toluene. Not being miscible with water, they can be extinguished with "ordinary" foams.

Polar solvents include O (Oxygen) or N (Nitrogen) atoms or halogens: Cl, Br, F or I. Their characteristic is their affinity for water (i.e. they mix easily with it). These materials break down regular foam.

Common groups of Polar Solvents: Alcohols, e.g. methanol, ethanol, isopropanol, etc.; Ketones and aldehydes, e.g. acetone, acetaldehyde, methyl ethyl ketone (MEK), MIBK, etc.; Esters, e.g. Ethyl acetate, etc.; Ethers, e.g. diethyl ether, MTBE, THF, etc.; Glycols, e.g. combinations of alcohol and ether such as MEG, MPG, Butoxyethanol, butyl carbitol, etc.; Amines, e.g. trimethylamine, etc.; Acids, e.g. acetic acid, propionic acid, etc.

Each formulation was tested to extinguish Class A, Class B (polar and nonpolar), K and D fires, along with re-ignition test. Each formulation was also tested using saltwater to evaluate the performances when fresh water is not available. See Tables 7 and 8 for results.

Before testing each solution for its application to the different types of fires, the fire extinguishers were pressurized with an air compressor to about 120 psi. The fire extinguisher used in each test a smooth bore nozzle. The testing was performed outside at a temperature of about 76° F. with a relative humidity of 14% and calm winds.

For Class A fires, three different materials were set on fire and used to test each formulation: wood, paper, and plastics. For example, a fire using 2 wood pallets broken down into pieces was used for the wood fire. The fire was set using paper and a torch. Once the wood was totally engulfed in flames, a fire extinguishing composition was sprayed from the extinguisher at the burning material. At a 45° angle from about 5 feet away. For Class A fires, it was concluded that the fire extinguished with each composition in less than 5 s.

For class B fires, the following materials were each set on fire and used to test each formulation separately: oil, gas, diesel, jet fuel, hydraulic oil, ethanol, acetone, and brake kleen. For example, 2 quarts of oil in a metal container was set on fire using a torch. After about 30 seconds, the oil was totally engulfed in flames. At that time, a fire extinguishing composition was sprayed from the extinguisher at the burning material at a 45° angle from about 5 feet away.

The following table shows the result of testing the different formulations on diesel fuel fire:

TABLE 7

(for non-Polar solvents)

| Formulation tested with Diesel Fuel | Time to extinguish/fresh water | Time to extinguish/Saltwater |
|---|---|---|
| A | 2.5 s no reignition | 3 s no reignition |
| B1 | 3.5 s re-ignited | 3.5 s re-ignited |
| B2 | 3 s reignited | 3 s re-ignited |
| B3 | 3 s re-ignited | 3.5 s re-ignited |
| B4 | 2.5 s re-ignited | 3.5 s re-ignited |
| C | 2.5 s re-ignite then goes out | 3 s re-ignite then goes out |
| D | 2.5 s re-ignite then goes out | 3 s re-ignite then goes out |
| E | 2.5 s re-ignite | 3 s reignite |
| F | 2.5 s re-ignite | 3 s reignite |
| G | 2.5 s no re-ignition | 3 s re-ignited |
| H1 | 2.5 s no re-ignition | 3 s re-ignited |
| H2 | 2.5 s re-ignited | 3 s re-ignited |
| H3 | 2 s re-ignited | 3 s re-ignited |
| H4 | 2.5 s re-ignited | 3 s re-ignited |
| H5 | 2.5 s re-ignited | 3 s re-ignited |
| I1 | 2.5 s no re-ignition | 3 s re-ignition |
| I2 | 2.5 s re-ignited | 3 s re-ignition |
| I3 | 2 s re-ignited | 3 s re-ignition |
| I4 | 2.5 s re-ignited | 3 s re-ignition |
| I5 | 2 s re-ignited | 3 s re-ignition |
| I6 | 2.5 s re-ignited | 3 s re-ignition |
| J1 | 2.5 s re-ignited | 3 s re-ignite |
| J2 | 2.5 s re-ignited | 3 s re-ignite |
| J3 | 2.5 s re-ignited | 3 s re-ignite |
| J4 | 2.5 s re-ignited | 3 s re-ignite |
| J5 | 2.5 s no re-ignition | 2.5 s re-ignition |
| K1 | 2.5 s re-ignite | 3 s re-ignite |
| K2 | 2.5 s re-ignite | 3 s re-ignite |
| L | 2.5 s re-ignite | 3 s re-ignite |
| M | 2.5 s re-ignite | 3 s re-ignite |
| N | 2.5 s re-ignite | 3 s re-ignite |
| O | 2.5 s re-ignite | 3 s re-ignite |
| P | 2 s re-ignite | 3 s re-ignite |
| Q | 2 s re-ignite | 3 s re-ignite |

The formulations shown have a trend to put out fire faster when more surfactant is present, i.e. the greater the surfactant, the faster the fire is extinguished by layering a bigger foam. However, the foam is not stable and re-ignition is observed when polysaccharides are present in concentrations lower than 0.32%. When saltwater is used, Xanthan Gum seems to be the best choice to use as a polysaccharide. Xanthan solutions are highly pseudoplastic, the ordered conformation is stabilized by hydrogen bonds. The acemannan and Xanthan form a rigid helicoid conformation, and the matrix's conformation is relatively insensitive with Temperature increase. The matrix backbone is protected by side chains. Xanthan Gum helps the solution to be stable, preventing the disperse phase from coalescing.

The following table shows the result of testing the different formulations on ethanol fuel fire. It should be noted that ethanol and Acetone give about the same results.

TABLE 9

(for Polar solvents)

| Formulation tested with ethanol | Time to extinguish/fresh water | Time to extinguish/Saltwater |
|---|---|---|
| A | 3 s no reignition | 3.5 s no reignition |
| B1 | 3.5 s re-ignited | 4 s re-ignited |
| B2 | 3 s reignited | 3.5 s re-ignited |
| B3 | 3 s re-ignited | 3.5 s re-ignited |
| B4 | 2.5 s re-ignited | 3.5 s re-ignited |
| C | 3 s re-ignite | 3.5 s re-ignite |
| D | 3 s re-ignite | 3.5 s re-ignite |
| E | 3 s re-ignite | 3.5 s reignite |
| F | 3 s re-ignite | 3.5 s reignite |
| G | 3 s reignite | 3.5 s re-ignited |
| H1 | 3 s no re-ignition | 3.5 s re-ignited |
| H2 | 3 s re-ignite | 3.5 s re-ignited |
| H3 | 2.5 s re-ignite | 3.5 s re-ignited |
| H4 | 3 s re-ignite | 3.5 s re-ignited |
| H5 | 3 s re-ignite | 3.5 s re-ignited |
| I1 | 2.5 s no re-ignition | 3 s re-ignition |
| I2 | 3 s no reignition | 3.5 s re-ignition |
| I3 | 2.5 s re-ignite | 3.5 s re-ignition |
| I4 | 2.5 s re-ignite | 3.5 s re-ignition |
| I5 | 2s no re-ignition | 3.5 s re-ignition |
| I6 | 2.5 s re-ignite | 3.5 s re-ignition |
| J1 | 3 s re-ignite | 3 s re-ignite |
| J2 | 2.5 s re-ignite | 3 s re-ignite |
| J3 | 2.5 re-ignite | 3 s re-ignite |
| J4 | 2.5 re-ignite | 3 s re-ignite |
| J5 | 2.5 s no re-ignition | 2.5 s re-ignition |
| K1 | 3 s re-ignite | 3s re-ignite |
| K2 | 3 s re-ignite | 3 s re-ignite |
| L | 2.5 s re-ignite | 3 s re-ignite |
| M | 2.5 s re-ignite | 3 s re-ignite |
| N | 2.5 s re-ignite | 3 s re-ignite |
| O | 2.5 s re-ignite | 3 s re-ignite |
| P | 2s re-ignite | 3 s re-ignite |
| Q | 2s re-ignite | 3 s re-ignite |

For class D fires, 18 ounces blocks of magnesium were ignited using a torch. Once the block was completely engulfed in flames, a fire extinguishing composition was sprayed from the extinguisher at the burning material at a 45° angle from about 5 feet away. Best performances were obtained with formulations A, and 16.

All preparations were prepared (using procedures as disclosed elsewhere within). Miscibility testing were performed at 4° C. (both concentrate and water) with 3% solution, 6% solution and 10% solution each time in 500 ml deionized water. Each Solution was then mixed at 60 rpm, with a maximum of 100 rotations allowed to observe the miscibility performances. APEX-V ExptSamp 1 required higher shear, mixing at 250 rpm before total dissolution is observed with absolutely no separation at 4° C. Both concentrate and diluted complexes were tested at 0° C. and 50° C. for 30 days with absolutely no separation. In some embodiments, sodium gluconate is the neutralized salt of gluconic acid. It has excellent chelating properties to bind metal ions especially iron and copper over a wide range pH range. It is also a natural alternative to synthetic chelating agents. In some embodiments, various thickeners and hydrocolloids are used. In some embodiments, high molecular weight polysaccharides are used. Some are negatively charged, some are nonionic, some are positively charged. As shown herein, pectin, guar gum, agar gum, sodium hyaluronate, xanthan gum, hydrolyzed cellulose, hydroxypropyl guar, and cationic guar gum were tested. As shown herein, carbomer (940 and 980) which are synthetic carboxy vinyl polymers crosslinked with ethers were tested. These have a high level of biodegradability (but are not naturally derived). In some embodiments, hydroxypropyltrimonium honey is added to add multivalent cations and ionic strength. Other cationic surfactants could be used, including biodegradable and naturally derived ones. In some embodiments, charged polymer/surfactants are used which can enhance the stability of foam at the air/water interface. In some embodiments, these surfactants also enhance gas permeability and encapsulation. It was found that some polysaccharides have synergistic interactions with acemannan, xanthan being one of them.

APEX-V concentrate will eventually crystallize at low freezing temperatures. In some embodiments, several additives were added to lower the freezing point.

The following formulations were proposed:

| Formulation APEX-V CWF (Cold Weather Formula) | | State at −15° C. |
|---|---|---|
| APEX-V CWF1 | | Liquid |
| DI water + Calcium Chloride | 93.16 oz (72.79 wt %) | |
| BiAloe | 0.31 oz (0.24 wt %) | |
| Xanthan Gum | 0.41 oz (0.32 wt %) | |
| Cocobetaine | 16.44 oz (12.84 wt %) | |
| 1,3 Propanediol | 16.44 oz (12.84 wt %) | |
| Phenoxyethanol | 1.23 oz (0.96 wt %) | |
| APEX-V CWF2 | | Frozen |
| DI water + 10% Nabr | 93.16 oz | |
| BiAloe | 0.31 oz | |
| Xanthan Gum | 0.41 oz | |
| Cocobetaine | 16.44 oz | |
| 1,3 Propanediol | 16.44 oz | |
| Phenoxyethanol | 1.23 oz | |
| APEX-V CWF3 | | Frozen |
| DI water + 60% Potassium Acetate | 93.16 oz | |
| BiAloe | 0.31 oz | |
| Xanthan Gum | 0.41 oz | |
| Cocobetaine | 16.44 oz | |
| 1,3 Propanediol | 16.44 oz | |
| Phenoxyethanol | 1.23 oz | |
| APEX-V CWF4 | | Frozen |
| DI water + 10% Kbr | 93.16 oz | |
| BiAloe | 0.31 oz | |
| Xanthan Gum | 0.41 oz | |
| Cocobetaine | 16.44 oz | |
| 1,3 Propanediol | 16.44 oz | |
| Phenoxyethanol | 1.23 oz | |
| APEX-V CWF5 | | Frozen |
| DI water + 10% NH4I | 93.16 oz | |
| BiAloe | 0.31 oz | |
| Xanthan Gum | 0.41 oz | |
| Cocobetaine | 16.44 oz | |
| 1,3 Propanediol | 16.44 oz | |
| Phenoxyethanol | 1.23 oz | |
| APEX-V CWF6 | | Liquid |
| DI water + 60% Sodium Lactate | 93.16 oz | |
| BiAloe | 0.31 oz | |
| Xanthan Gum | 0.41 oz | |
| Cocobetaine | 16.44 oz | |
| 1,3 Propanediol | 16.44 oz | |
| Phenoxyethanol | 1.23 oz | |
| APEX-V CWF7 | | Frozen |
| DI water + 10% Ammonium Citrate | 93.16 oz | |

-continued

| Formulation APEX-V CWF (Cold Weather Formula) | | State at −15° C. |
|---|---|---|
| BiAloe | 0.31 oz | |
| Xanthan Gum | 0.41 oz | |
| Cocobetaine | 16.44 oz | |
| 1,3 Propanediol | 16.44 oz | |
| Phenoxyethanol | 1.23 oz | |
| APEX-V CWF8 | | Liquid |
| DI water + 60% Potassium Lactate | 93.16 oz | |
| BiAloe | 0.31 oz | |
| Xanthan Gum | 0.41 oz | |
| Cocobetaine | 16.44 oz | |
| 1,3 Propanediol | 16.44 oz | |
| Phenoxyethanol | 1.23 oz | |
| APEX-V CWF9 | | Frozen |
| DI water + Calcium iodide | 93.16 oz | |
| BiAloe | 0.31 oz | |
| Xanthan Gum | 0.41 oz | |
| Cocobetaine | 16.44 oz | |
| 1,3 Propanediol | 16.44 oz | |
| Phenoxyethanol | 1.23 oz | |
| APEX-V CWF10 | | Liquid |
| DI water + 60% Sodium Lactate 60% Potassium Lactate | 93.16 oz | |
| BiAloe | 0.31 oz | |
| Xanthan Gum | 0.41 oz | |
| Cocobetaine | 16.44 oz | |
| 1,3 Propanediol | 16.44 oz | |
| Phenoxyethanol | 1.23 oz | |

The different formulations were tested on Class A, B, C, D and K fires, the results are summarized in Table 9.

TABLE 9

| Formulation APEX-V CWF (Cold Weather Formula) | Class A | Class B Nonpolar | Class B polar | Class D | Class K |
|---|---|---|---|---|---|
| APEX-V CWF1 | 2 s | 3.6 s | 3.8 s | 7 s | 5 s |
| APEX-V CWF2 | 2.4 s | 3.7 s | 4 s | 8 s | 5.3 s |
| APEX-V CWF3 | 1.9 s | 2.7 s | 2.4 s | 5 s | 4.3 s |
| APEX-V CWF4 | 3.2 s | 3.8 s | 3.2 s | 5 s | 3.9 s |
| APEX-V CWF5 | 4 s | 5.2 s | 5 s | 5.4 s | 5 s |
| APEX-V CWF6 | 1.7 s | 2.4 s | 2.6 s | 5 s | 3.5 s |
| APEX-V CWF7 | 3 s | 4.7 s | 4.5 s | 6 s | 5 s |
| APEX-V CWF8 | 1.5 s | 2.4 s | 2.3 s | 6 s | 3.3 s |
| APEX-V CWF9 | 2.9 s | 3.4 s | 3.5 s | 7 s | 4 s |
| APEX-V CWF10 | 1.3 s | 2.8 s | 2.9 s | 5.4 s | 3.5 s |

As illustrated in Table 9, only 3 out of the 10 formulations tested show really good results. Those are the formulations containing Potassium Lactate, Sodium Lactate, and a combination of both, i.e. formulations APEX-V CWF6, APEX-V CWF8, and APEX-V CWF10.

In some embodiments, Glycine Betaine is added. Glycine betaine is an important nontoxic osmoprotectant. It is believed that potassium lactate and sodium lactate increase the interaction between water molecules and *Aloe vera*, thus increasing the ability for *Aloe vera* to retain water. It is believed that Glycine Betaine protects *Aloe vera* from water loss through osmosis.

The following formulation (APEX-V Gel) was tested on a metal testing table:

| Sample | Ingredients | Wt | Wt % |
|---|---|---|---|
| APEX-V Gel | DI water + 60% Potassium lactate/60% Sodium Lactate | 4 oz | 69.08 |
| | BiAloe | 0.014 oz | 0.24 |
| | Xanthan Gum | 0.1 oz | 1.73 |
| | Glycine Betaine | 0.176 oz (5 g) | 3.04 |
| | 1,3 Propanediol | 1.5 oz | 25.91 |

The results are presented in Table 10.

TABLE 10

| Time (minutes) | Temperature (° Fahrenheit) |
|---|---|
| 0 | 81 |
| 2 | 105 |
| 3 | 128 |
| 4 | 147 |
| 6 | 176 |
| 7 | 183 |
| 8 | 190 |
| 9 | 197 |
| 10 | 204 |
| 11 | 218 |
| 12 | 239 |
| 13 | 250 |
| 14 | 273 |
| 15 | 278 |
| 16 | 281 |
| 17 | 285 |
| 18 | 287 |
| 19 | 292 |
| 22 | 298 |

In some embodiments, the solution is to be mixed with paint, epoxy, etc.

A solution called "APEX V Paint" was prepared with the following ingredients:

| Sample | Ingredients | Wt | Wt % |
|---|---|---|---|
| APEX-V Paint | DI water + 60% Sodium Lactate | 20 oz | 67.91 |
| | BiAloe powder | 0.07 oz | 0.24 |
| | Xanthan Gum | 0.5 oz | 1.70 |
| | Glycine Betaine | 0.88 oz (25 g) | 2.99 |
| | 1,3 Propanediol | 8 oz | 27.16 |

Figure 7:
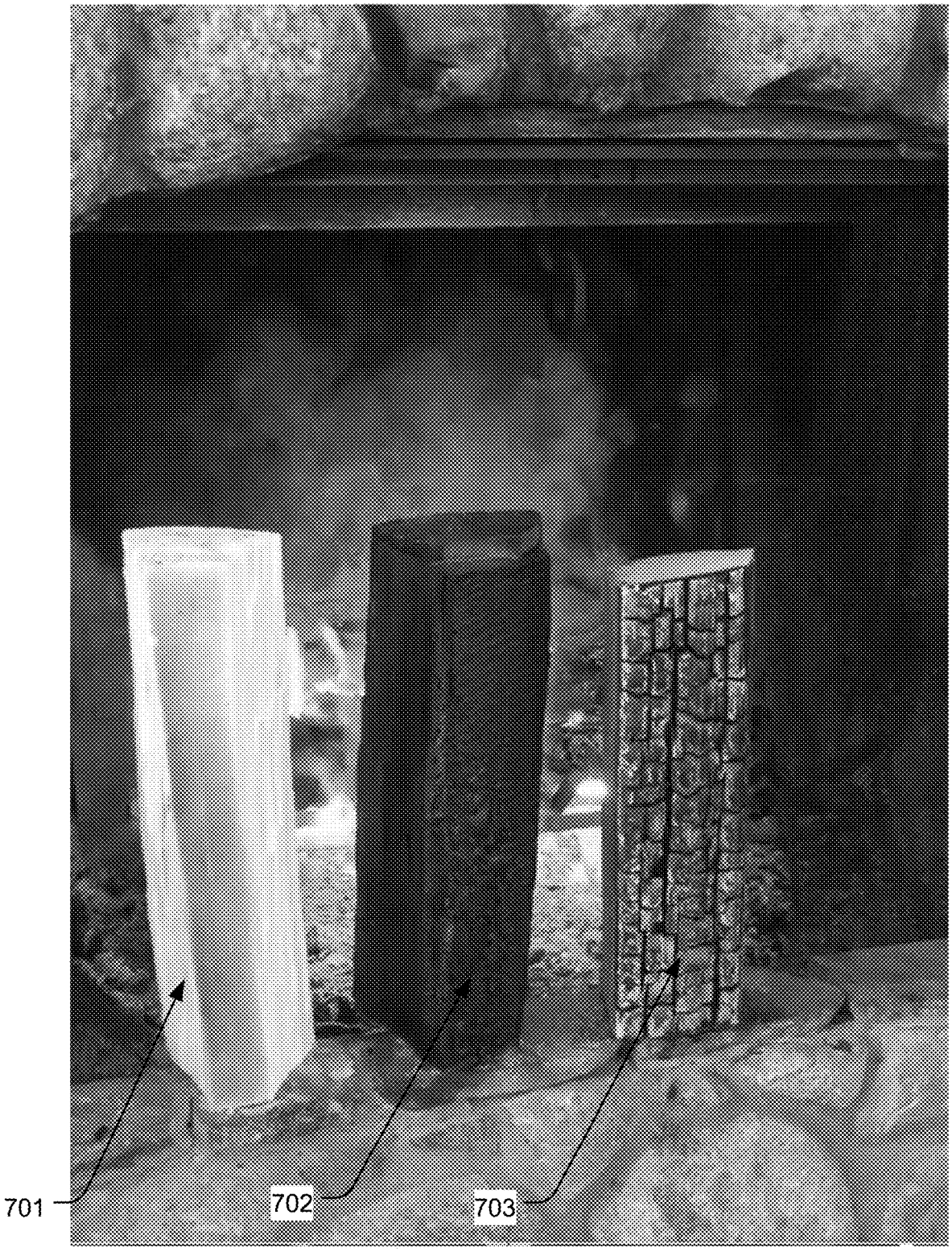
FIG. 7 shows the result of a 45 minutes exposure to a fire of 3 wood logs with 3 different treatments (701: wood log treated with paint comprising an extinguishing composition of the present invention mixed within the paint at 10% dilution; 702: wood log treated with epoxy mixed with an extinguishing composition of the present invention at 10% dilution; 703: non-treated wood log).

FIG. 7 is an illustration of the results of a 45 minutes exposure to a fire of 3 wood logs with 3 different treatments (701: wood log treated with paint comprising an extinguishing composition of the present invention mixed within the paint at 10% dilution; 702: wood log treated with epoxy mixed with an extinguishing composition of the present invention at 10% dilution; 703: non-treated wood log).

For the first test, 15 oz of paint was mixed with 5 oz of APEX-V Paint undiluted solution, i.e. about a 3:1 paint to undiluted solution weight ratio. The first wood log, i.e. 701, was painted with this paint/APEX-V Paint solution. Those of skill in the art would appreciate that other mix ratios of paint to undiluted APEX-V Paint solution are contemplated. In some embodiments, the weight ratio is equal to or about: 1:1, 2:1, 3:1, 4:1, 5:1, 6:1, 7:1, 8:1, 9:1, 10:1, 15:1, 20:1, 25:1, or ranges including and/or spanning the aforementioned values.

For the second test, 15 oz of epoxy resin was mixed with 5 oz of APEX-V Paint undiluted solution, i.e. about a 3:1 epoxy to undiluted solution weight ratio. The second wood log, i.e. 702, was painted with this epoxy resin/APEX-V Paint solution. Those of skill in the art would appreciate that other mix ratios of epoxy resin to undiluted APEX-V Paint solution are contemplated. In some embodiments, the weight ratio is equal to or about: 1:1, 2:1, 3:1, 4:1, 5:1, 6:1, 7:1, 8:1, 9:1, 10:1, 15:1, 20:1, 25:1, or ranges including and/or spanning the aforementioned values.

The third wood log, i.e. 703, was left untouched.

Thereafter, a large fire was built and was let to burn till the fire became extremely hot to simulate radiation heat created in a real fire. The three wood logs were then placed next to each other in front of the large fire. The fire was kept hot and running for the duration of the test.

After 45 minutes, the logs were removed and the following results were observed: (1) The first log, i.e. 701, treated with the paint/APEX-V Paint solution showed very little discoloration and had minimal blackening; (2) The second Log, i.e. 702, showed traces of burning but no penetration to the wood; (3) The third log, i.e. 703, was burned through about 1 inch and kept burning.

In summary, various embodiments and examples of fire extinguishing and/or suppressing compositions, systems and devices related thereto, and their methods of manufacture and use has been disclosed. Although the compositions have been disclosed in the context of various embodiments and examples, it will be understood by those skilled in the art that this disclosure extends beyond the specifically disclosed embodiments, as well as to certain modifications and equivalents thereof. This disclosure expressly contemplates that various features and aspects of the disclosed embodiments can be combined with or substituted for one another. Accordingly, the scope of this disclosure should not be limited by the particular disclosed embodiments described above but should be determined only by a fair reading of the claims that follow.

What is claimed is:

1. A fire suppressing composition concentrate comprising:
*Aloe vera* powder in an amount of about 0.24% by weight;
di-ionized water in an amount of about 67% by weight;
sodium lactate solution in an amount of about 0.1% to 5.0% by weight;
a thickening agent selected from a group consisting of guar gum, carbomer, xanthan gum, gum Arabic, pectin, *Acacia* gum, hydroxyl propyl guar, Sodium Carboxymethylcellulose in an amount of about 1.7% by weight;
glycine betaine in an amount of about 3% by weight; and
1,3-Propanediol in an amount of about 27% by weight.

2. The fire suppressing composition of claim 1, further comprising paint mixed therein at a weight ratio of about 3:1 with said composition.

3. The fire suppressing composition of claim 1, further comprising epoxy resin mixed therein at a weight ratio of about 3:1 with said composition.

4. The fire suppressing composition of claim 1, wherein said *Aloe vera* powder comprises freeze dried powder from organic *Aloe barbadensis* Miller inner leaf.

5. The fire suppressing composition of claim 1, wherein said thickening agent is xanthan gum.

6. A fire suppressing composition concentrate comprising:
*Aloe vera* powder in an amount between 0.2% and 0.3% by weight;
di-ionized water in an of between 60% and 75% by weight;
a thickening agent selected from a group consisting of guar gum, carbomer, xanthan gum, gum Arabic, pectin, *Acacia* gum, hydroxyl propyl guar, Sodium Carboxymethylcellulose in an amount between 0.2% and 2.0% by weight;
a bio-based surfactant selected from a group consisting of cocobetaine, sodium cocoamphoacetate, glycine betaine and a combination thereof in an amount between 2% and 15% by weight;
1,3-Propanediol in an amount between 5% and 29% by weight; and
a preservative selected from a group consisting of sodium phenoxyethanol, phenoxyethanol, caprylyl glycol, sorbic acid and a combination thereof in an amount between 0% and 10% by weight.

7. The fire suppressing composition of claim 6, wherein said *Aloe vera* powder comprises freeze dried powder from organic *Aloe barbadensis* Miller inner leaf.

8. The fire suppressing composition of claim 6, wherein said composition is diluted with water at a water to composition weight ratio of between 1:1 and 50:1.

9. The fire suppressing composition of claim 6, wherein said preservative is phenoxyethanol.

10. The fire suppressing composition of claim 6, wherein said bio-based surfactant is glycine betaine.

11. An article of manufacture comprising:
a fire extinguisher cannister; and
a fire suppressing composition in said cannister, wherein said composition comprises:
*Aloe vera* powder in an amount between 0.2% and 0.3% by weight;
di-ionized water in an of between 60% and 75% by weight;
a thickening agent selected from a group consisting of guar gum, carbomer, xanthan gum, gum Arabic, pectin, *Acacia* gum, hydroxyl propyl guar, Sodium Carboxymethylcellulose in an amount between 0.2% and 2.0% by weight;
a bio-based surfactant selected from a group consisting cocobetaine, sodium cocoamphoacetate, glycine betaine and a combination thereof in an amount between 2% and 15% by weight; and
1,3-Propanediol in an amount between 5% and 29% by weight.

12. The article of manufacture of claim 11, wherein said amount of *Aloe vera* powder is about 0.24% by weight.

13. The article of manufacture of claim 11, wherein said amount of de-ionized water is about 67% by weight.

14. The article of manufacture of claim 11, wherein said amount of thickening agent is about 1.7% by weight.

15. The article of manufacture of claim 11, wherein said amount of bio-based surfactant is about 3% by weight.

16. The article of manufacture of claim 11, wherein said amount of 1,3-Propanediol is about 27% by weight.

17. The article of manufacture of claim 12, wherein said amount of de-ionized water is about 67% by weight.

18. The article of manufacture of claim 17, wherein said amount of thickening agent is about 1.7% by weight.

19. The article of manufacture of claim 18, wherein said amount of bio-based surfactant is about 3% by weight.

20. The article of manufacture of claim 19, wherein said amount of 1,3-Propanediol is about 27% by weight.

21. The article of manufacture of claim 11, wherein said de-ionized water further comprises about 0.1% to 5.0% by weight of sodium lactate and about 0.1% to 5.0% by weight of potassium lactate.

* * * * *